US006343575B1

(12) United States Patent
Deckard

(10) Patent No.: US 6,343,575 B1
(45) Date of Patent: Feb. 5, 2002

(54) ROTATING/RECIPROCATING CYLINDER POSITIVE DISPLACEMENT DEVICE

(76) Inventor: Carl Robert Deckard, 720 Bastrop Hwy., Suite 108, Austin, TX (US) 78741

( * ) Notice: Subject to any disclaimer, the term of this patent is extended or adjusted under 35 U.S.C. 154(b) by 0 days.

(21) Appl. No.: 08/949,447

(22) Filed: Oct. 14, 1997

(51) Int. Cl.[7] ..... F02B 75/26
(52) U.S. Cl. ..... 123/43 R; 123/45 A; 123/50 A
(58) Field of Search ..... 123/43 R, 44 R, 123/45 R, 45 A, 50 R, 50 A, 50 B

(56) References Cited

U.S. PATENT DOCUMENTS 2,332,056 A * 10/1943 Caldwell ..... 123/50 A
3,319,615 A * 5/1967 Girerd ..... 123/43 R
5,351,657 A 10/1994 Buck
5,517,952 A 5/1996 Wielenga

FOREIGN PATENT DOCUMENTS

DE 2559200 * 7/1977 ..... 123/43 R

* cited by examiner

*Primary Examiner*—Michael Koczo
(74) *Attorney, Agent, or Firm*—Rick B. Yeager

(57) ABSTRACT

This positive displacement device features relative rotation and translation of a piston and a cylinder where the rotation accomplishes a rotary valve function and the translation accomplishes a change in chamber volume function. The preferred embodiment is a ported, single-piston, four-stroke internal combustion engine with one moving part and low emissions, a sinusoidal cam on the cylinder is confined between two fixed cams relative to the generally fixed piston. The cam creates a four-stroke translational movement of the cylinder about the piston for each revolution of the cylinder. A transfer port on the cylinder facilitates movement of the intake charge from an intake port on the piston into the combustion chamber where it is compressed, ignited, and then removed by means of the transfer port and an exhaust port on the piston.

56 Claims, 41 Drawing Sheets

| Quantity | Small Range Low | Small Range High | Large Range Low | Large Range High | Units | Notes |
|---|---|---|---|---|---|---|
| Compression ratio | 8 | 10 | 6 | 11 | | for spark ignition |
| | | | 16 | 22 | | for compression ignition |
| Piston to cylinder clearence | 0.0005 | 0.005 | | | times bore | with rings |
| | -0.025 | 0.025 | | | mm | without rings |
| Ignition timing | 5 | 15 | 0 | 25 | Degrees before TDC | |
| Exhaust port opening | 20 | 35 | 0 | 30 | Degrees before BDC | |
| Exhaust port closing | 5 | 17 | 0 | 10 | Degrees after TDC | |
| Intake port opening | 2.5 | 15 | 0 | 10 | Degrees before TDC | |
| Intake port closing | 22 | 37 | 0 | 30 | Degrees after BDC | |
| Transfer port hight | 1.2 | 1.5 | 1.2 | 2 | Times stroke | |
| Transfer port width | 68 | 72 | 60 | 80 | Degrees | |
| Exhaust port size | 46 | 50 | 40 | 55 | Degrees | |
| Exhaust port position | 49 | 53 | 45 | 55 | Degrees before TDC | Center of port |
| Intake port size | 43 | 47 | 40 | 55 | Degrees | |
| Intake port position | 53 | 57 | 50 | 60 | Degrees after TDC | Center of port |

FIG. 33

| Parameters | (Deg,360/cycle) |
|---|---|
| Transfer port size | 70 |
| Exhaust size | 48 |
| Exhaust position | 129 |
| Intake size | 45 |
| Intake position | 235 |
| Port height | 1.2 |
| Valve Overlap | 21 |

| Event | Position |
|---|---|
| Exhaust Opens | 70 |
| Intake opens | 177.5 |
| Exhaust Closes | 188 |
| Intake Closes | 292.5 |

| | Timing (720/cycle) |
|---|---|
| Exhaust Opens | 40 bbdc |
| Intake opens | 5 btdc |
| Exhaust Closes | 16 atdc |
| Intake Closes | 45 abdc |

ROTATING/RECIPROCATING CYLINDER POSITIVE DISPLACEMENT DEVICE

FIELD OF THE INVENTION

This invention relates to positive displacement devices such as internal combustion engines, pumps, compressors, and fluid motors.

BACKGROUND

An object of the present invention is to provide a novel form of a positive displacement device.

The key aspects of the positive displacement device include relative rotation and translation of a piston and a cylinder where the rotation accomplishes a rotary valve function and the translation accomplishes a change in chamber volume function; a means of linking the translation to the rotation; and a means of coupling the motion to an external device.

The preferred embodiment of the device has a relatively fixed piston which includes an intake port and an exhaust port; and a cylinder which rotates and translates relative to the piston. The cylinder contains a recessed volume which serves as a transfer port such that the piston intake port and the transfer port are in periodic registry during the cylinder rotation to allow fluid to enter the chamber through the intake port and transfer port. The piston exhaust port and the transfer port are also in periodic registry during the cylinder rotation to allow fluid to exit the chamber through the transfer port and the exhaust port. The volume between the piston and the cylinder creates a working chamber. The rotary valve action of the device is accomplished through the movement of the transfer port relative to the intake and exhaust ports. The translation of the cylinder relative to the piston creates the change in chamber volume.

The rotary valve action is accomplished in an alternative embodiment including a relatively fixed piston, a rotating and translating cylinder, and a relatively fixed outer case which contains the intake and exhaust ports.

The rotary valve action is also accomplished in another alternative embodiment including a relatively fixed cylinder which contains the intake and exhaust ports, and a rotating and translating piston which contains the transfer port.

The linkage between the relative rotation and translation of the piston and cylinder coordinates the expansion and compression of the working chamber with the opening and closing of the ports. The preferred embodiment of this linkage utilizes a moving cam which is attached or integral to the rotating cylinder. The moving cam is confined between two fixed cams such that as the moving cam rotates, the fixed cams cause the moving element to translate with respect to the relatively fixed element. For instance, in the preferred is embodiment, the moving cam is attached to the cylinder; and as the cylinder rotates about the piston, the moving cam rotates between the fixed cams, which creates a four-stroke translational movement of the cylinder about the piston for each revolution of the cylinder. The ability to define the rotation and translation of the cylinder enables the device to operate as a two-stroke per rotation device, a four-stroke per rotation device, or at a customized cycle such as two or more four-stroke cycles per revolution.

The ability to define the rotation and translation of the cylinder also enables the designer to minimize acceleration and deceleration forces or to create more ideal combustion cycles.

The definition of a path can be determined in alternative embodiments such as a moving cam and a fixed follower, a moving follower between fixed cams, a fixed cam and a moving follower, a lever mechanism, an electromagnetic drive, or other means.

The third aspect of this positive displacement device is a means of coupling the motion to an external device which either drives the positive displacement device or is driven by the positive displacement device. This coupling may connect only the rotational component of motion, only the translational component of motion, or both components. In the preferred embodiment of this invention, both the translation and the rotation are coupled to the external load or driver, and the means of isolating rotation and translation is external to the positive displacement device and is not included as a claimed element. In several alternative embodiments, the function of isolating either the rotational or translational component of motion is included in the device. Coupling means are well known, and include splines, spline-like devices, levers, electromagnetic means, and flexible couplings such as wafer springs, diaphragms, bellows, and coil springs.

In addition to the general aspects of rotary-valve action, linked rotation and translation, and motion coupled to an external device, some implementations of positive displacement devices require additional elements. In some applications, sealing may be provided. In some engine applications, an air/fuel mixture and an ignition source may be provided.

The preferred embodiment of the invention is a four-stroke internal combustion engine which offers substantial improvement in costs over conventional four-stroke engines and substantial improvement in emissions over conventional two-stroke engines.

The advantages of the invention over prior art can be appreciated by considering the design and function of positive displacement devices.

Many devices are used either to convert mechanical energy to gas or liquid fluid energy, or to convert fluid energy to mechanical energy. Some classes of these devices include pumps and compressors, fluid motors, and internal combustion engines. These devices can be categorized as positive displacement devices and non-positive displacement devices.

In a typical example of a positive displacement device, a working chamber changes volume through a cycle of the device. During part of the cycle, the chamber is connected to an intake by means of valves or ports, and the working fluid flows into the chamber. During another part of the cycle, the chamber is connected to the exhaust and the working fluid flows out of the chamber. In some types of positive displacement devices, closed valves or ports trap a compressible fluid in the chamber during part of the cycle, and the compressible fluid changes in volume as the volume of the chamber changes.

In the following discussion, the term "load/driver" refers to an external device which may either produce or sink mechanical energy. Drivers include electric motors, internal combustion engines, steam engines, water wheels, turbines, fluid motors, clock springs, and falling weights. Loads include electric generators, pumps, compressors, propellers, cranes, vehicle wheels, drills, saws, lathes, mills, and grinders. Devices for transferring energy include rotating shafts, reciprocating shafts, belts, and chains. In the positive displacement devices described by this invention, the load/driver may capture or deliver either a rotational component, a translational reciprocating component, or a combination of both the rotational and the translational components. A motor/generator is an example of the concept of the load/driver—it can be used as either a motor or a generator.

Three common functional classes of positive displacement devices include pumps and compressors; fluid motors; and internal combustion engines.

In a typical pump or compressor, mechanical energy from a driver such as an electric motor is used to increase the pressure or velocity of a fluid, or to reduce the volume of the fluid. Examples of these types of devices include water pumps, air compressors, refrigeration compressors and fans.

In a typical fluid motor, fluid energy is used to produce mechanical energy to a load such as a grinding wheel via a turning shaft. Examples of this type of devices include air motors, hydraulic motors, air cylinders, hydraulic cylinders, piston steam engines, and steam turbines. Fluid motors may also produce reciprocating motion as in a pneumatic chisel; or both rotating and reciprocating motion as in a hammer drill.

In a typical internal combustion engine, a chemical reaction occurs in the working fluid inside the engine thereby producing fluid energy in the form of increased pressure, volume or velocity; and that fluid energy is then converted into mechanical energy supplied to a load, such as a propeller via a turning shaft.

Mechanically, positive displacement devices can be categorized as reciprocating, rotary or hybrid.

Rotary positive displacement devices are commonly used as pumps or motors. Classes of rotary positive displacement devices include sliding vane devices and Wankel devices. In the Wankel and the sliding vane device, the boundaries of the chamber include the rotating elements and the outer case. The chamber moves with the rotary element and ports can be used for intake and exhaust of the working fluid. Drawbacks of these devices include difficulty in sealing and difficulty in cooling the rotor.

There are several disadvantages to rotary Wankel engines related to sealing. The tip seals are uncooled and unlubricated unless oil is added to the fuel. The rotor end seals require extensive machining and provide a large area for leakage, and the attempted seal against a flat area is difficult. The engines also provide a lot of area for unburned hydrocarbons to hide, which creates emissions problems. The present invention provides the advantages of a rotary valve device with the relative simplicity of sealing found in reciprocal devices.

In a typical reciprocating positive displacement device, a convex element, such as a generally cylindrical piston, reciprocates relative to a concave element, such as a hollow cylinder with one closed end. The most common reciprocating positive displacement devices use a crank and a connecting rod to couple the reciprocating motion of the piston to the rotation of a shaft. The convex element and the concave element usually have a generally round or slightly elliptical cross section, but oval cross sections and other shapes are possible.

Disadvantages of reciprocating positive displacement devices are well known and include the need for valves, which complicate the operation and add expense to the device; non-optimum piston motion due to a dependence upon a crank and rod geometry; and a requirement to compensate for side-slap oblique forces on the piston.

Typically, a sliding seal such as a piston ring is used to seal between the piston and the cylinder. Rolling seals, bellow seals, diaphragm seals and other forms of sealing have also been used. In some applications such as small model engines, the fit between the piston and the cylinder may be tight enough to limit the leakage to an acceptable amount without the use of rings or other sealing means. Some of these applications employ an interference fit to accomplish sealing.

Reciprocating positive displacement devices may have passively actuated valves, actively actuated valves, or ports. A typical four-stroke automobile engine uses actively actuated valves. An air compressor may employ reed valves that are actuated passively by the pressure of the working fluid. In other positive displacement devices, the working fluid flows into and out of the chamber by way of ports.

A typical air compressor is an example of a reciprocating positive displacement device with passively actuated intake and exhaust valves. As the chamber volume is increased, chamber pressure decreases below the pressure in the intake manifold, and the pressure difference opens the intake valve. When the volume of the chamber stops increasing, the intake valve closes. As the chamber volume is then reduced, the pressure increases above the pressure in the exhaust manifold, and the pressure difference opens the exhaust valve. Passive one way valves that require no external means of actuation can be used in an air compressor because it is desirable to have the intake valve or exhaust valve open at any time that the pressure in the chamber is less than the intake manifold pressure or greater than the pressure in the exhaust manifold.

A piston steam engine or a piston compressed air motor is an example of a reciprocating positive displacement device requiring actively actuated valves. At or near top dead center, or minimum chamber volume, the inlet valve is opened and steam or compressed air enters the chamber. At some point during the power stroke, the inlet valve is closed, and the steam or compressed air expands during the rest of the power stroke. At or near bottom dead center, the exhaust valve is opened allowing the steam or air to exhaust during the exhaust stroke.

A gasoline powered four-stroke internal combustion piston engine is another example of a reciprocating positive displacement device requiring actively actuated valves. The four-stroke engine uses two strokes, the exhaust stroke and intake stroke, to accomplish the pumping function; and two strokes, the compression stroke and power stroke, to extract energy from the working fluid by combustion. The piston reduces the chamber volume on both the compression stroke and the exhaust stroke, but the exhaust valve is opened only on the exhaust stroke. The piston increases the chamber volume on both the power stroke and the intake stroke, but the intake valve is opened only on the intake stroke. Since the exhaust valve and the intake valve are not opened or closed solely based upon the piston position, the valves are actively actuated.

A typical small gasoline powered two-stroke internal combustion piston engine is an example of a reciprocating positive displacement device with ports. Near the point in the cycle of maximum chamber volume, the intake and exhaust ports in the cylinder wall are uncovered by the piston. The intake charge mixture of air, gasoline and oil is supplied under pressure, causing the by intake charge to flow into the chamber and to displace the burned charge through the exhaust port. Ports can be used in this application because it is desirable to have the intake and exhaust ports open each time the piston nears bottom dead center and the desired open or closed state of the ports is solely a function of the piston position.

A typical hybrid positive displacement device such as a rotary-V engine or a K-cycle engine will have multiple reciprocating pistons arranged in a manner that permits ports rather than valves. The disadvantages of these devices typically include a need for sealing large surfaces, difficulty in cooling the cylinders, and that they are not suitable for single cylinder engines. The advantages of the current invention relative to other hybrid positive displacement devices include, simplicity, single cylinder embodiments, improved cooling, and easier sealing, if sealing is required.

A key feature of the present invention is the use of relative rotation and reciprocation between a cylinder and a piston. The relative rotation of the cylinder accomplishes the porting function of a rotary valve, while the relative translation accomplishes the compression, expansion, and fluid displacement functions.

The prior art indicates several engine designs involving a rotating cylinder. Most of these designs are more intricate than this invention, and most include both piston movement and cylinder movement. U.S. Pat. No. 4,136,647 which issued Jan. 30, 1979 to Stoler describes a rotary device with a pair of pistons defining a chamber particularly where the movement of the piston imparts a rotary motion to the pistons. In U.S. Pat. No. 4,553,506 which issued Nov. 19, 1985 to Prodromos Bekiaroglou et. al., there is a rotating cylinder and pistons which both rotate and reciprocate. This patent describes the use a curved guide tracks in the cylinder wall to adapt the time-law for the volume change in the working chamber to the needs of the mechanics, thermodynamics and reaction kinetics. The patent also describes a method for changing stroke length to provide variable power output. In U.S. Pat. No. 4,178,885 which issued Dec. 18, 1979 to Siegfried Konther et. al., there is a rotary piston/cylinder engine which features a crank axis offset from the axis of rotation of the cylinder. In U.S. Pat. No. 3,654,907 which issued Apr. 11, 1972 to Clarence Bartlett et. al., a rotating cylinder engine is described with relatively few moving parts. That design was said to eliminate the requirement for a muffler and to improve cooling. In U.S. Pat. No. 2,036,060 which issued Mar. 31, 1936 to Newton A. Lewis and U.S. Pat. No. 1,583,560 which issued May 4, 1926 to James K. Morris also feature rotating cylinders in rotary engines that are much different from this invention.

The prior art also indicates several engine designs involving an oscillating or reciprocating cylinder. In U.S. Pat. No. 628,124 which issued Jul. 4, 1899 to William S. Sharpneck describes an oscillating cylinder engine. In U.S. Pat. No. 4,699,093 which issued Oct. 13, 1987 to Joseph I. Byer, there is an oscillating cylinder and a fixed piston. The cylinder does not rotate.

In the present invention, the porting is accomplished by the relative rotary action of the piston and cylinder, whereas in U.S. Pat. No. 4,553,506, porting is accomplished by the relative linear motion of the piston and cylinder.

Although the art of positive displacement devices has been refined over many years, the present invention offers substantial improvements over prior art.

Although the invention may implement a four stroke cycle, it is simpler in construction than two-stroke engines. By combining rotational and translational motion, the porting and change of volume function are accomplished with the same element, and sealing, if required, is only required in one place. The invention captures the simplicity of simple 2-stroke ported devices while retaining the efficiency advantages of the more complex 4-stroke devices. As an example, the preferred embodiment of the invention is a four-stroke internal combustion engine with a single moving part.

The inherent symmetry of the invention permits efficient combinations of positive displacement devices such as an integral engine and pump which requires only one moving part. The sizes of the devices in the combination need not be the same, so the combinations may be specifically tailored for a particular application.

Despite its simplicity, the invention offers several design and operational variables to permit customization and optimization including the ability to change ignition and port timing, to dynamically vary compression ratio, to use a motion curve that minimizes acceleration and deceleration forces, to improve combustion, and to provide a movement of the combustion chamber relative to an ignition source, if ignition is used.

Internal combustion engines are typically either two-stroke engines or four-stroke engines. For small engine applications such as model engines, chain saws, lawn trimmers, leaf blowers, and off road vehicles, two-stroke engines are often employed because of their lower weight, relative simplicity, lower cost, and high power to weight ratio relative to four-stroke engines Two-stroke engines, however, have inherently higher pollutant emissions than four-stroke engines because oil must be added to the fuel, and because the intake charge is incompletely burned. Another disadvantage of two-stroke engines is the relatively poor fuel efficiency which results from this incomplete burning of fuel. Two-stroke engines are typically run "rich" which means that more fuel will be introduced than can be stoichiometrically combined with the oxygen provided. For instance, four-stroke engines will typically be run at air to fuel mass ratios of 13:1 is to 15:1, while two-stroke engines may be run at a ratio of 10:1. Since this ratio is substantially below the stoichiometric ratio of about 14.8:1 for gasoline, it is impossible to burn all of the fuel introduced. The results of this incomplete combustion are reduced fuel economy and increased emissions.

From the consumer's perspective, the general advantages of four-stroke engines relative to two-stroke engines include: that there is no requirement to add oil to the fuel, that the smell is not as bad, that the engines are less noisy, that the engines are easier to start, that the engines provide better low-end torque, and that the engines run better at idle.

Four-stroke engines have improved emissions relative to two-stroke engines because they do not require the addition of oil to the fuel, and because they have more complete combustion. On the other hand, four-stroke engines typically require more moving parts than two-stroke engines.

For the foregoing reasons, there is a need for a simple, low cost, four-stroke engine. The preferred embodiment of this invention is a four-stroke ported internal combustion engine. The preferred embodiment provides a four-stroke engine with one moving part, and few parts that require machining. In this embodiment, a cam means is used to link the rotation and translation of the cylinder relative to a generally fixed piston; and the rotation accomplishes the functions of a rotary valve, while the translation accomplishes the change of volume function. A transfer port, which is a recess in the cylinder wall, provides a path for intake of fuel and air through the intake port, as well as exhaust of combustion products through the exhaust port.

The other engine embodiments of this invention offer similar advantages over prior art. These other embodiments include applications with two or more cylinders, fixed cylinder variations where the piston rotates and reciprocates relative to the cylinder, and applications where a cylinder may reside within an outer casing.

The following discussion relates to design considerations and to inherent advantages for engines and other positive displacement device embodiments of this invention.

Conventional engine design factors of compression ratio, clearances, and timing provide a starting point for setting design factors in the current invention. These factors should be viewed only as starting points because of the differences in this invention and conventional engines. The design factors may be varied in this invention just as in conventional devices depending upon the desired goals of performance, desired performance range, emissions, runnability, and fuel economy. Many of these design factors have a broader range in the current invention than is permissible in conventional devices. For example, overlap of port opening times may not be required in the invention and clearances may be smaller than in conventional engines.

Variable compression can be accomplished by such means as a motor and lead screw which move the piston, a cam, or a cam means relative to the cylinder; or by other means such as springs of appropriate stiffness or gas pressure. Thus in some applications, it may be desirable to permit some movement of the piston, so the piston is described as being relatively fixed with respect to the cylinder. Alternately, some clearance may be designed into the cam system so that the cylinder does not make the full stroke during compression at full throttle and low engine speed. This clearance provides a lower compression ratio at starting and low speeds, and a higher compression ratio as the engine speed increases. In a typical internal combustion engine, a greater clearance is present around the piston edges near the top of the piston than on the sides of the piston. One reason for providing this additional clearance is to compensate for the differential heating of the piston relative to the cylinder, which may have the benefit of air or water cooling of the cylinder block. Another reason for providing this additional clearance is to compensate for the fact that, even if the temperatures and thermal expansion coefficients were equal in the piston and cylinder, the bore of the cylinder has less thermal expansion than the piston. In the current invention, the cylinder may be thin-walled, and cooling may be provided to the piston; so a lower clearance between the top edge of the piston and the cylinder may be employed. One practical benefit of being able to reduce that clearance is that the clearance volume can be a significant source of unburned fuel. By reducing the clearances, the amount of this potential unburned fuel can be reduced substantially.

In a conventional valved four-stroke engine, the time required to open the valves is large relative to the total time required for the piston to complete a cycle. It is often necessary to begin opening the intake valve before the exhaust valve is completely closed. This overlap of times when both valves are partially open can be the source of emission of unburned fuel. The overlap also contributes to variations in the residual gas fraction which in turn contributes to cycle-to-cycle variation. It has been reported in the literature that a 10% improvement in engine power could be realized without increase in fuel consumption if cycle-to-cycle variation were eliminated. In the current invention, this overlap can be reduced or eliminated if desired.

The path of the cylinder, the size and position of the transfer port, the size and position of the exhaust port, and size and position of the intake port control the timing of the engine. The port timing may be dynamically adjusted in some embodiments by rotating the piston. This adjustment will change both the intake and the exhaust timing.

The present invention has a reduced number of moving parts relative to conventional four- stroke internal combustion engines. For instance, a two cylinder engine requires only a single moving part. The engine requires no valves. The simplicity of the design may permit ceramics or other advanced materials to be practically employed as engine construction materials. In the preferred embodiment, there are no inertial loads on the piston, so the piston is a good candidate for ceramic materials. In this invention, machining may be necessary on the inside of the cylinder and the outside of the piston. Machining may also be necessary for the cam or gear teeth in some embodiments. In the preferred embodiment, it is possible that the piston and cylinder would be die cast and that the fixed cams would be injection molded; with the outer surface of the piston and the inner surface of the cylinder being the only machined surfaces.

The operating speed of an engine can be limited by the time required to achieve combustion. Turbulent flow in the combustion chamber is necessary in all but the slowest turning engines. Turbulence is often created by swirl and squish. The swirl is achieved by techniques such as an axial introduction of fuel that creates a swirling rotational motion within the combustion chamber. In many engine designs, a squish component is created by forcing the compressed fuel and air through a relatively narrow opening. The present invention creates swirl during the intake stroke due to the relative rotation between the piston, cylinder, and ports; and creates squish during the compression stroke due to the small piston to cylinder clearance at minimum chamber volume. The invention also operates such that the charge may be moving relative to the ignition source to allow multiple ignition events along the path of the ignition source relative to the chamber, and thus creating a greater combustion efficiency. The present invention also offers an inherent squish between the chamber and the transfer port. These turbulence promoting features may enable the present invention to operate at relatively high rpm.

In some engine applications, the ignition source will ignite the fuel mixture in the transfer port, which will serve as a prechamber. The advantage of prechambers in improving combustion are well known. The shape of the transfer port in the preferred embodiment is rectangular, but the shape may be modified in all three dimensions due to considerations such as gas transfer, combustion efficiency, or the formation of a jet of burning gas.

The invention produces a high displacement to engine volume ratio which may complete a full Otto cycle in a single revolution of the cylinder. The strokes corresponding to Intake, Compression, Power, and Exhaust, are accomplished as a cylinder rotates and reciprocates about the relatively fixed piston. The present invention provides an opportunity to operate at a cycle that is closer to an idealized Otto Cycle because the path of the cylinder to piston movement can be established to achieve a cycle closer to the ideal constant volume combustion assumption in an ideal Otto cycle. The present invention also permits operation at other cycles such as the diesel cycle.

The engine may have multiple pistons arranged in a manner that share one or more cylinders. For instance a typical "two cylinder" engine, could consist of two pistons sharing a single cylinder where the closed end of the cylinder is a common wall between pistons. The wall may have cooling passages. In this case, the second piston would be rotated approximately 90 degrees, and would be upside down, with respect to the first piston.

In the four-stroke engine, the four-strokes may take place in either a single revolution or a portion of a revolution of the cylinder where there are four or more cylinder translation movements per revolution. In combinations of devices, one device may operate at a different number of cycles per revolution than other devices. For instance in the combined pump and engine example below, the engine completes four stroke per revolution of one engine cycle, while the pump completes two pump cycles in that same revolution, One difference between an engine and other positive displacement devices is that in an engine, a chemical reaction takes place with the fluid. That reaction is usually between the oxygen in air and a fuel that is supplied. The intake charge may be a premixed fuel-air charge. Alternatively, the fuel may be introduced by port injection or direct injection. Alternately, a self reacting working fluid such as a mixture of air and solvent fumes; hydrogen and chlorine; or ethylene and a polymerization initiator may be externally supplied.

The engine may include a means to ignite the contents of the combustion chamber such as spark ignition or glow plug ignition. Alternately, the compression ratio and the fuel may be selected such that the fuel ignites spontaneously upon compression.

The combustion chamber is defined by the volume between the closed end of the cylinder and the top of the piston, as well as an additional volume in the transfer port. As the combustion chamber contents are compressed, there is only a small volume between the closed end of the cylinder and the top of the piston, and much of the fuel mixture has been compressed into the volume of the transfer port. In some embodiments, it may be desirable to increase the volume of the combustion chamber by changing the geometry of the piston face.

The transfer port permits the invention to work as a rotary valve. It may be designed as a cavity or protrusion in a portion of the wall of a rotating cylinder; a recess in a rotating piston, or as a hole in a rotating cylinder which is located within a ported outer case. In each embodiment, this port serves the function of making a connection between the working chamber and the intake and exhaust ports at various portions of the cycle.

The positive displacement devices described below include a means of defining a relative path of rotation and translation of the cylinder and the piston. The path of the rotation and translation causes the transfer port to move across the intake port and exhaust port at the time in the cycle appropriate for intake and exhaust. At other times in the cycle, the path of the cylinder is causing compression of the fuel mixture and is permitting a power stroke expansion after ignition of the compressed fuel mixture.

One way to accomplish the path definition is by use of a cam means. Several implementations of cam means are described in the embodiments. The shape of the cam means could be sinusoidal, but alternative or customized shapes may be appropriate for some applications. For instance, a modified constant acceleration cam shape can be used to lower the peak acceleration and deceleration forces and to achieve more time at the minimum chamber volume. The decrease in peak acceleration may be accompanied by a more ideal combustion cycle. Modifications of the cam shape may also lead to reduced vibration in the devices and to improved combustion.

In devices that are started by hand power or foot power such as a lawnmower, a hand held appliance, or a motorcycle, the torque required to overcome compression is often substantial. A compression release is often needed. In this invention, the compression release may be accomplished passively because of the clearance that may be designed into the cam system. The fixed cam embodiments of the present invention provide reduced inertial resistance at low rpm so that the device may be easier to start. In other embodiments, a variable compression ratio permits easier starting through a release of compression on starting the engine.

The engine may include a means to seal the combustion chamber such as a standard piston ring below the ports, above the ports, or both above and below the ports. Alternately, the piston may be designed with relatively tight tolerances without a means of sealing. In this case the fit is close enough that the leakage or blow-by is limited to an acceptable amount.

Another advantage of the invention is the elimination of side-slap forces which occur in crank engines due to the fact that the force exerted on the piston by the rod is not always aligned with the cylinder.

The present invention has improved lubrication relative to conventional devices because there is no point of zero relative motion between the cylinder and the piston. In a typical engine, the top dead center and bottom dead center locations in the cycle represent times where there is no relative motion between the piston and cylinder to promote hydrodynamic lubrication. At these times, only boundary lubrication is present.

In some embodiments, the intake charge may be directed to the inlet port through a fixed outer case, and the exhaust may be directed from the outlet port to the fixed outer case. The cylinder then contains a transfer port cavity such that as the cylinder rotates and translates relative to the piston, the intake charge is directed from the inlet port to the combustion chamber, and the exhaust is directed from combustion chamber to the exhaust port. In many applications, the engine will be incorporated into a larger product or device, and the support and enclosure functions will be provided by the larger device rather than being a part of the engine.

Heat fins may be provided to enhance the cooling of the engine or to add stiffness to the cylinder. The ability to control the temperature of the piston also offers the ability to reduce clearances between the piston and the cylinder. The ability to control the piston temperature can also make it possible to employ a ringless design. Since there is no inertial loading of the piston, it is also possible to construct the piston from higher temperature materials such as ceramics.

The means of coupling the positive displacement device to an external load/driver can be located internal or external to the positive displacement device. Some applications such as a hammer drill might use both the translational and the rotational components of the cylinder motion. In most applications only one component of the motion will be coupled to the load/driver. The means of coupling only one component of the motion include a spline, a spline-like device, a flexible coupling, and other means. A spline-like device is a device comprising a male element and a female element, with the female element overlapping the male element. The shapes of which allow relative translation but which limit relative rotation between the male and the female element. The rotational component can also be captured directly from the cam by means of gear teeth to drive a power take off gear for transferring power into or out of the engine.

The power output of the engine embodiments may be controlled by throttling air/fuel flow, by changing ignition timing, or by other standard techniques such as changing the air/fuel ratio.

In this description, terms such as top, and clockwise are intended for illustration and explanation only, and the devices can operate in any orientation. The examples shown include common techniques for which those skilled in the art recognize interchangeableness of other elements. Many other variations, modifications and applications of the illustrated embodiments of the invention will be apparent to those skilled in the art. For internal combustion engines, a good reference for design techniques and interchangeableness is the text *Introduction to Internal Combustion Engines* by Richard Stone, published by the Society of Automotive Engineers. Another good engine reference is *Internal Combustion Engines* by Colin R. Ferguson, published by John Wiley & Sons. A good metals reference is *Metals Handbook* published by the American Society for Metals. A good sealing reference is *Seals and Sealing Handbook* by Melvin W. Brown published by Elsevier Science Publishers Limited. A good coupling reference is W. W. Berg, Inc.'s *B97 Master Catalog* of mechanical components, including its "Guide for Coupling Selection".

SUMMARY

This invention is a positive displacement device that can be used in engines, pumps, compressors, motors and other positive displacement device applications. The device is simple, relatively small for its displacement, and low cost. The preferred embodiment presented is a single cylinder, four-stroke internal combustion engine which comprises a cylindrical piston and a cylinder that rotates and reciprocates with respect to the piston. As the cylinder completes a revolution around the piston, a cam integral to the cylinder rotates through fixed cams and causes the cylinder to reciprocate through exhaust, intake, compression, and power strokes relative to the piston. These strokes correspond generally to the four-strokes of a conventional engine. A transfer port within the cylinder facilitates the intake of fuel and the exhaust of combustion products. The cylinder may include a cam and followers to control the cylinder movement.

BRIEF DESCRIPTION OF THE DRAWINGS

These and other features, aspects, and advantages of the present invention will become better understood with regard to the following description, appended claims, and accompanying drawings where:

FIG. 33 is a table of design factors for the preferred embodiment of the invention.

DESCRIPTION

Example—A Positive Displacement Device and Load/Driver

Figure 1:
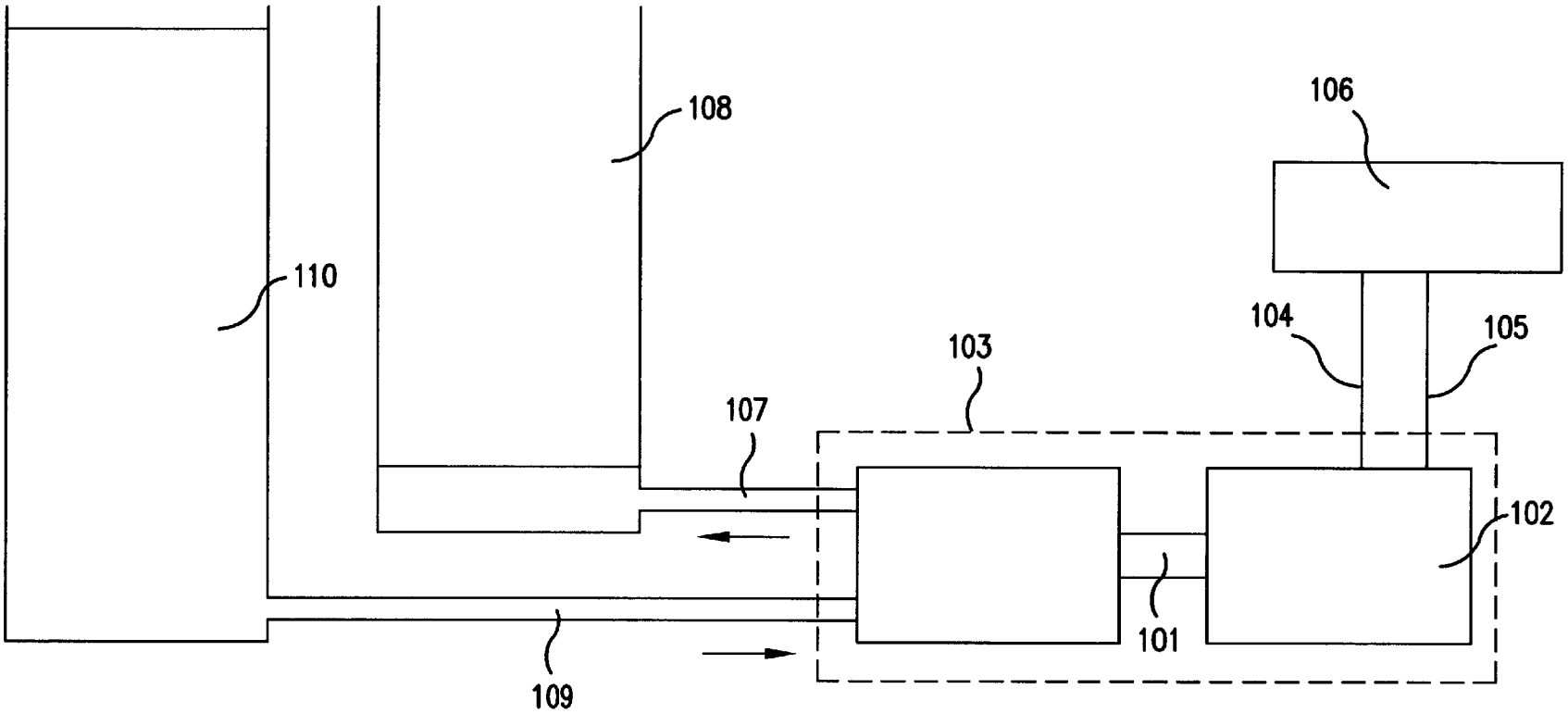
FIG. 1 is a schematic illustrating the concept of a positive displacement device and a load/driver.

The following example illustrates the concepts of a positive displacement device and a load/driver. FIG. 1 shows a positive displacement device 100 that can be used as a fluid motor to convert fluid energy to mechanical energy; or as a pump to convert mechanical energy to fluid energy. The positive displacement device is connected by means of a shaft 101 to an electric motor/generator 102. The motor/generator is a device that can convert electrical energy to mechanical energy; or convert mechanical energy to electrical energy. The resulting machine 103 can convert fluid energy input 109 to electrical energy, or convert electrical energy input to fluid energy 107. The electrical energy may be dissipated or drawn from an electrical power in supply/sink 106 through wires 104 and 105.

In the application shown in FIG. 1, the machine 103 is used to maintain a constant flow of liquid from tank a 110 to tank B 108. At the beginning of the liquid transfer process, the level of tank a is higher than the level of the tank B. At the end of the liquid transfer process, the level of tank A is lower than the level of the tank B. During the time that the level of tank A is higher than the level of the tank B, the positive displacement device 100 is acting as a fluid motor, and the electrical motor/generator is acting as a generator, and the power supply/sink is acting as a power sink. During the time that the level of tank a is lower than the level of the tank B, however, the positive displacement device 100 is acting as a pump, the electrical motor/generator is acting as a motor, and the power supply/sink is acting as a power supply. In this example, the motor/generator is acting as a load part of the time and as a driver part of the time. The term "load/driver" is used to describe a device such as the above electrical motor/generator that can supply or absorb mechanical energy.

The term load/driver is used to describe any device that can produce or consume mechanical energy. In this example, the motor/generator and motor/pump are load/drivers. Thus, some positive displacement devices can be used as both a pump and a motor, depending upon whether the fluid pressure is greater at the inlet or the exhaust, and may be connected to other devices that are load/drivers such as a motor/generator.

Example—Operation of the Positive Displacement Device

Figure 2:
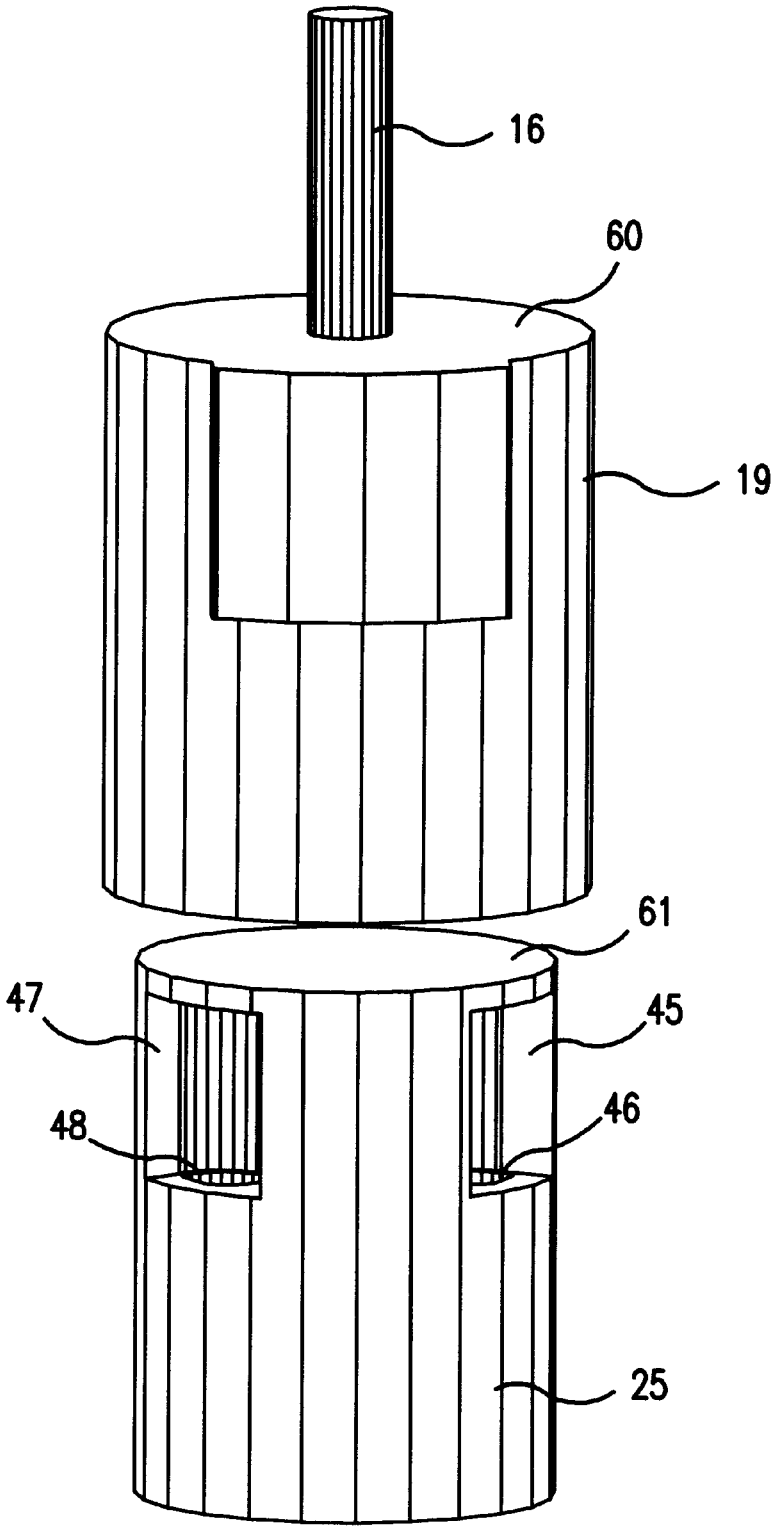
FIG. 2 is a simplified exploded side view of a positive displacement device showing the piston, cylinder, and ports.

FIG. 2 shows an exploded view of the key elements of an embodiment of the subject positive displacement device. A cylinder 19 with a closed end 60 rotates and reciprocates relative to a fixed piston 25. The shaft 16 is integral to the cylinder, and rotates and translates with the cylinder movement. If the positive displacement device is used as internal combustion engine, then the shaft provides power from the engine to an external load. If the positive displacement device is used as a motor, then the shaft may be used to provide power from the positive displacement device to an external load. The shaft may also provide power from an external driver to drive the cylinder movement if the positive displacement device is used as a load such as a pump. An intake part 47 and an exhaust port 45 are located on the piston. Fluid is introduced through an intake runner 48 to the intake port. Fluid is removed through the exhaust port and an exhaust runner 46.

Figure 3:
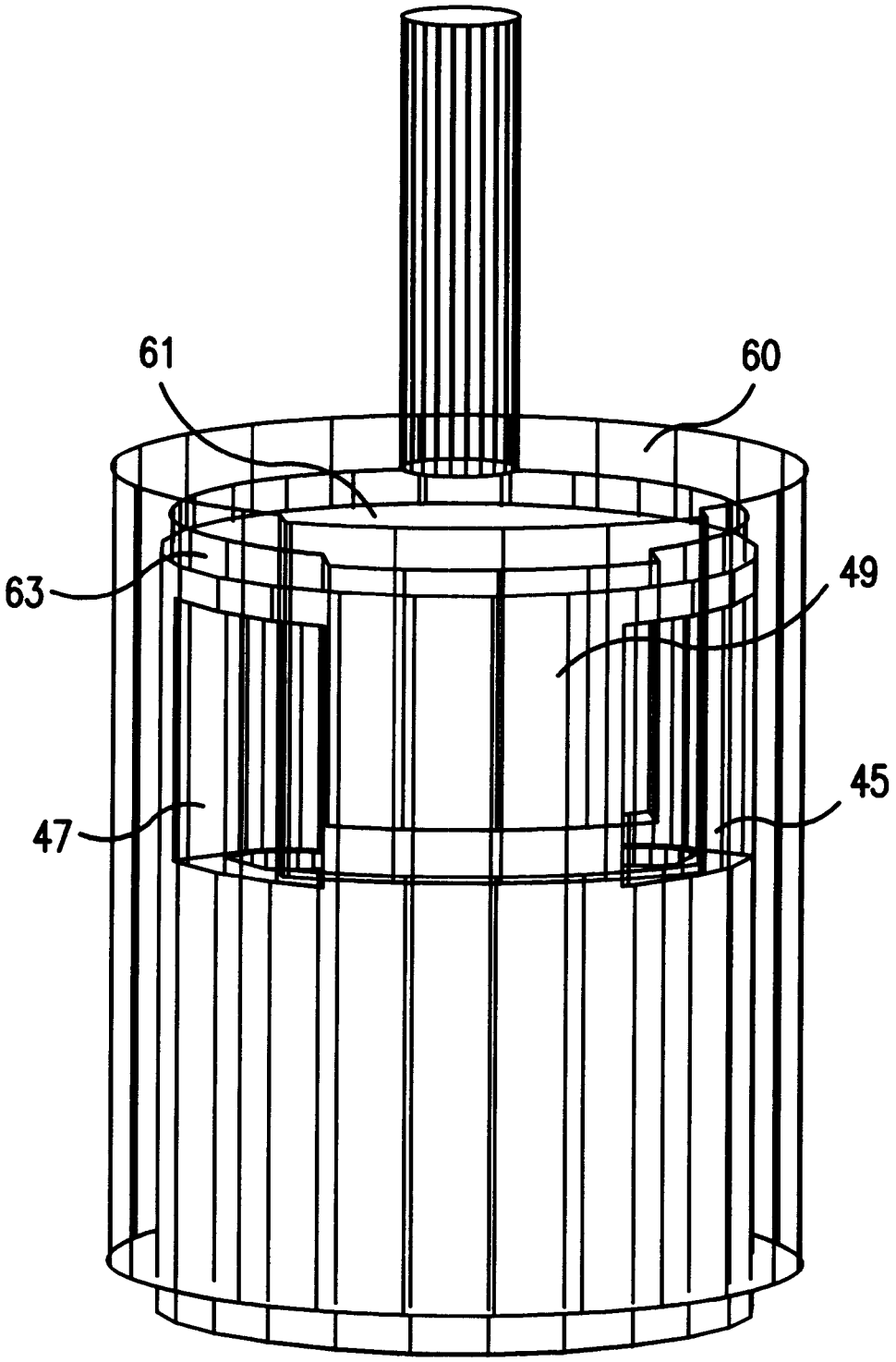
FIG. 3 is a simplified hidden line drawing of a positive displacement device showing the chamber formed between the cylinder and the piston.

FIG. 3 shows the fluid chamber 63 formed between the closed end of the cylinder 60 and the piston top 61. In this view, the transfer port 49 has rotated toward the exhaust port 45. In the case of a pump, the fluid was allowed to enter the chamber through the transfer port at the time that the transfer port overlapped the intake port 47. During the downward movement of the cylinder, the transfer port will overlap the exhaust port and the fluid will be forced from the chamber through the transfer port and out the exhaust port 45. In the case of an internal combustion engine, the fuel mixture will enter the chamber through the transfer port at the time that the transfer port overlaps the intake port. The fuel will be compressed in the chamber as the cylinder moves downward. After compression, the fuel in the chamber will be ignited, and a power stroke will drive the revolution of the cylinder and its expansion. Following the power stroke, the combustion products will be forced out of the chamber through the transfer port and out the exhaust port.

Figure 4:
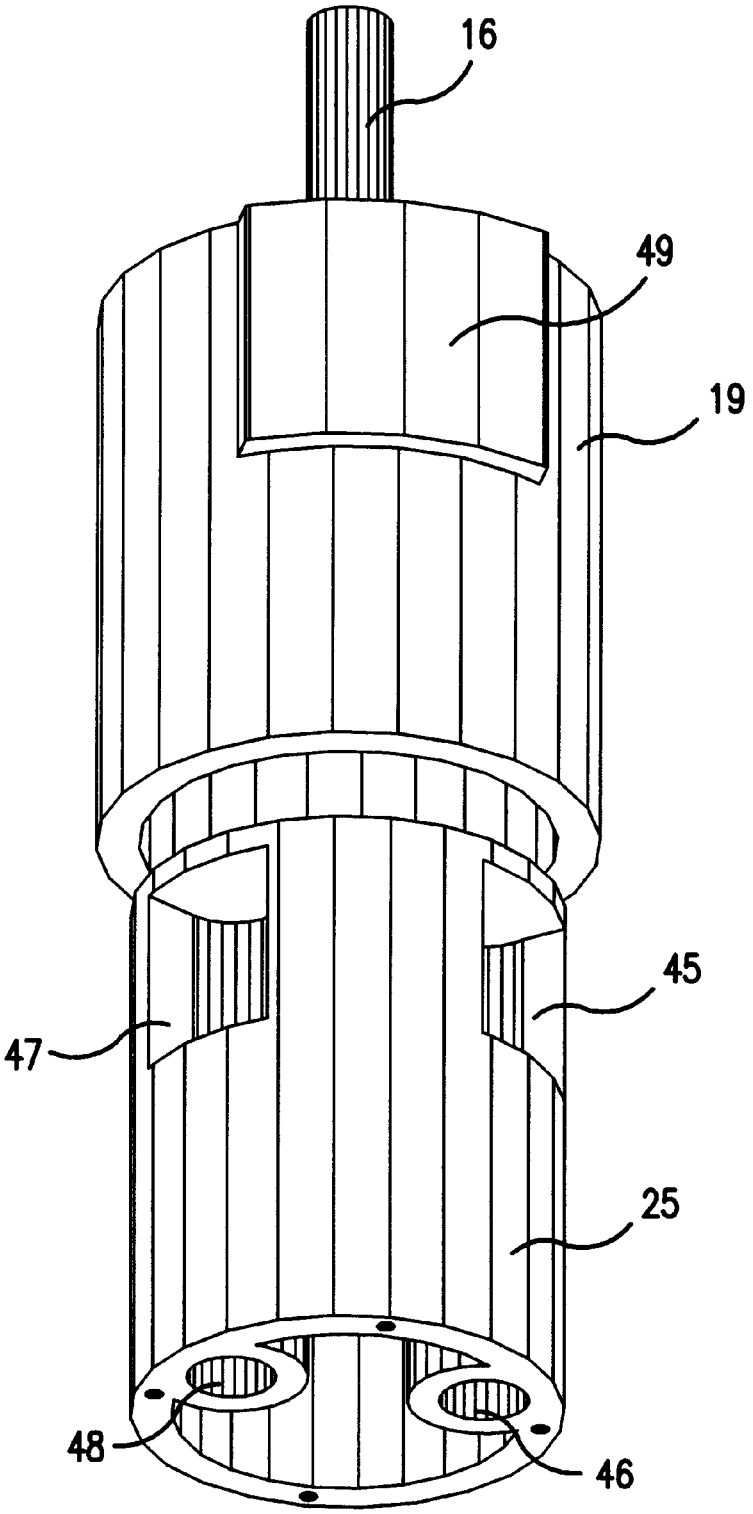
FIG. 4 is an exploded view of a positive displacement device showing intake and exhaust details.

FIG. 4 shows details of the intake runner 48 and the exhaust runner 46 . In this figure, the transfer port 49 is shown as an recess over a portion of the inner wall of the cylinder. The transfer port provides both a storage volume for the fluid, and a path for the fluid to enter the chamber from the intake port 47, and to exit the chamber through the exhaust port 45.

Example—Moving Cam with Fixed Follower

Figure 5:
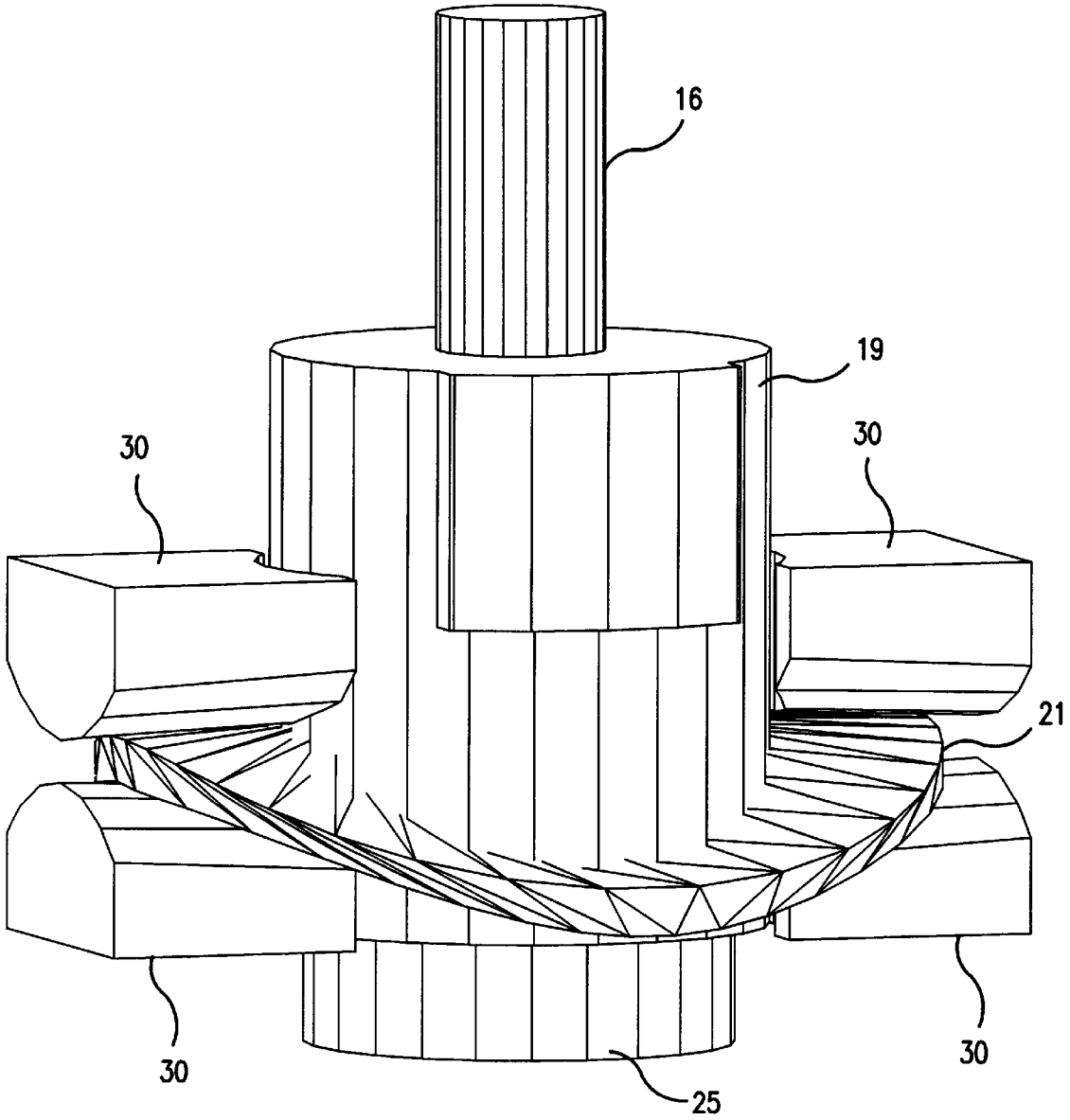
FIG. 5 is a side view of a positive displacement device with a moving cam and a fixed follower.

FIG. 5 shows the addition of a moving cam 21 which is attached or integral to the cylinder 19. The cam is confined by fixed followers 30 which are generally fixed relative to the piston 25 location. As the cylinder rotates, its up and down motion is defined by the shape of the moving cam as the cam moves through the fixed followers. The cam thus defines the movement of the cylinder about the fixed piston 25. Other methods of defining the relative movement of the cylinder and piston are illustrated in other figures. The followers are described as generally fixed relative to the piston because in some applications it may be desirable to change the follower location in order to change the compression ratio.

Figure 6:
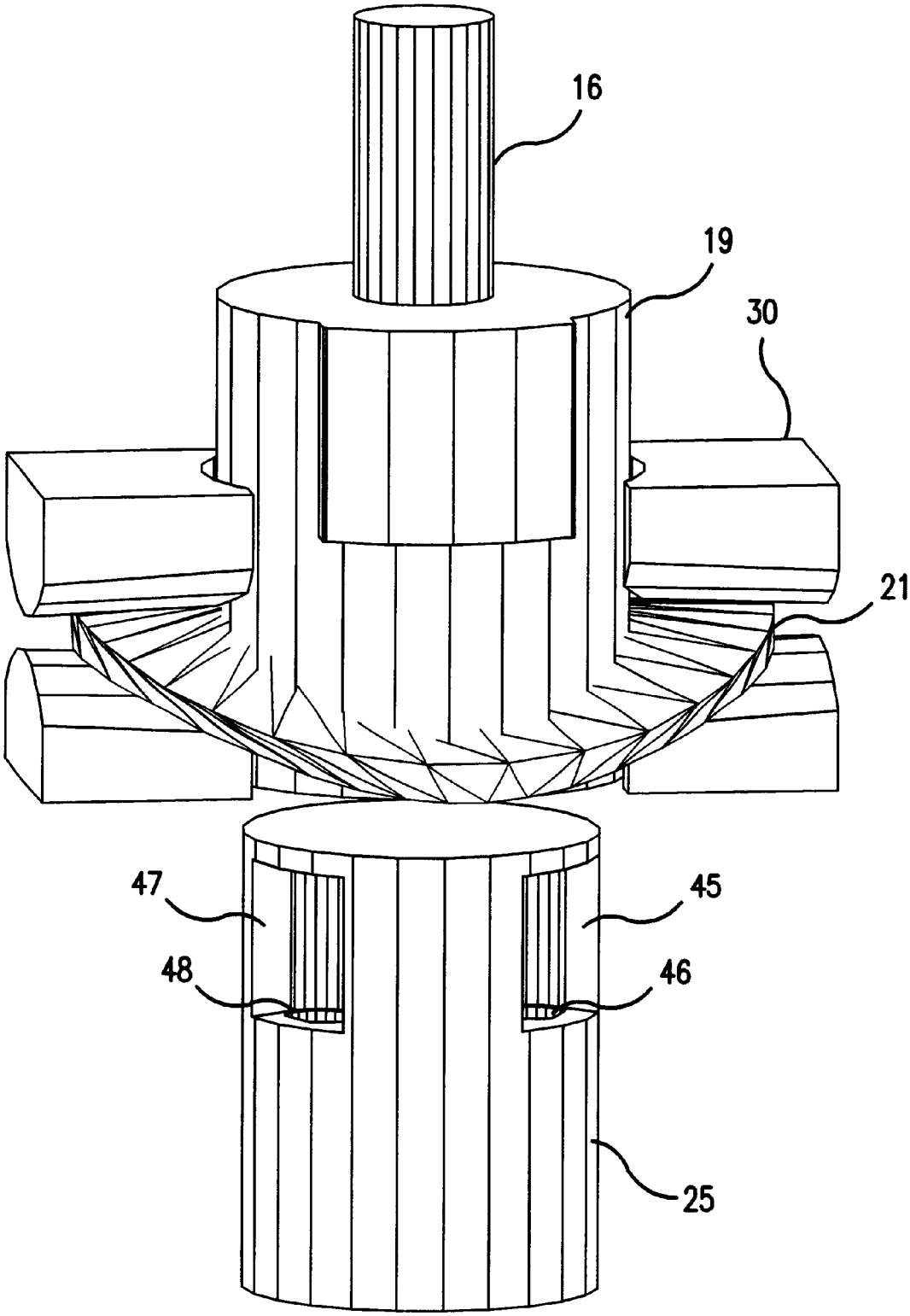
FIG. 6 is an exploded side view of the positive displacement device shown in FIG. 5.

FIG. 6 shows an exploded view of FIG. 5. The followers 30 are not attached to the cylinder, but are shown in this figure to illustrate their location relative to the cam.

A clearance may be provided in the cam system to permit the compression ratio to be passively reduced during low speed, high power operation in order to avoid knock. It is well known that higher compression ratio generally leads to a greater engine efficiency, but that high compression ratio engines are subject to knock at low speeds. The ability to passively reduce the compression ratio permits the designer to achieve a maximum compression ratio for more efficiency at high speeds and to reduce the compression ratio at low speeds. Another benefit to this clearance in the cam system is to reduce the torque required to start the engine.

Example—Moving Cam with Fixed Cam

Figure 7:
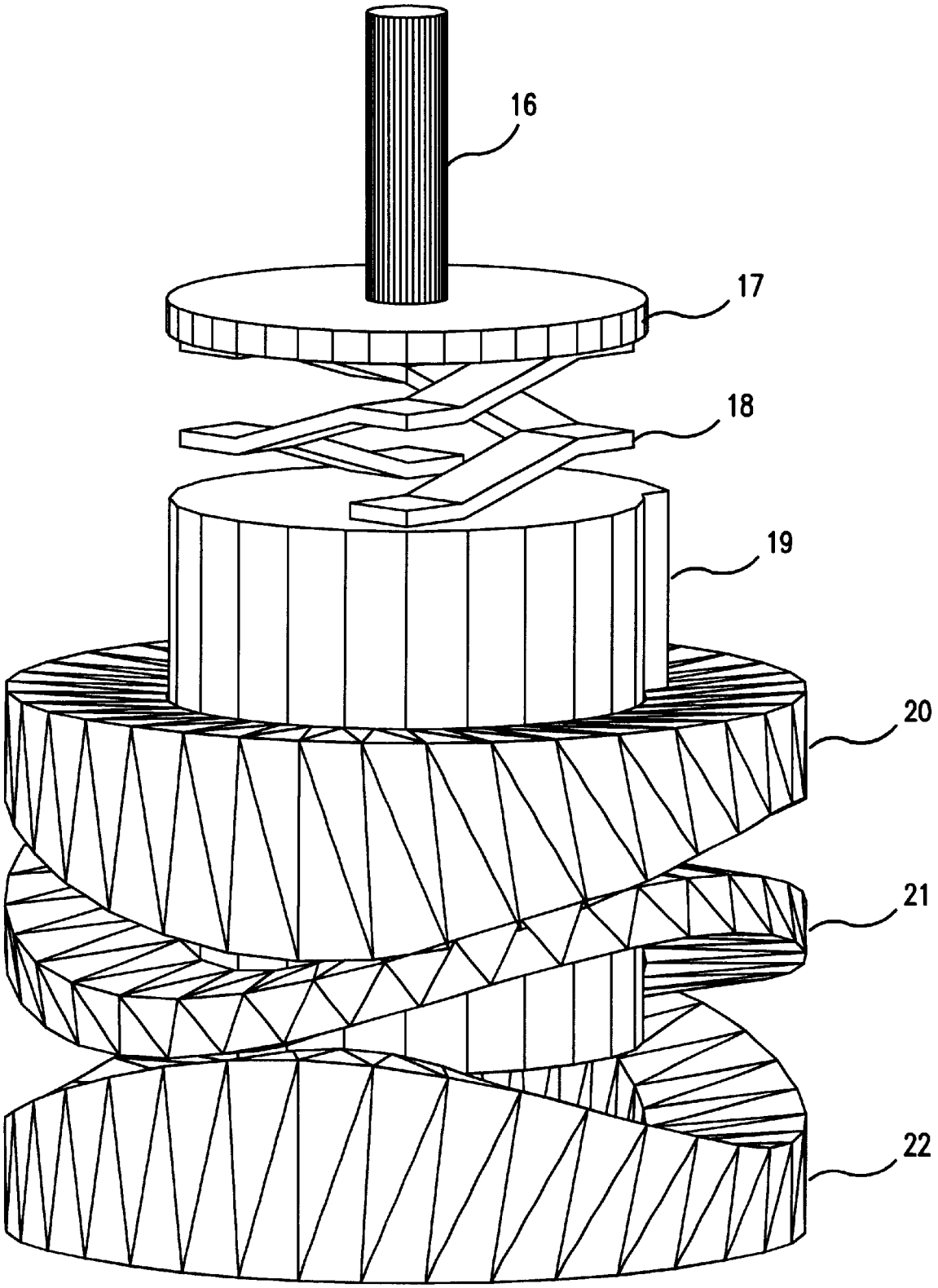
FIG. 7 is a side view of a moving cam embodiment of the invention with fixed cams and a flexible coupling spring.

FIG. 7 shows the moving cam 21 which is attached or integral to the cylinder. As the cylinder rotates, its up and down motion is defined by the shape of the moving cam as the cam moves between a front fixed cam 20, which is not attached to the cylinder, and a back fixed cam 22, which is not attached to the cylinder. The cylinder 19 is rotates freely inside the front fixed cam and the back fixed cam.

The cylinder will have both a rotational and a reciprocating component. One way to couple the cylinder movement to the load is to use a flexible coupling spring 18 between the cylinder 19 and a flexible coupling disk 17 to permit the shaft 16 to rotate without a reciprocating motion. Other methods of coupling the cylinder movement to the load are illustrated in other figures.

Example—Moving Follower

Figure 8:
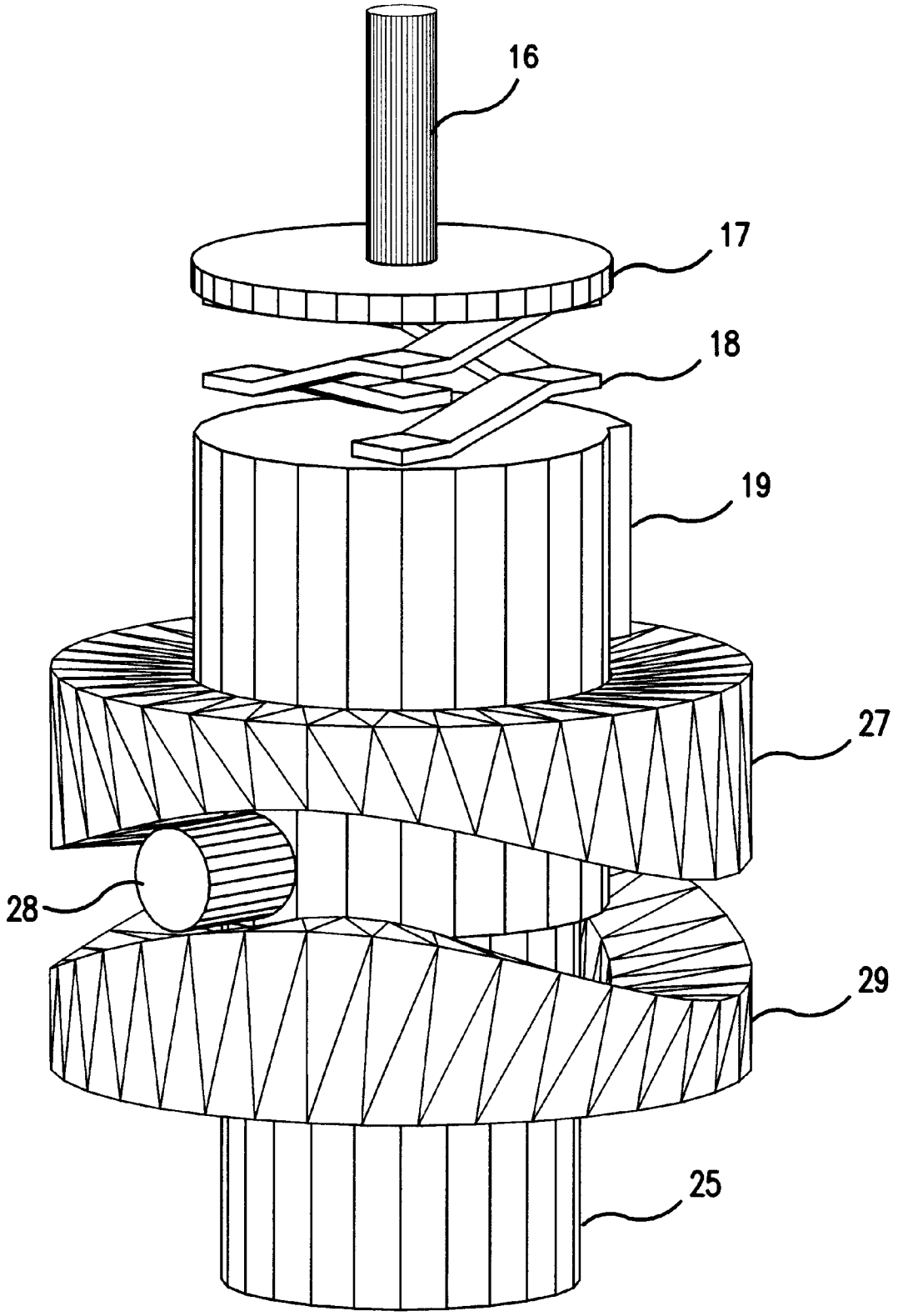
FIG. 8 is a side view of a moving follower embodiment of the invention.

FIG. 8 shows an alternative means of cylinder path definition which utilizes a moving follower 28 between an alternate type of a front fixed cam 27, which is not attached to the cylinder, and a back fixed cam 29 which is not attached to the cylinder.

Example—Ported Outer Case Positive Displacement Device

A key concept of this invention is the accomplishment of a rotary valve function through the relative rotation of a cylinder and a piston. The following example illustrates that concept in an alternative embodiment.

Figure 9:
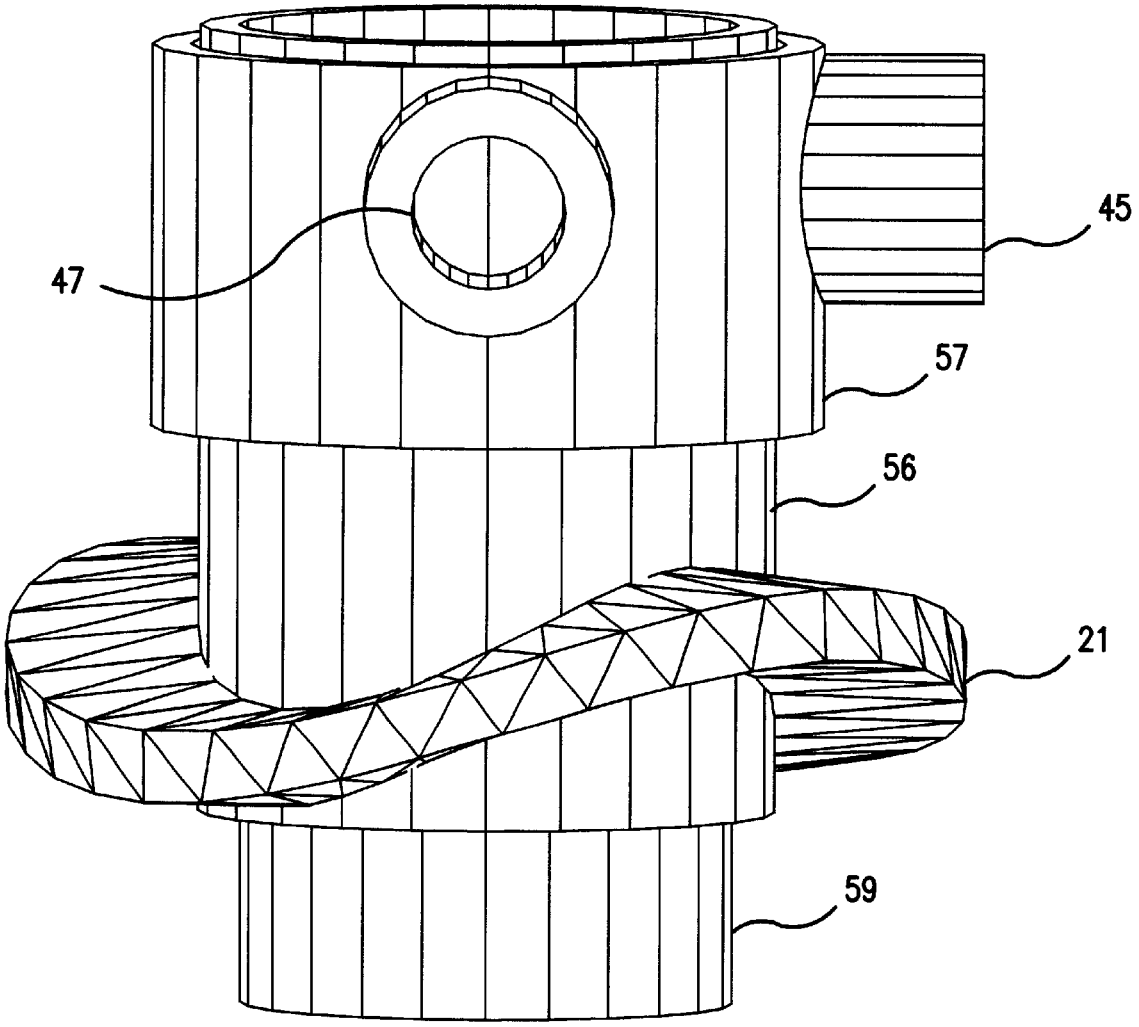
FIG. 9 is a side view of a ported-case embodiment of the invention.

FIG. 9 illustrates a moving cylinder 56 which rotates about a relatively fixed piston 59. The cylinder rotates within a fixed outer case 57. The exhaust port 45 and the intake port 47 are located in the fixed outer case.

Figure 10:
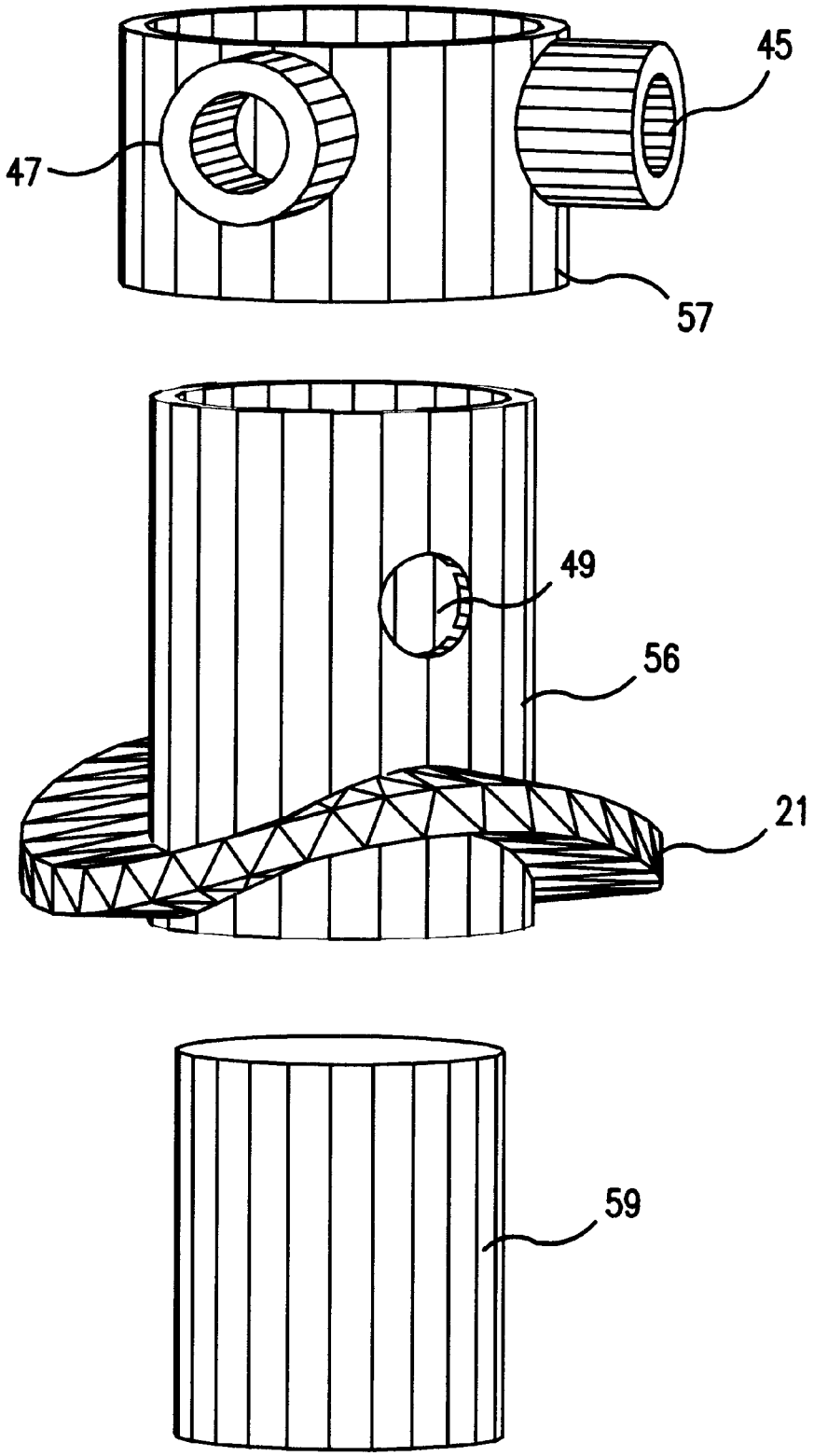
FIG. 10 is an exploded side view showing the elements of FIG. 9.

FIG. 10 is an exploded view which shows the transfer port 49 as a hole in the cylinder. The piston 59 is fixed. A cam means 21 is provided attached to or integral to the cylinder such that as the cam means rotates through fixed followers as in FIG. 5 or through fixed cams as in FIG. 7, the cylinder with the transfer port rotates about the piston and within the fixed outer case.

Figure 11:
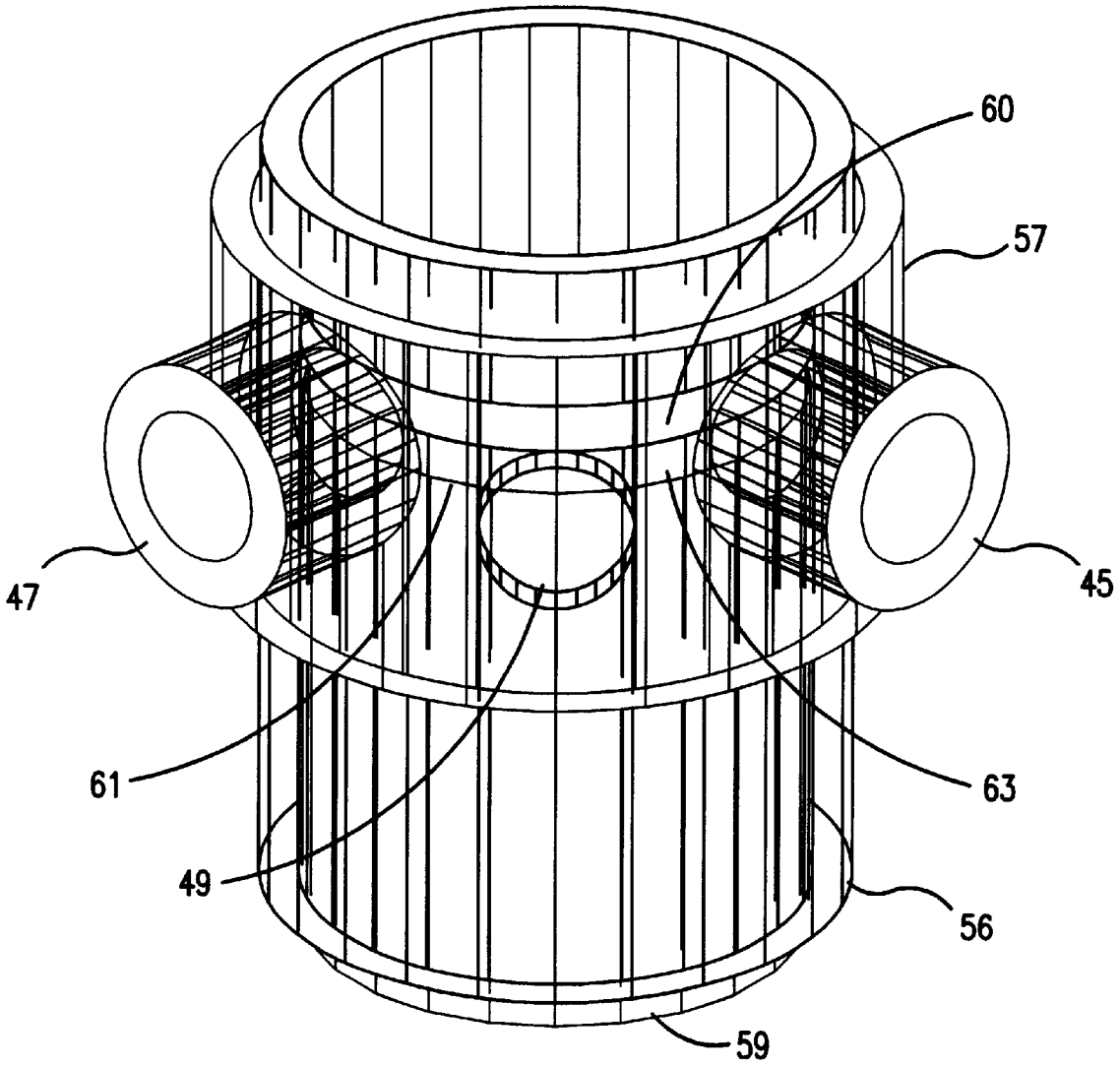
FIG. 11 is a hidden line side view showing the elements of FIG. 9.

FIG. 11 illustrates the location of the fluid chamber 63 formed between the closed end of the cylinder 60 and the piston top surface 61. In a portion of its revolution about the piston, the transfer port 49 will overlap the intake port 47. During most of this time, the volume of the chamber is increasing as the closed end of the cylinder is moving away from the piston, and fluid will be introduced from the intake port, through the transfer port, and into the fluid chamber. In another portion of its revolution about the piston, the transfer port will overlap the exhaust port 45. During most of this time, the volume of the chamber is decreasing as the closed end of the cylinder is moving toward the piston, and fluid will be discharged from the chamber, through the transfer port, and into the exhaust port.

Example—Fixed Cylinder Positive Displacement Device

The examples above have described a relatively fixed piston and a rotating cylinder. Another embodiment of this invention is to allow the piston to move relative to the cylinder.

Figure 12:
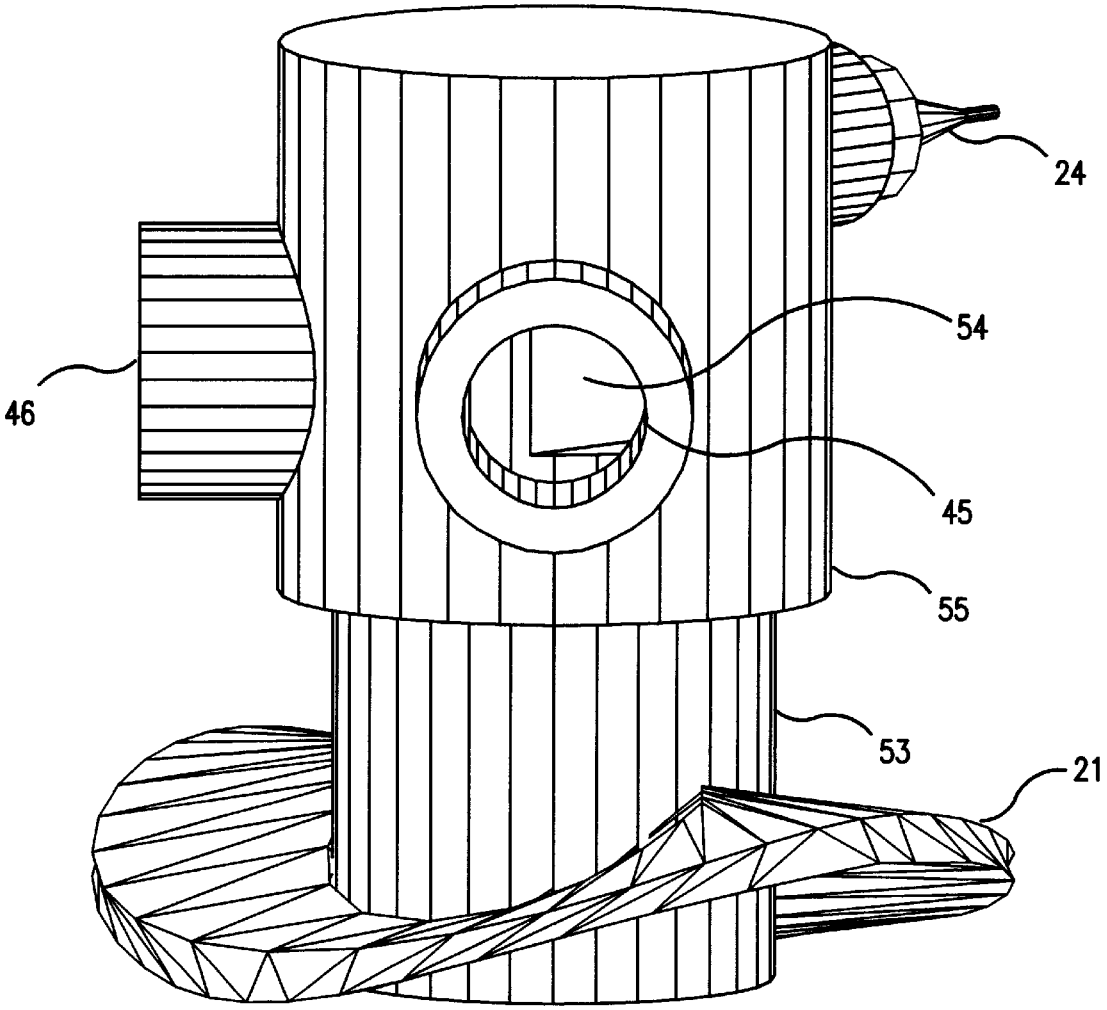
FIG. 12 is a side view of a fixed-cylinder embodiment of the invention.

FIG. 12 shows a fixed-cylinder implementation with a moving piston 53 whose path is controlled by a moving cam 21. The cam is attached to or integral to the piston, and is confined between followers or fixed cams as earlier described. In this case, the exhaust port 45 and the intake port 47 are located on the relatively fixed cylinder 55, and the transfer port 54 is located on the moving piston. This embodiment also illustrates a spark plug 24 as an example of an ignition device.

Figure 13:
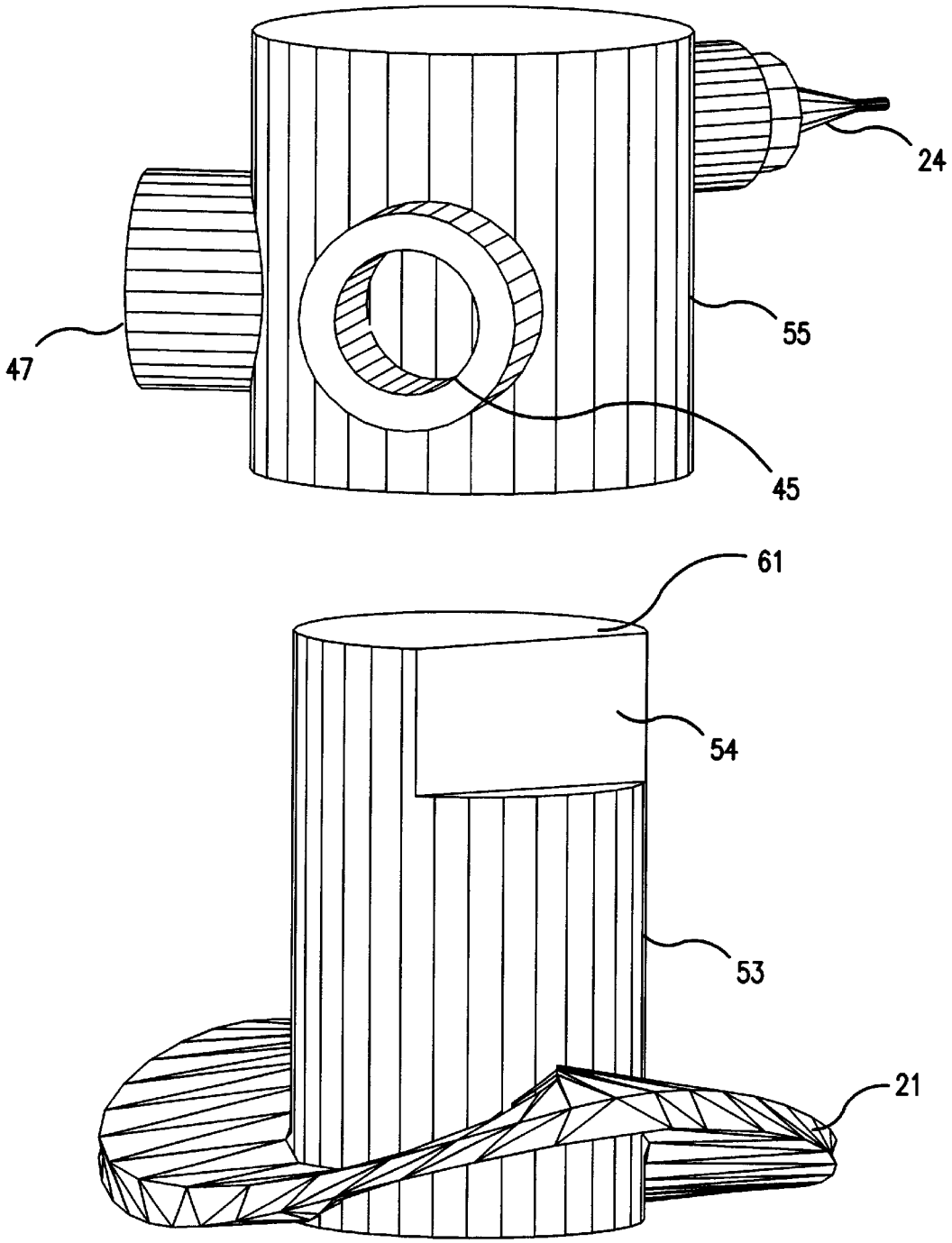
FIG. 13 is an exploded side view showing the elements of FIG. 12.

FIG. 13 shows an exploded view of the components in FIG. 12. The transfer port 54 is shown as a notch on the piston. The fluid chamber is formed between the closed end of the cylinder and the piston top 61. In this embodiment, the positive displacement device is an engine and the fluid chamber is a combustion chamber. In a portion of its revolution within the cylinder, the transfer port 54 will overlap the intake port 47, and fluid will be introduced from the intake port, through the transfer port, and into the fluid chamber. In another portion of its revolution about the piston, the transfer port will overlap the exhaust port 45, and fluid will be discharged from the chamber, through the transfer port, and into the exhaust port.

Example—Integral Enclosure

Figure 14:
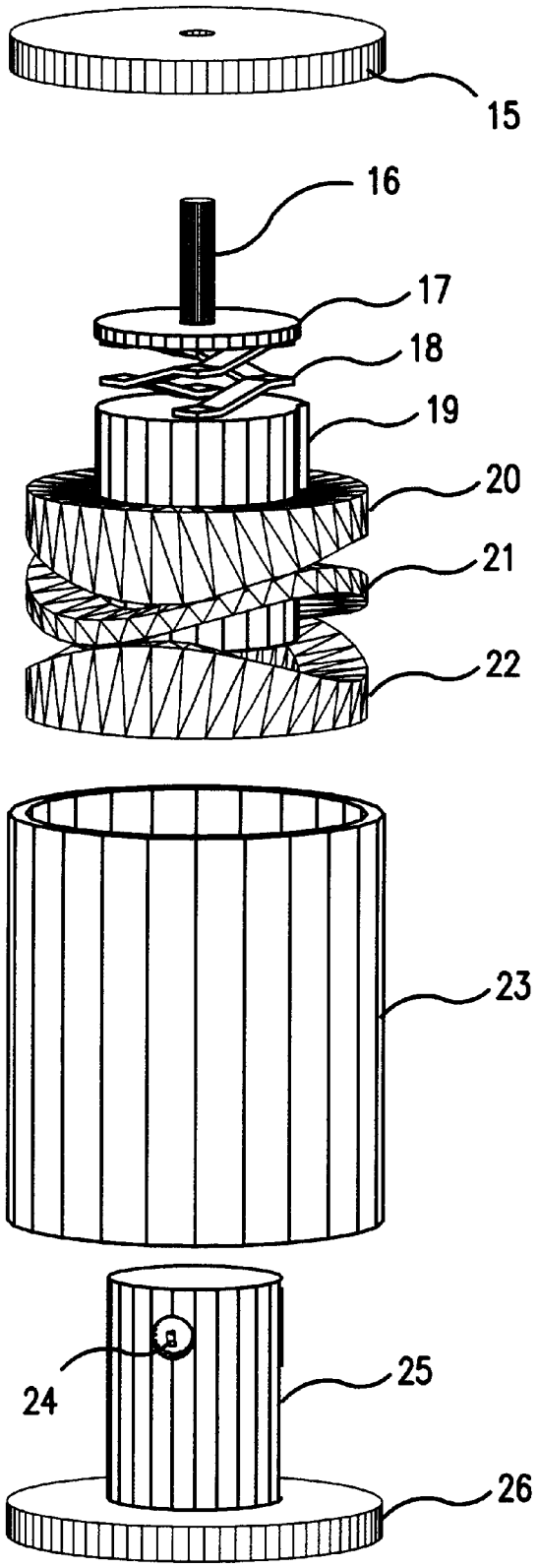
FIG. 14 is an exploded side view showing the elements of FIG. 7 and additional case details.

FIG. 14 shows another implementation of the positive displacement device with a protective case 23, where a bottom end plate 26 is used to secure the piston, and a top end plate 15 is used to enclose the device. In this embodiment, the front fixed cam 20 and the back fixed cam 22 may be attached to the protective case or to the bottom and top plates, respectively. The shaft 16 protrudes through the top end plate. Flexible coupling springs 18 are attached to the top of the cylinder and to a coupling disk 17 so that the shaft can rotate without translating. The positive displacement device is generally a part of a larger machine, and the support function may be provided by that larger machine.

Example—Coupling Arms

Figure 15:
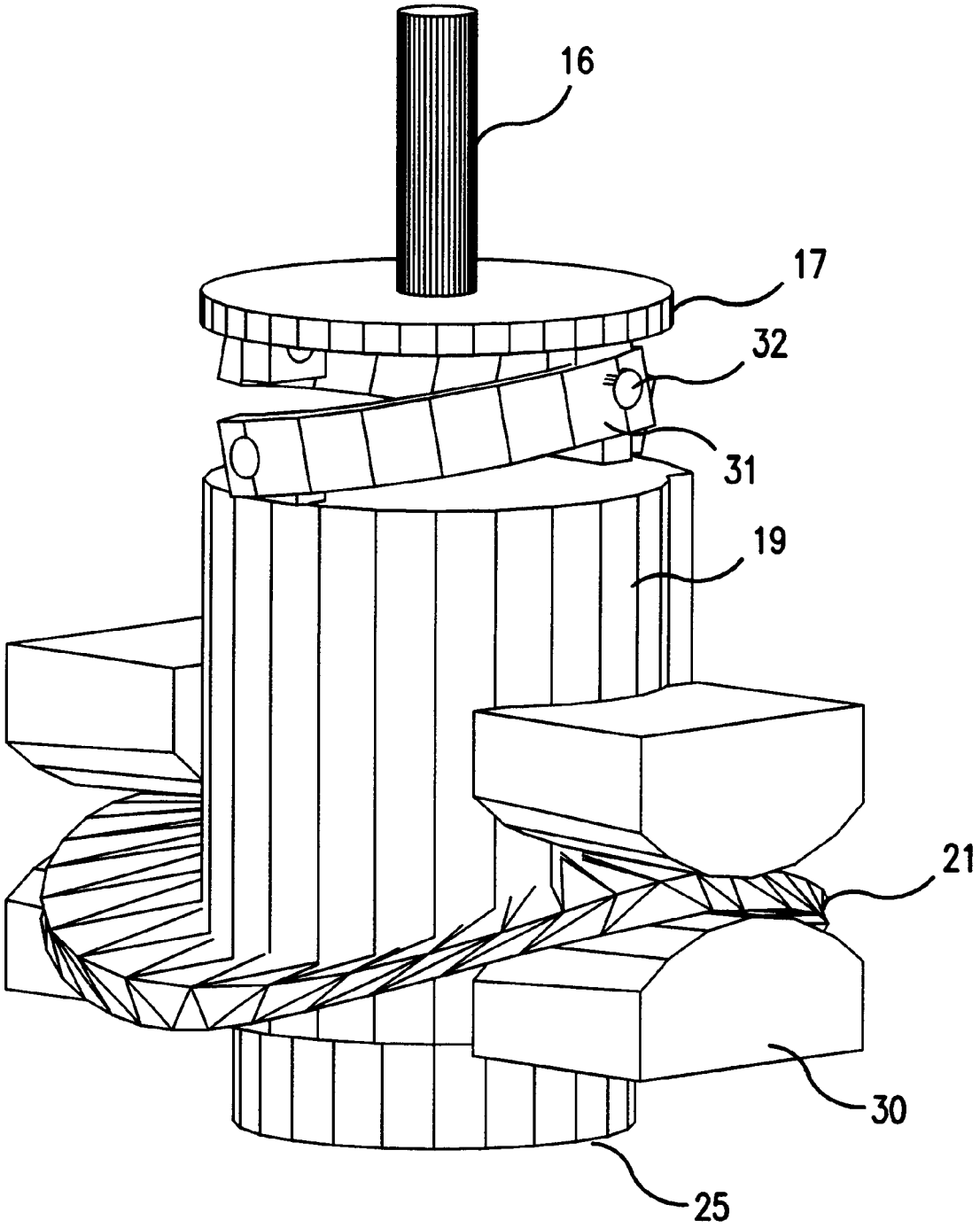
FIG. 15 is a side view of a fixed follower embodiment of the invention with coupling arms.

FIG. 15 shows an alternative means of cylinder 19 to shaft 16 coupling which utilizes coupling arms 31. The coupling arms are attached to the cylinder and to the coupling disk 17 by means of pins 32 in a manner that permits the coupling arms to partially rotate on the pins.

Example—Spline-Like Drive

Figure 16:
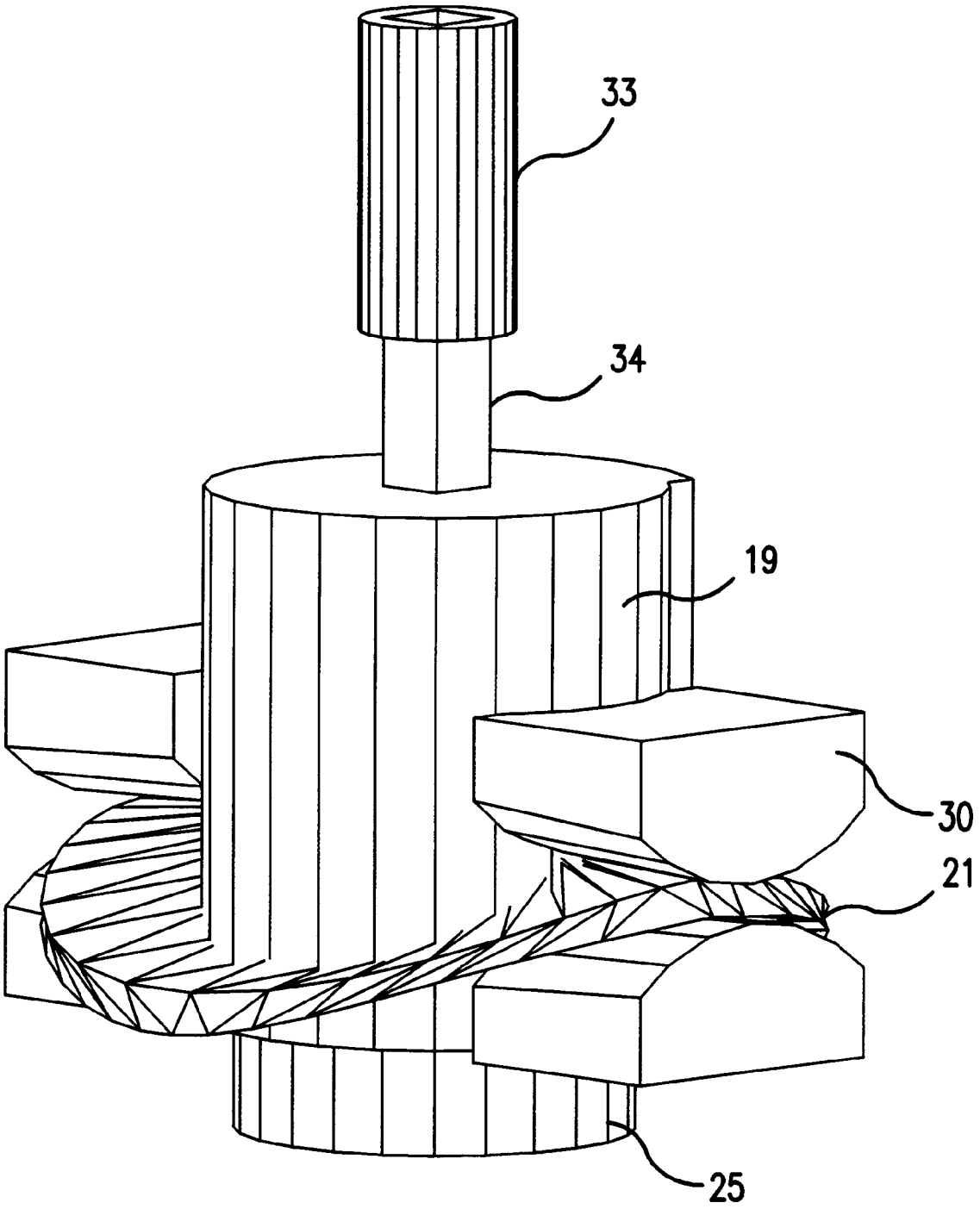
FIG. 16 is a side view of a fixed follower embodiment of the invention with a spline-like square drive.

FIG. 16 shows an alternative means of coupling between the cylinder 19 and a shaft which utilizes a spline-like male square drive 34 and a female square drive 33. This drive arrangements captures the rotational component of the cylinder movement, and allows slippage of the male square drive within the female square drive.

Example—Offset Coupling Arm Positive Displacement Device

Figure 17:
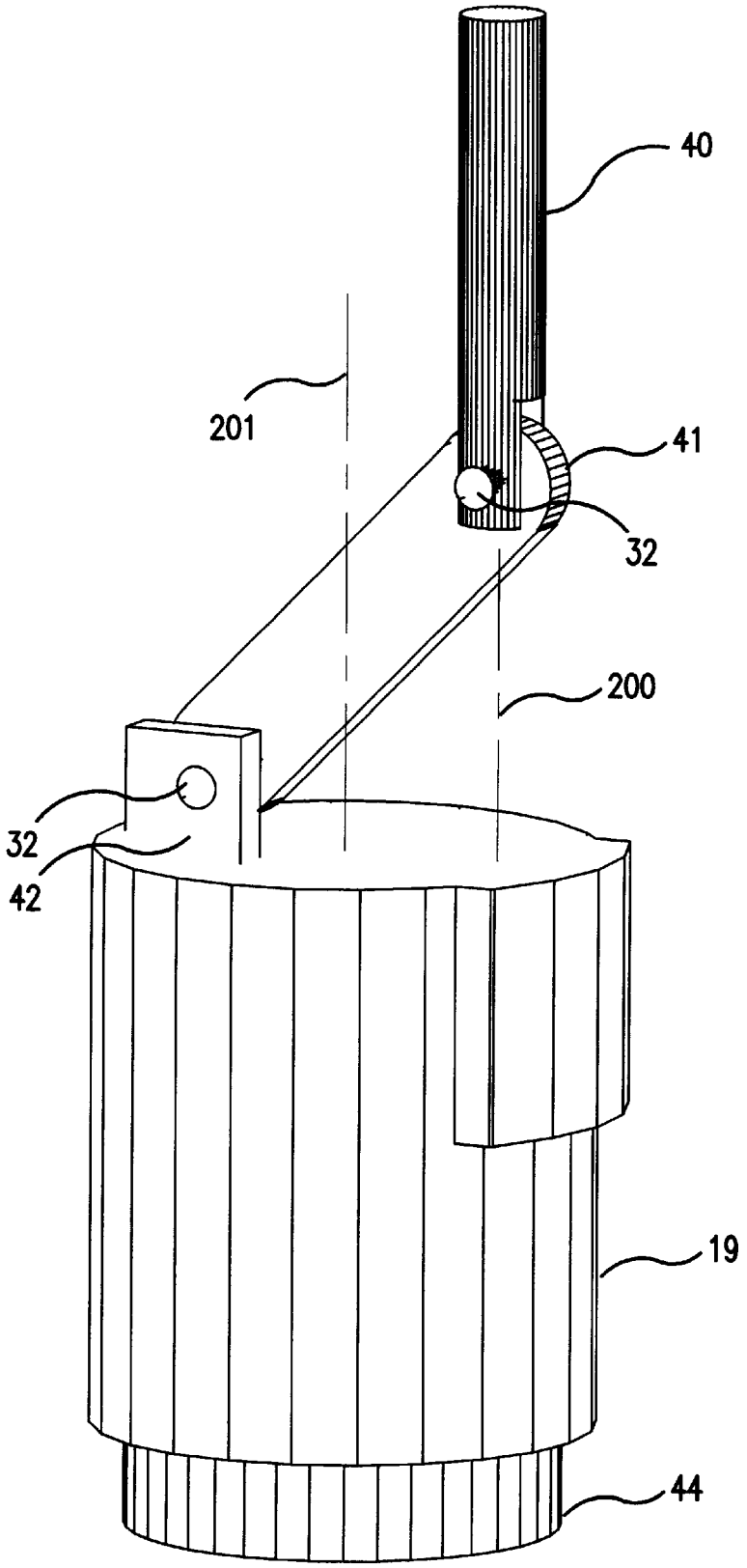
FIG. 17 is a side view of a pump embodiment of the invention with a coupling arm.

FIG. 17 shows an implementation of the device which uses a coupling arm 41 to drive the cylinder 19. In this application, which would typically be used for pumping fluids, the cylinder will make one complete up and down motion with each revolution. The cylinder is attached to the coupling arm by means of a tab 42 and a pin 32. The coupling arm is attached to a slotted shaft 40 by means of a pin 32. The slotted shaft axis of rotation 200 is offset from the cylinder axis of rotation 201. As the slotted shaft turns, it imparts a rotational and reciprocal component to the cylinder. The arm accomplishes the coupling of rotation between the shaft and the cylinder as well as the coupling to the cylinder translation to its rotation.

Figure 18:
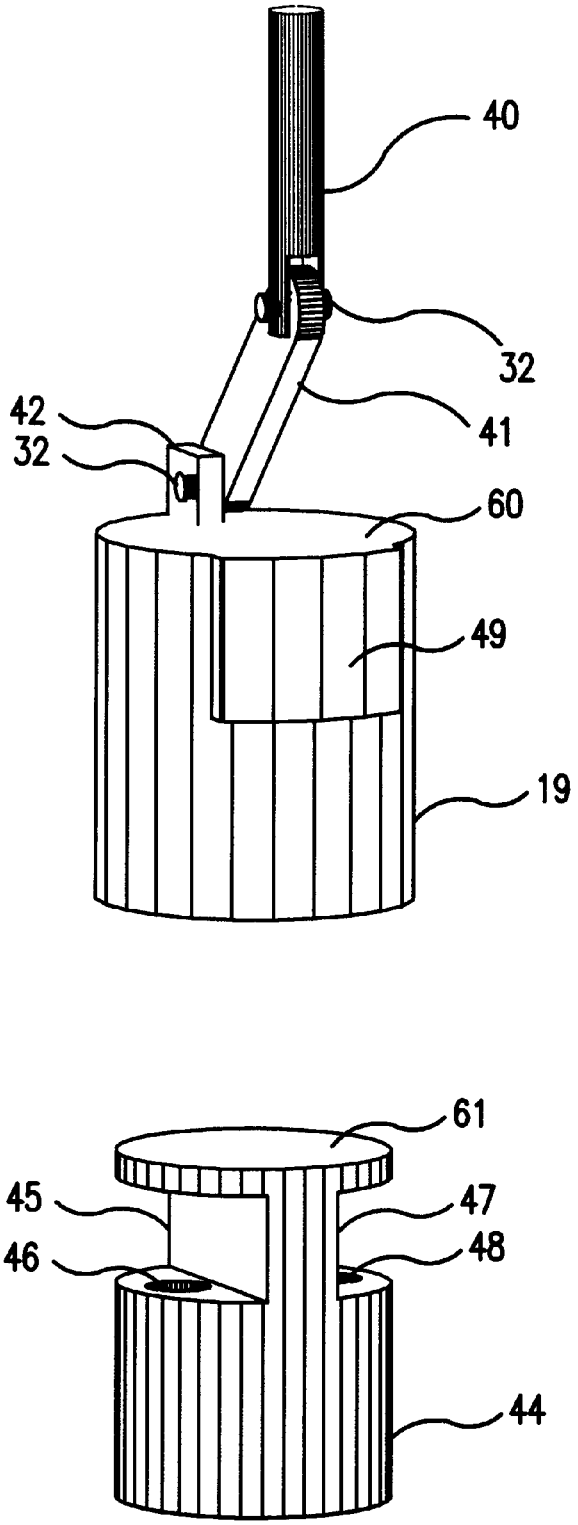
FIG. 18 is an exploded side view showing the elements of FIG. 17.

FIG. 18 is an exploded view which shows details of the piston 44 with an exhaust runner 46 and the exhaust port 45. The intake runner and intake port are located on the opposite side of the piston. As the cylinder rotates around the piston, the transfer port overlaps the intake port, and rises relative to the piston to allow fluid through the intake port into the fluid chamber which is formed between the top of the piston 61 and the closed end of the cylinder 60. As the cylinder continues to rotate around the piston, the transfer port begins to overlap the exhaust port, and the piston is driven down relative to the piston, so that fluid is forced from the fluid chamber through the transfer port into the exhaust port. The typical use of this embodiment is a fluid pump; however it may also be used as a two-stroke engine if an ignition means is provided.

Example—Multiple Cylinder Positive Displacement Device

Figure 19:
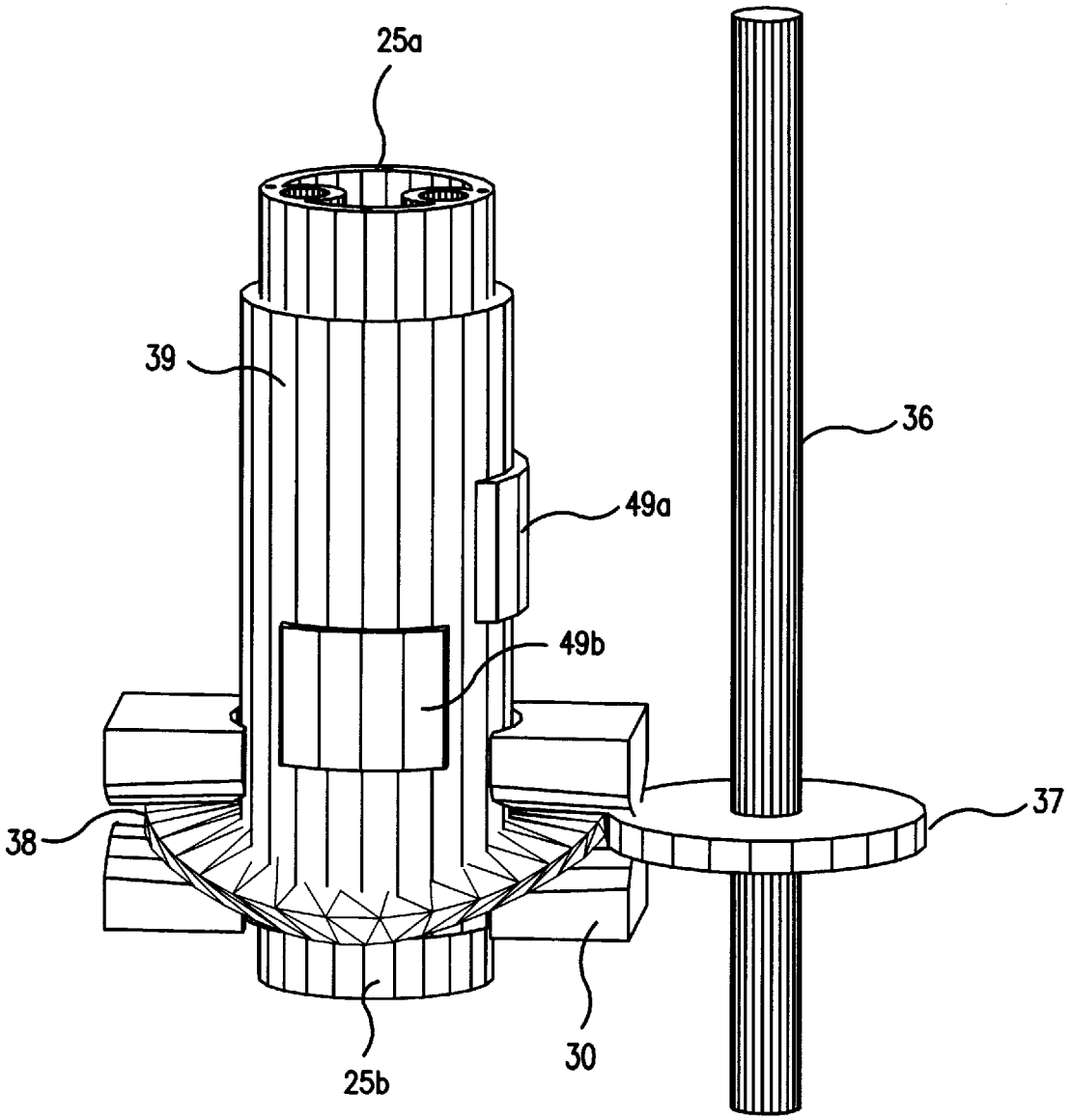
FIG. 19 is a side view of a fixed follower and two-piston embodiment of the invention with a gear drive.

FIG. 19 shows a side view of a two-piston embodiment of the positive displacement device. A double acting cylinder 39 fits over a first piston 25*a* and a second piston 25*b*. The cylinder contains two transfer ports 49*a* and 49*b*, one for each piston. The device may be driven by, or may drive, a gear output shaft 36 by means of an output shaft gear 37 which is turned by, or turns, a moving cam with integral gear 38. The output shaft gear 37 may be driven by a gear located anywhere along the cylinder. This type of drive may also be used on single piston devices. The moving cam with integral gear is attached to or integral to the cylinder, and is restricted by fixed followers 30 which are not attached to the cylinder. The rotation of the moving cam with integral gear causes the cylinder to rotate and translate relative to both pistons. Other cam configurations may also be used.

Figure 21:
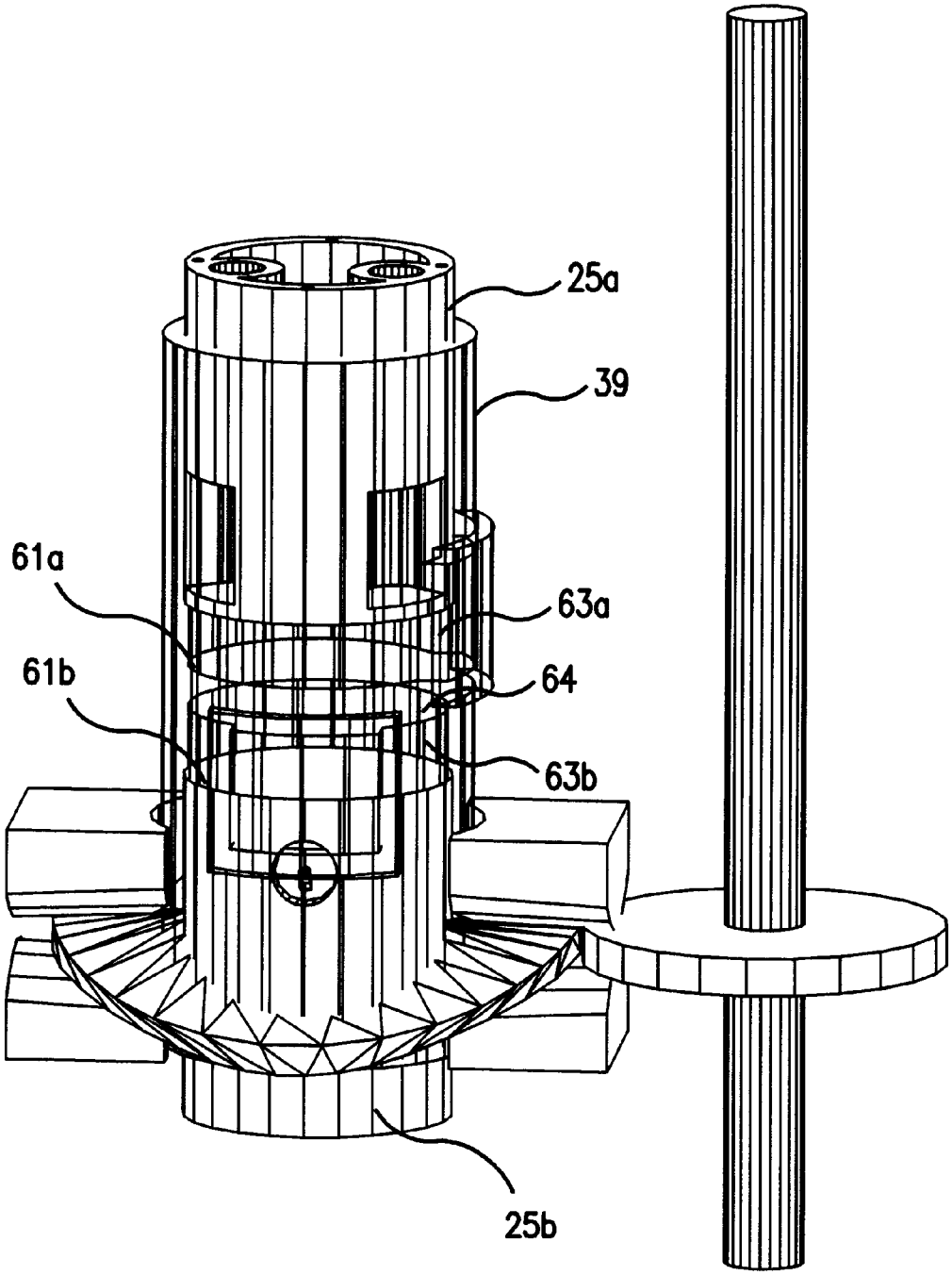
FIG. 21 is a hidden line side view showing the elements of FIG. 19.

FIG. 21 shows a hidden line view of the embodiment described in FIG. 19. A first fluid chamber 63*a* is formed between a cylinder partition wall 64 and the piston top surface 61*a* of the first piston 25*a*. A second fluid chamber 63*b* is formed between the cylinder partition wall 64 and the piston top surface 61*b* of the second piston 25*b*. Since the cylinder movement provides the compression and expansion for both fluid chambers, one chamber will be compressed as the other chamber is expanded.

Figure 20:
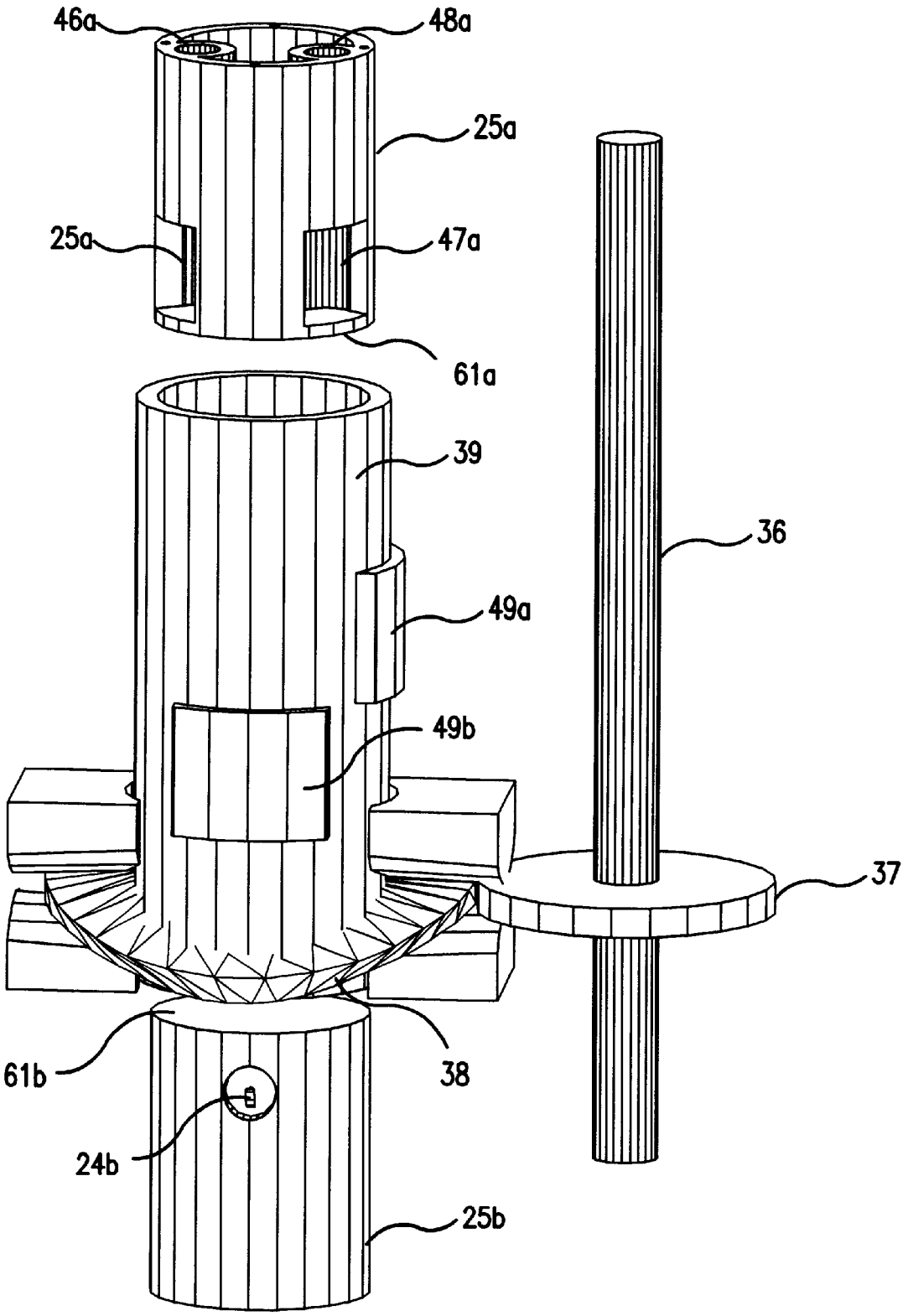
FIG. 20 is an exploded side view showing the elements of FIG. 19.

FIG. 20 shows an exploded view of the embodiment described in FIG. 19. The intake port 47*a*, the intake runner 48*a*, the exhaust port 45*a*, and the exhaust runner 46*a* which are shown on the first piston 25*a*, have been previously described in the single cylinder embodiments. These features are also present, but not shown, in the second piston 25*b*. This embodiment may be used as an engine, and a spark plug 24*b* is shown on the second piston, and is present but not shown on the first piston. It is not necessary that the pistons be the same diameter, or that both sides of the device have the same purpose. For instance, the embodiment described below, is a combination engine and pump. This embodiment, however, shows a "two-cylinder" four-stroke internal combustion engine. In the first piston, the transfer port 49*a* permits fluid to enter the fluid chamber from the intake port, and to exhaust from the fluid chamber to the exhaust port. In the second piston, the transfer port 49*b* permits fluid to enter the fluid chamber from the intake port, and to exhaust from the fluid chamber to the exhaust port.

Example—Combinations of Positive Displacement Devices

Figure 22:
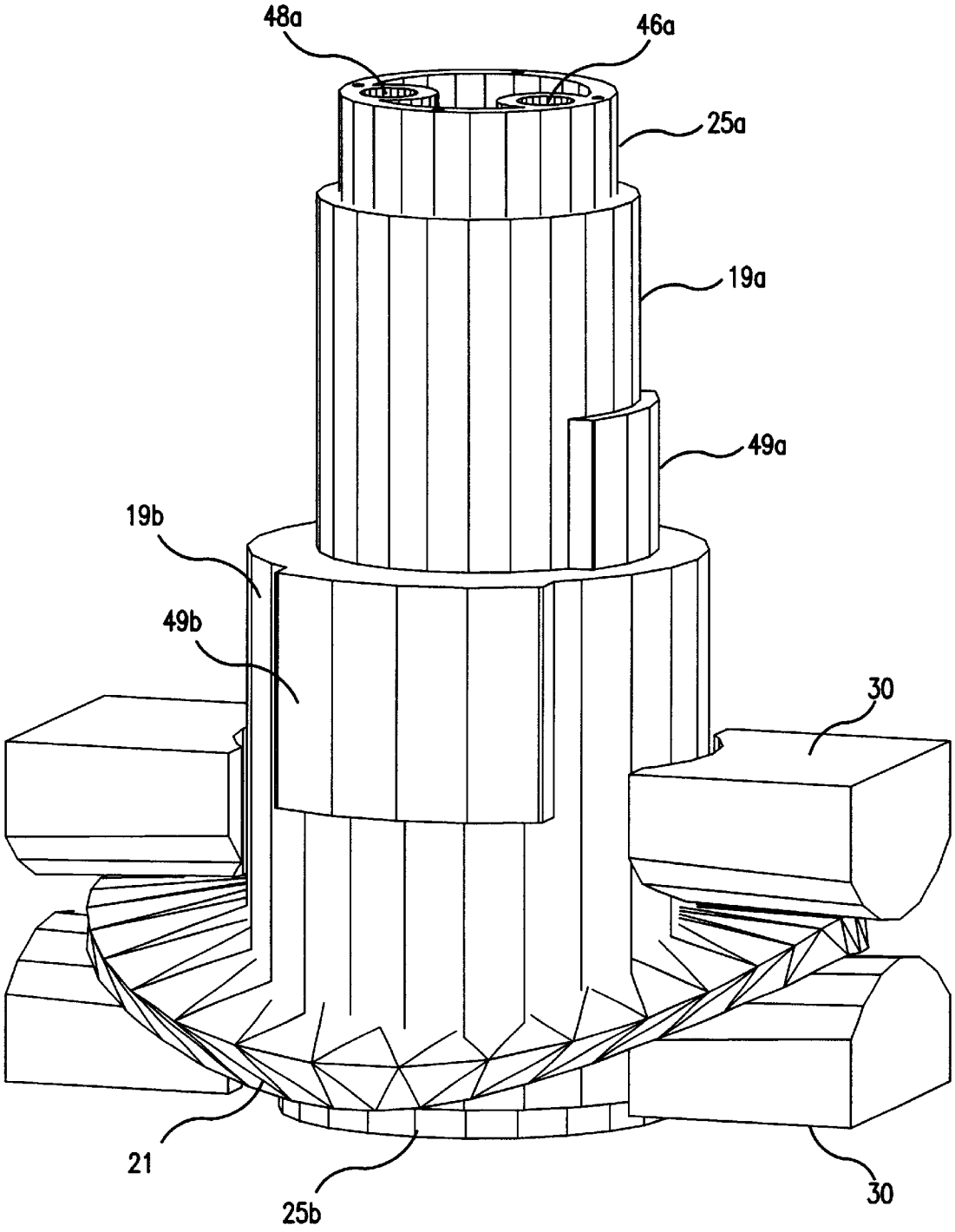
FIG. 22 is a side view of a combination pump and engine embodiment of the invention.

FIG. 22 shows a side view of an embodiment with a combination engine and pump. In this embodiment, the pump has a relatively fixed piston 25*a* containing an intake runner 48*a* and an exhaust runner 46*a*. The pump piston is overlapped by the pump's cylinder 19*a* which has a transfer port 49*a*. The pump's cylinder is integral to the engine's cylinder 19*b* which overlaps a relatively fixed engine piston 25*b*. The engine cylinder contains a transfer port 49*b*. Since the cylinders are integral, the motion of both cylinders is defined by an integral cam 21 as it moves through fixed followers 30. The cylinder component is the only moving part in this embodiment.

The pump is shown to be smaller than the engine in this embodiment because there is no requirement that the positive displacement devices be the same size—the pump could also be larger than the engine or the same diameter as the engine.

Figure 23:
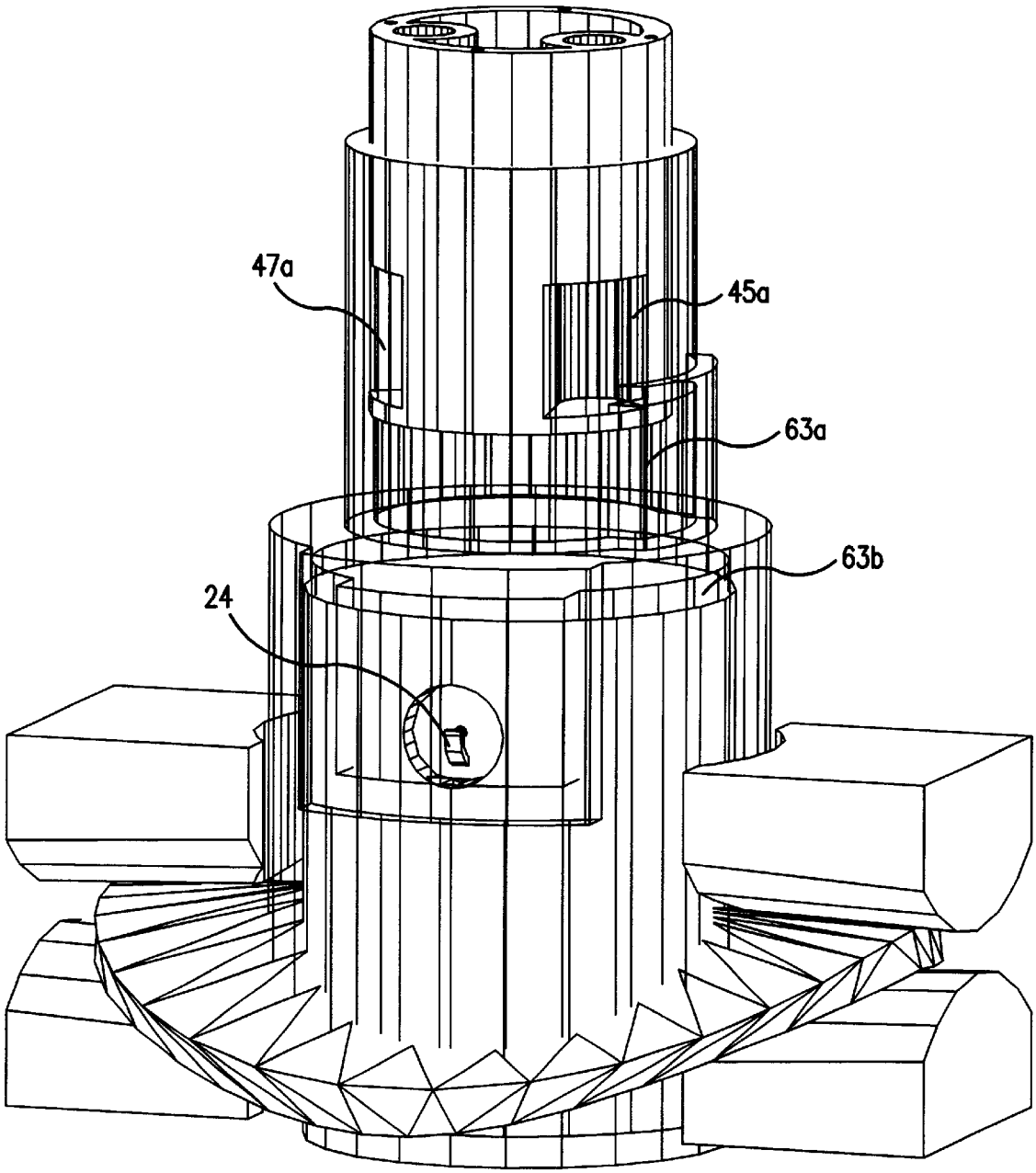
FIG. 23 is a hidden line view of a combination pump and engine embodiment of the invention.

FIG. 23 shows a hidden line view of the embodiment where one pump intake port 47*a* and an exhaust port 47*a* can be seen. The engine contains a spark plug 24. There is a common wall between the pump's cylinder and the engine's cylinder which creates two working chambers—a pump chamber 63*a* between the pump piston and the common wall of the cylinder, and an engine cylinder 63*b* between the engine piston and the common wall of the cylinder. As one chamber volume increases, the other chamber volume will decrease. The engine shown is a four-stroke engine which will complete one four-stroke cycle per revolution. The pump will complete two two-stroke pumping cycles per revolution.

Figure 24:
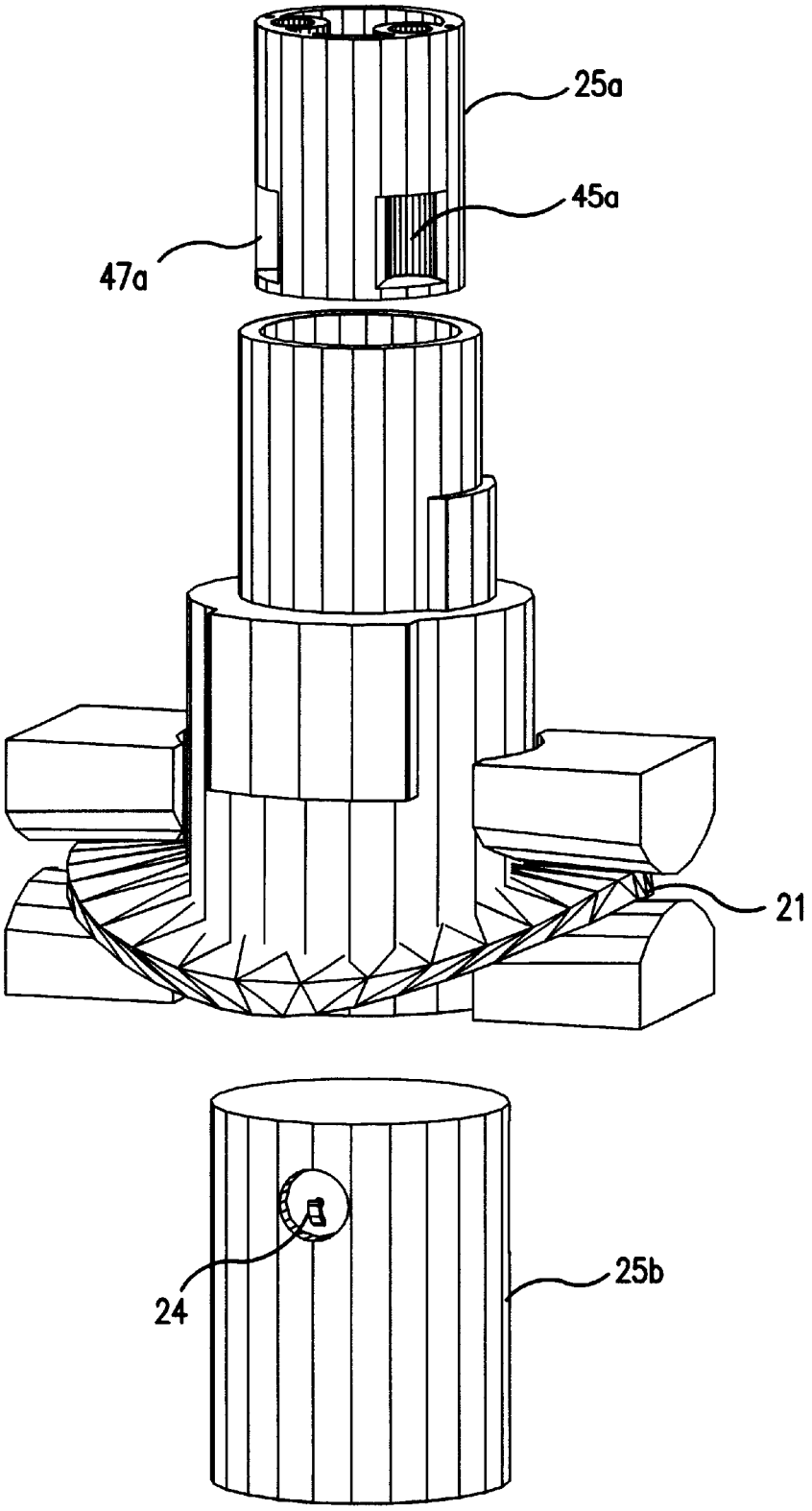
FIG. 24 is an exploded side view showing the elements of FIG. 22.

FIG. 24 shows an exploded view of the embodiment showing an intake port 47*a* and an exhaust port 45*a*. Another set of intake and exhaust ports is located on the opposite side of the pump piston. Since the engine shown is a four-stroke engine, the engine piston contains only a single set of intake and exhaust ports.

DESCRIPTION OF PREFERRED EMBODIMENT

The preferred embodiment of this invention is a single-cylinder, four-stroke, internal combustion engine with a moving cam and fixed cams.

Figure 25:
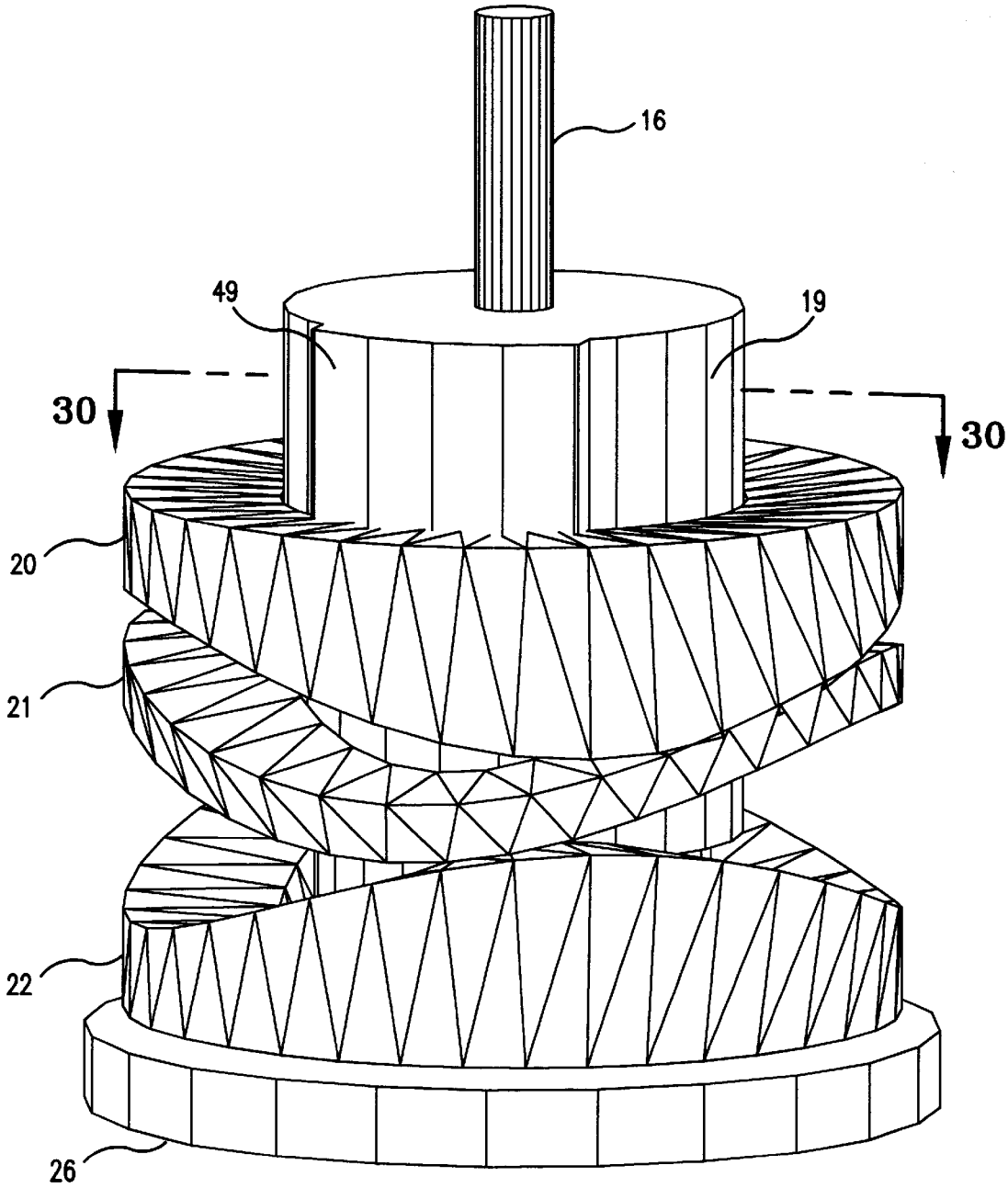
FIG. 25 is a side view of the preferred embodiment of the invention.

FIG. 25 shows a side view of the engine. A relatively fixed piston, not seen in this figure, is attached to a support structure 26, which is a part of an external device. A cylinder 19 rotates and reciprocates relative to the piston. The path of the cylinder is determined by a moving cam 21 which is attached or integral to the cylinder. As the cylinder rotates, the moving cam moves between a front fixed cam 20 which is attached to the support structure but which is not attached to the cylinder, and a back fixed cam 22, which is attached to the support structure but which is not attached to the cylinder. The cylinder and the shaft 16 have both a rotational and a reciprocating component. The external device will generally couple to the rotational component of the cylinder movement, and that coupling detail is not included in the preferred embodiment.

Figure 26:
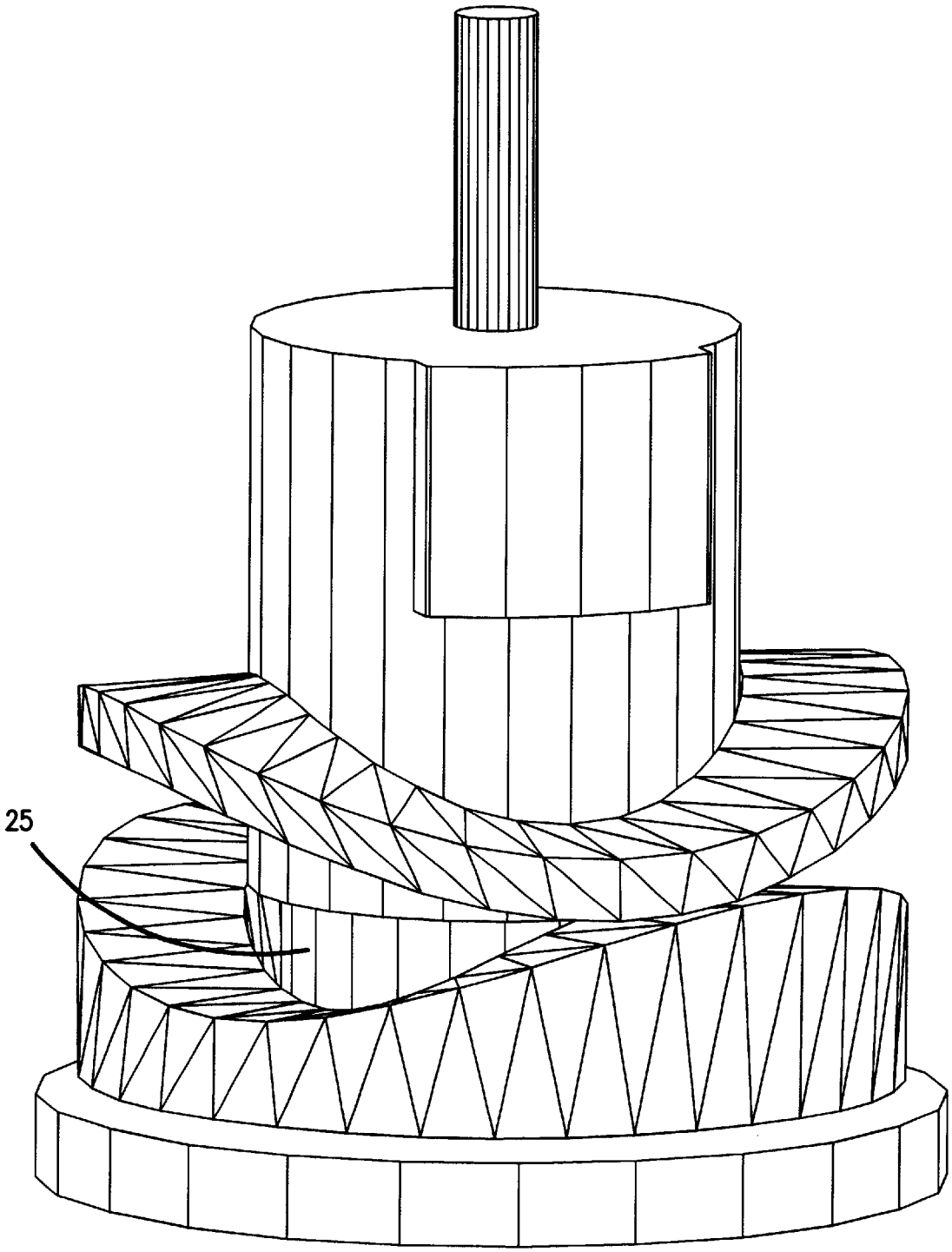
FIG. 26 is a side view of the preferred embodiment of the invention drawn without the top cam.

FIG. 26 shows a side view of the engine with the front fixed cam removed for clarity, and with the cam rotated to a different orientation than FIG. 25. A portion of the he relatively fixed piston 25 can be seen in this figure.

Figure 27:
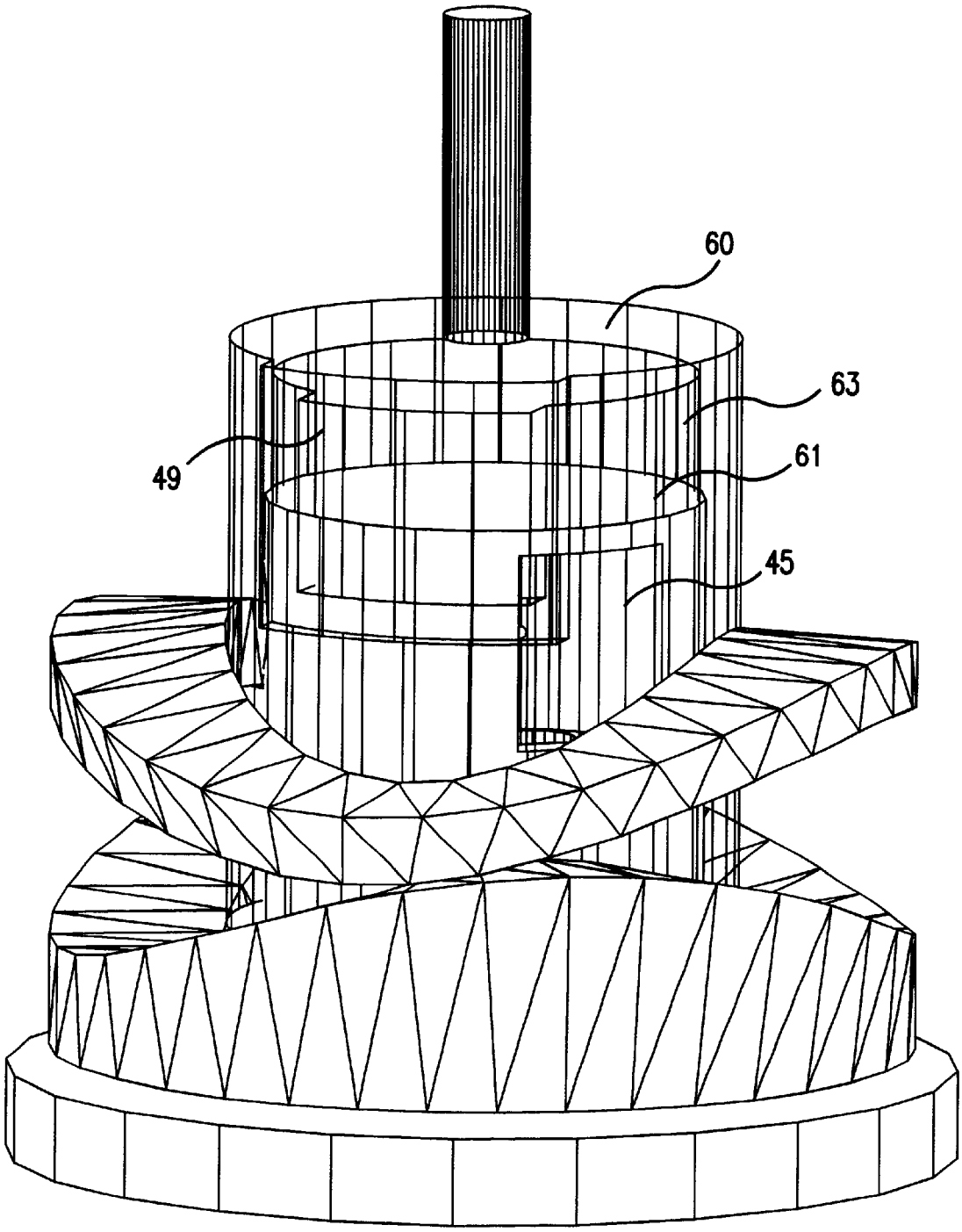
FIG. 27 is a hidden line view of the preferred embodiment of the invention.

FIG. 27 shows a hidden line view of the engine. A combustion chamber 63 is formed between the closed end of the cylinder 60 and the piston top 61. In this view the transfer port 49 has rotated past the exhaust port 45. Earlier in the cycle, the fuel had been permitted to enter the combustion chamber through the transfer port at the time that the transfer port overlapped the intake port.

Figure 28:
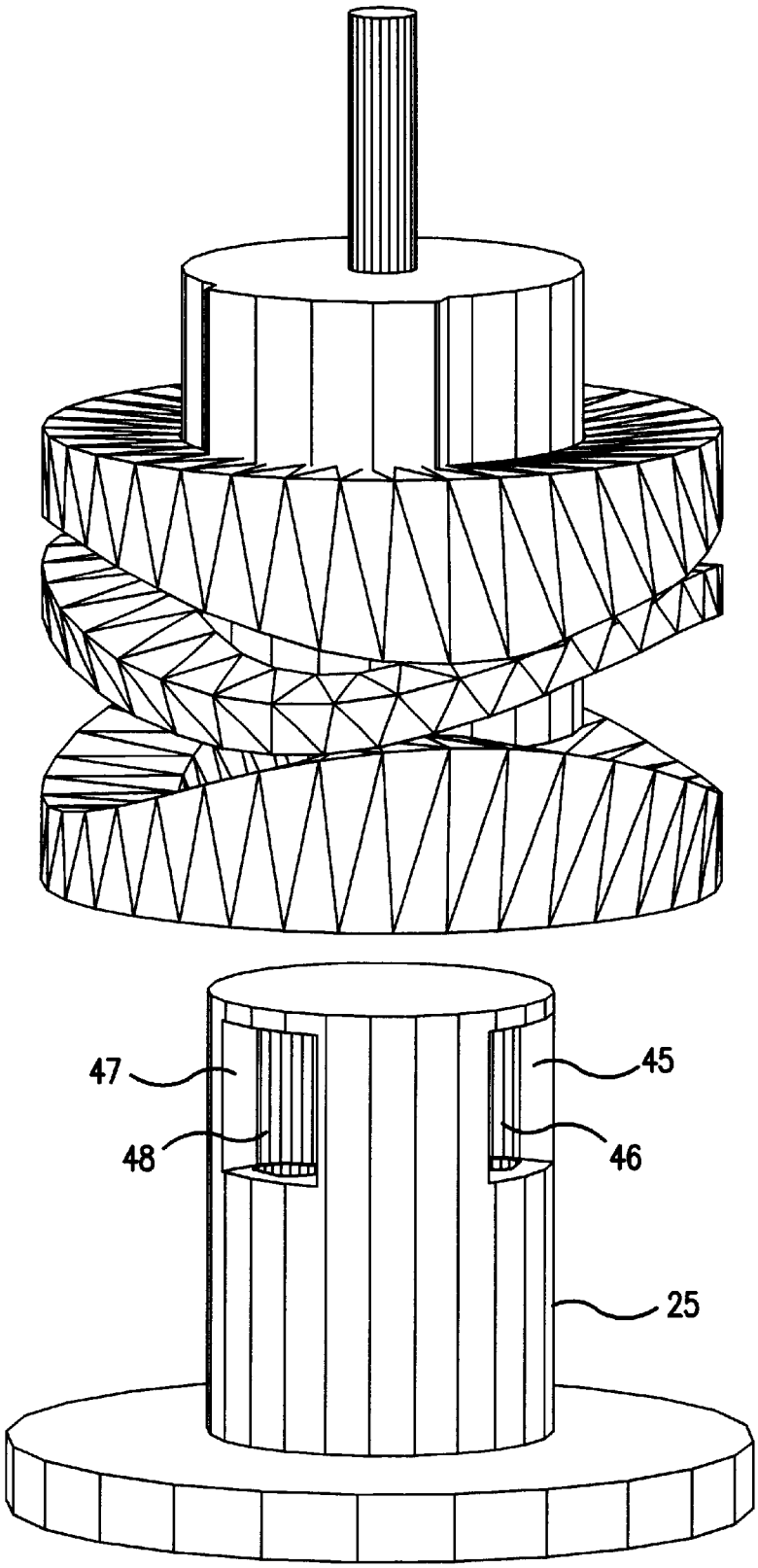
FIG. 28 is an exploded view of the preferred embodiment of the invention showing the ports.

FIG. 28 shows an exploded view of the engine. The intake charge is introduced through an intake runner 48 to the intake port 47. Exhaust is removed through the exhaust port 45 and an exhaust runner 46.

Figure 29:
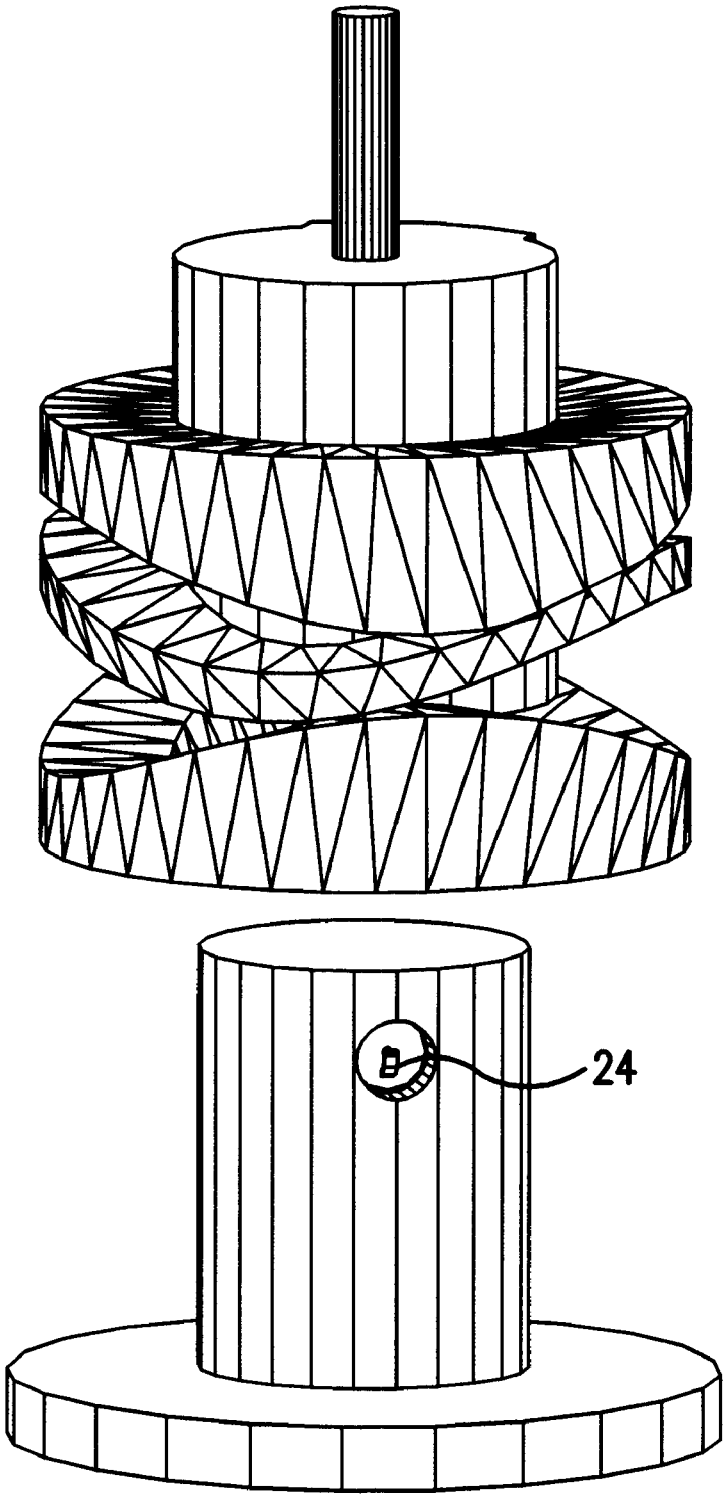
FIG. 29 is an exploded view of the preferred embodiment of the invention showing the spark plug.

FIG. 29 shows an exploded view of the engine on the opposite side of the piston than shown in FIG. 28. In this embodiment, a spark plug 24 is used as an ignition device, although an ignition device is not always necessary because the fuel and the compression ratio can be selected to obtain spontaneous combustion FIGS. 30A–30H are cross sectional views along line 30—30 of FIG. 25 showing relative positions of the transfer port during one revolution of the cylinder. For all cross-sectional views in FIGS. 30A–30H, the cylinder 19 is rotating clockwise about the fixed piston 25. The transfer port 49 is a part of the cylinder, and rotates about the piston. The spark plug 24 is used as an ignition device to ignite the fuel mixture located in the transfer port and in the combustion chamber. Each cross section view shows the relative position of the transfer port 49 to the intake port 47 and the exhaust port 45 at a point in the cycle or revolution of the cylinder about the piston.

FIGS. 31A–31H show the relative position of the cylinder 19, the transfer port 49, and the relatively fixed cylinder 25 corresponding to each cross section view in FIGS. 30A–30H.

For reference and comparison to a conventional slider crank four-stroke piston engine with overhead valves, FIGS. 32A–32H show the relative positions of the piston 301, the chamber 302, the intake valve 303, and the exhaust valve 304.

Figure 30A:
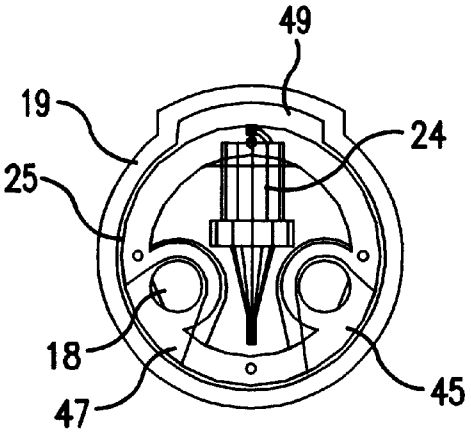
FIGS. 30A to 30H are cross sectional views along line 30—30 of FIG. 25 showing relative positions of the transfer port during one revolution of the cylinder.
Figure 31A:
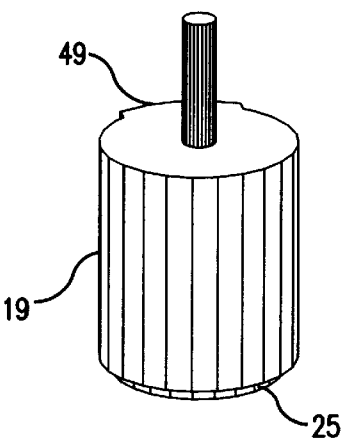
FIGS. 31A to 31H are perspective side views of a cylinder corresponding to FIG. 30A–30H.
Figure 32D:
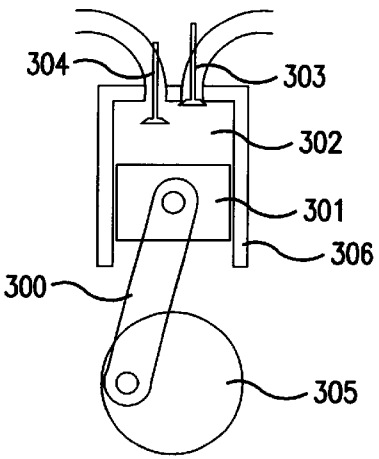
FIGS. 32A to 32H are cross sectional views of a conventional four-stroke piston engine corresponding to FIGS. 30A–30H.
Figure 32C:
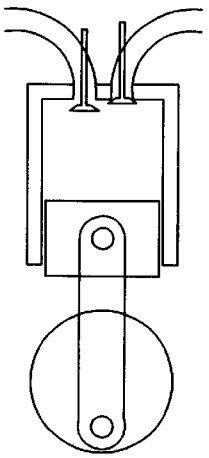
Figure 32B:
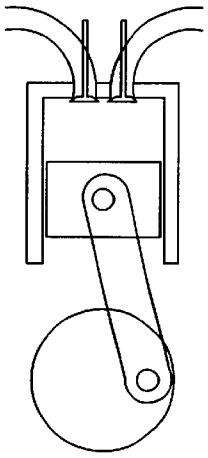
Figure 32A:
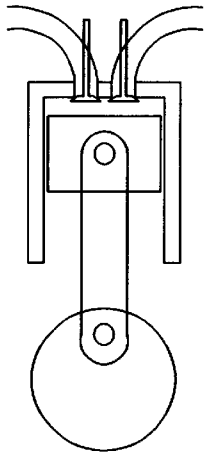
Figure 32H:
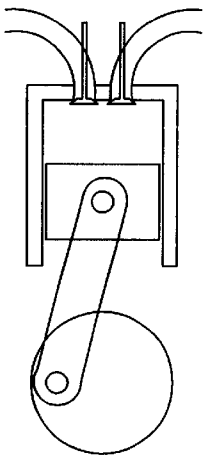

FIG. 30A represents the point of minimum distance between the top of the piston and cylinder, which corresponds to the "top dead center" position of a four-stroke engine. This is a point of maximum compression of the chamber contents; and the approximate time of firing the ignition device. In practice, the device may be fired before minimum chamber volume, and multiple ignition may be used. FIG. 31A shows the compression of the cylinder over the piston. FIG. 32A shows a conventional piston at top dead center with both the intake valve 303 and the exhaust valve 304 closed. The conventional four-stroke piston engine makes two complete revolutions of the crank 305 for each cycle, but this engine accomplishes the four strokes in one revolution.

Figure 30B:
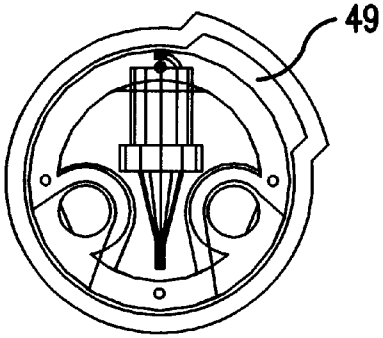
Figure 31B:
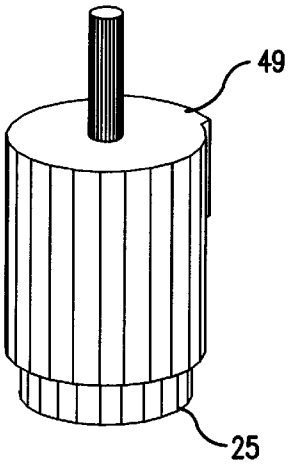

FIG. 30B represents a point in the cycle where the transfer port 49 has rotated clockwise relative to the piston. At this point, the transfer port has not begun to overlap the exhaust port 45, and the combustion chamber is still expanding during the power stroke. FIG. 31B shows the rotation of the cylinder and transfer port 49, and the relative rise of the cylinder with respect to the piston 25. FIG. 32B shows a conventional piston between top dead center and bottom dead center.

Figure 30C:
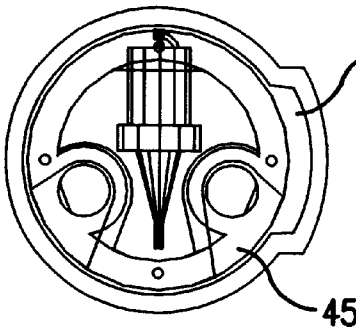
Figure 31C:
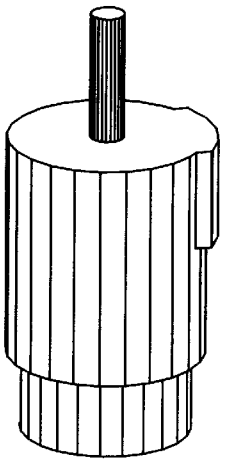
Figure 31D:
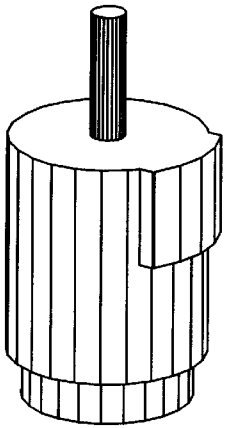

FIG. 30C represents a point in the cycle where the transfer port 49 has rotated clockwise relative to the piston to a point where it has begun to overlap the exhaust port 45. At this point, the combustion products are permitted to escape the combustion chamber through the exhaust port and the exhaust runner 46. FIG. 31C shows the rotation of the cylinder and transfer port 49 to the point of maximum distance between the top of the piston and cylinder, which corresponds to the "bottom dead center" position of a four-stroke engine. FIG. 32C shows a conventional piston at bottom dead center with the exhaust valve 304 partially open.

Figure 30D:
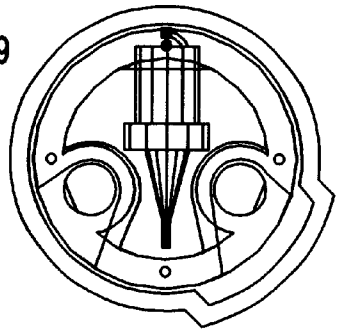

FIG. 30D represents a point in the cycle where the transfer port 49 has rotated clockwise relative to the piston to a point where it has maximum overlap of the exhaust port 45. At this point, the combustion products are being driven from the combustion chamber as the chamber is compressed. FIG. 3 ID shows the rotation of the cylinder and transfer port 49 to partially compress the chamber as the cylinder is lowered relative to the piston. FIG. 32D shows a conventional piston as the piston is being driven back toward top dead center, and the exhaust valve 204 is open.

Figure 30E:
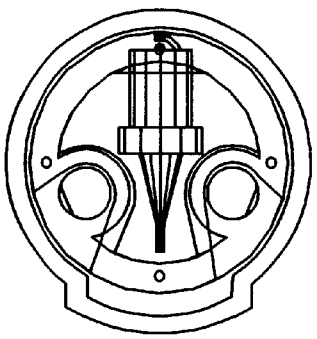
Figure 31E:
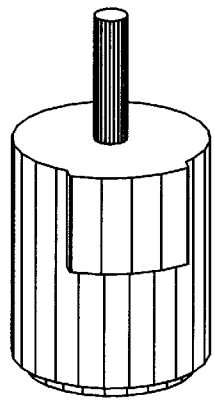

FIG. 30E represents a point in the cycle where the transfer port 49 has rotated clockwise relative to the piston to a point where it partially overlaps the of the exhaust port 45 and the intake port 47. At this point, the combustion chamber is at minimum volume and is at top dead center. FIG. 31E shows the rotation of the cylinder and transfer port 49 to bottom dead center. FIG. 32D shows a conventional piston at top dead center with both the exhaust valve 304 and the intake valve 303 partially open. This illustration demonstrates the requirement for a clearance between the top of a conventional piston and a valved cylinder in order to permit space for the valves to be open at top dead center. The illustration also demonstrates the concept of overlap where both the intake and the exhaust valves are open at the same time. In a conventional engine, there is a practical requirement to have overlap because the action of the valves is relatively slow with respect to the piston motion. Valves are required because the piston is at top dead center more than once in a cycle, and the relative position of the piston and cylinder alone cannot be used to determine when fluids must be introduced or removed from the chamber. If position alone could be used to determine when fluids must be introduced or removed from the chamber, then a simpler porting scheme could be used rather than the valves. Although the preferred embodiment demonstrates an overlap of the intake and exhaust ports, it is possible, and may be desirable to minimize or eliminate this overlap, and there is no mechanical reason why the overlap is necessary in this invention.

Figure 30F:
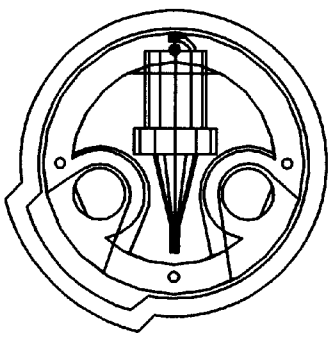
Figure 31F:
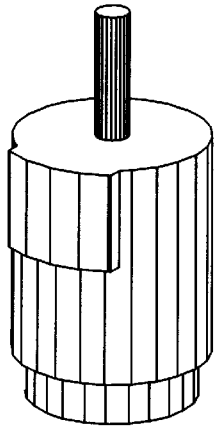
Figure 32G:
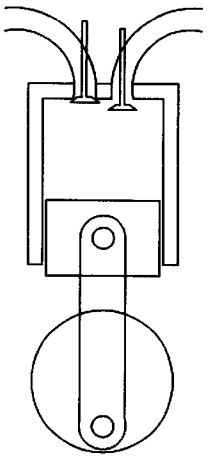
Figure 32F:
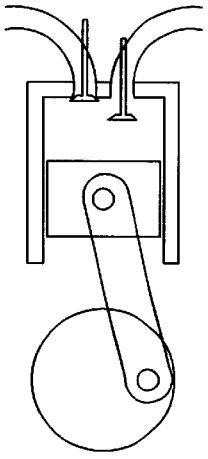
Figure 32E:
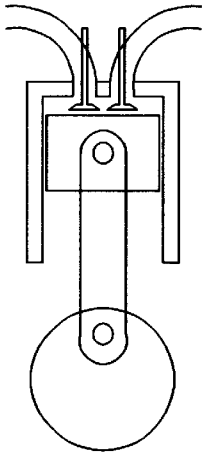

FIG. 30F represents a point in the cycle where the transfer port 49 has rotated clockwise relative to the piston to a point where it overlaps the intake port 47. At this point, the fuel mixture is being introduced to the chamber. FIG. 31F shows the rotation of the cylinder 19 and transfer port 49 to partially expand the chamber as the cylinder is raised relative to the piston. FIG. 32F shows a conventional piston as the piston is being pulled back toward bottom dead center, and the intake valve 303 is open.

Figure 30G:
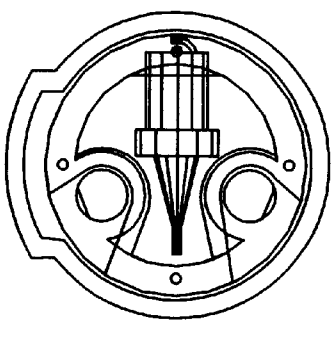
Figure 31G:
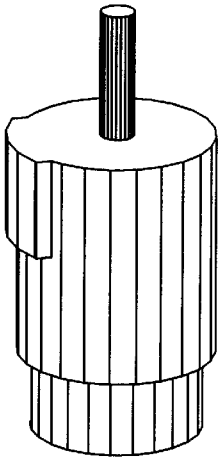

FIG. 30G represents a point in the cycle where the transfer port 49 has rotated clockwise relative to the piston to a point where it has almost passed the intake port 47. FIG. 31G shows the rotation of the cylinder 19 and transfer port 49 to bottom dead center which is the point of maximum expansion of the chamber. FIG. 32G shows a conventional piston at bottom dead center with the intake valve 303 partially open. As the cylinder continues to rotate, the device enters a compression phase that compresses the contents of the chamber.

Figure 30H:
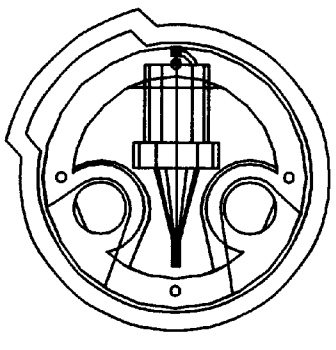
Figure 31H:
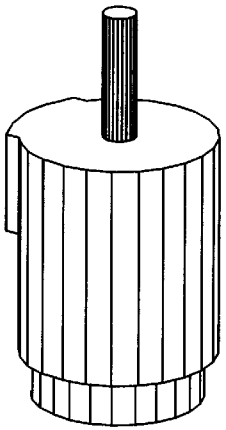

FIG. 30H represents a point in the cycle where the transfer port 49 has rotated clockwise relative to the piston to a point where it has passed the intake port 47. At this point, the fuel mixture is being compressed in the combustion chamber. FIG. 31H shows the rotation of the cylinder 19 and transfer port 49 to a point of partial compression of the chamber. FIG. 32C shows a conventional piston at partial compression with both the intake valve 303 and the exhaust valve 304 closed.

As the cylinder continues to rotate, the compression chamber contents are further compressed until the cylinder reaches a point near minimum chamber volume and the cycle is repeated.

In this example, the ignition of the fuel mixture in the combustion chamber causes the cylinder to continue rotation about the piston. The rotation of the cylinder with respect to the piston accomplishes the porting functions of a rotary valve. The compression and expansion of the chamber is determined by the shape of the cam as it moves through the cam followers.

The key design factors for the engine are the compression ratio, timing, and sealing. The compression ratio may be defined by the following relationships:

Vtdc=Volume at minimum chamber volume or top dead center

Vbdc=Volume at bottom dead center

Bore=Internal Cylinder Diameter

TDC=top dead center, or point of maximum compression

TDC Clearance=distance between piston top and cylinder at TDC

Stroke=Difference between TDC and BDC

Vtdc=[Bore*(TDC Clearance)]+transfer port volume

Vbdc=[Bore*(stroke +TDC Clearance)]+transfer port volume

Compression ratio=Vtdc/Vbdc

In this example, the compression ratio is fixed. In some applications the piston position may be changed to permit adjustment of TDC Clearance and change in compression ratio. The timing of the engine is accomplished by the location and size of the intake port, exhaust port, and transfer port. In this example, the tolerances are selected such that sealing rings are not required.

FIG. 33 shows the preferred range of design parameters for the size of the transfer port, exhaust port, intake port, and the relative positions of the exhaust and intake ports. The port widths and positions are expressed in terms of degrees relative to a 360 degree single revolution cycle. Desired compression ratios are provided for both spark and compression ignition. The transfer port height is given in terms of stroke height. Desired clearances are provided for engines with and without sealing rings.

Figure 34:
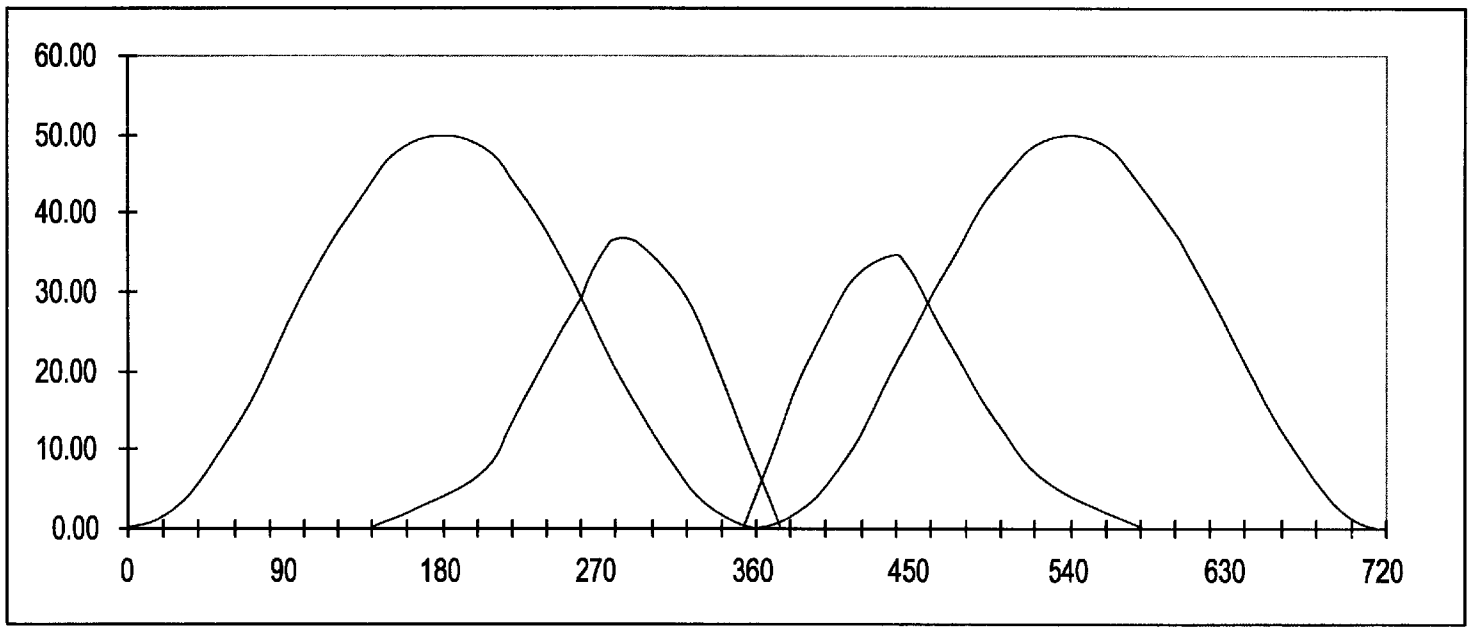
FIG. 34 is chart showing preferred embodiment design parameters and the resulting timing.

FIG. 34 shows the preferred embodiment design parameters for the size of the transfer port, exhaust port, intake port, and the relative positions of the exhaust and intake ports. The timing values are roughly equivalent to timing values for a traditional four-stroke engine with a 720 degree, two revolution, cycle. These figures represent the input values for a computer program which calculates the position in degrees for the opening and closing of the ports. The equivalent values for a traditional four-stroke engine are shown below in terms of a 720 degree cycle. The 720 degree cycle represents the typical 2 revolutions per cycle in a 4-stroke engine.

The graph in FIG. 34 represents the sinusoidal path 80 of a point on the transfer port. The origin 78 of the plot represents a "top dead center point" of minimum volume. Ignition occurs at approximately point 91. At point 83, the exhaust port opens; at point 86 the intake port opens; at point 85, the exhaust port closes; and at point 87, the intake port closes. The difference between the opening of the intake port 86 and the closing of the exhaust port 85 represents the design overlap. In this example, the exhaust port is slightly larger than the intake port. The path shown is sinusoidal, but other paths can be used to achieve modifications to the cycle.

Example—Positive Displacement Device With Multiple Cycles Per Revolution

Figure 35:
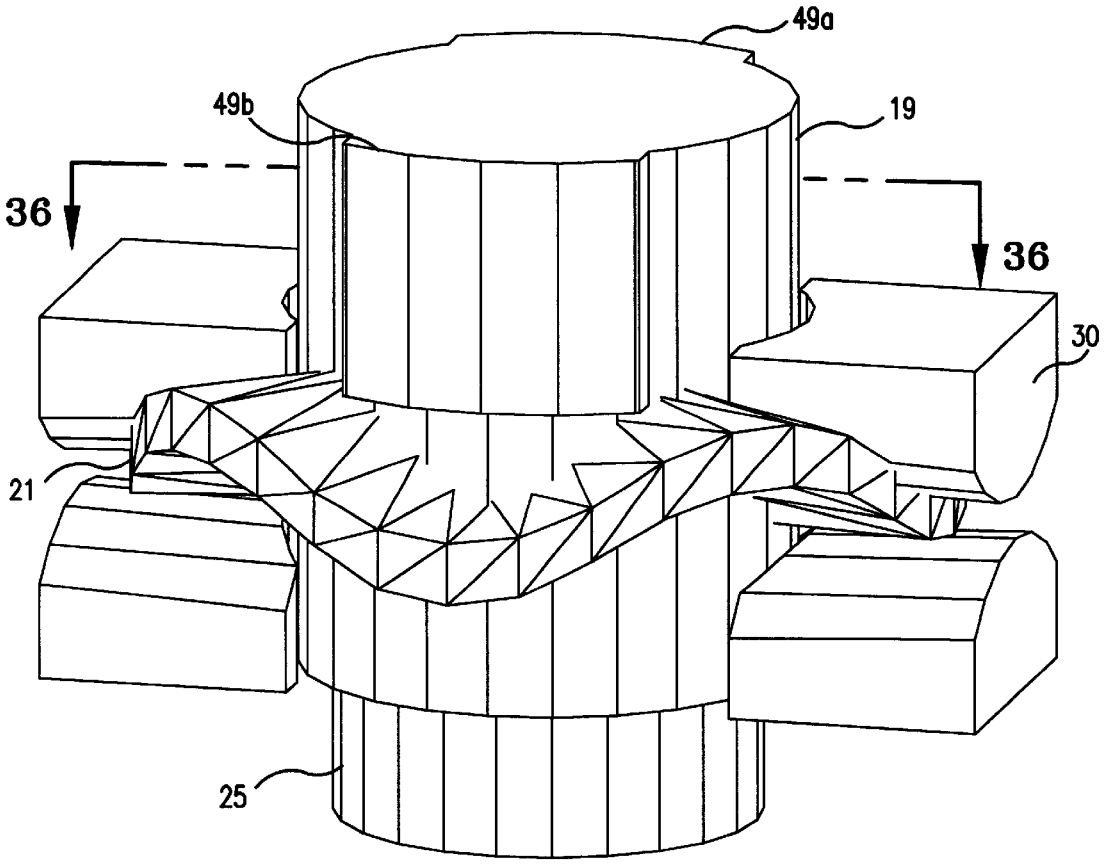
FIG. 35 is a side view of an engine which completes two cycles per revolution.

FIG. 35 is a side view of an engine which completes two complete cycles per revolution. The shape of the integral cam 21 as it moves through the fixed followers 30 will determine whether the cycles are four-stroke, two-stroke, or another type of cycle. The two cycles are shown as an example, and it may be desirable to have a greater or lesser number of cycles per revolution. The device may be any positive displacement device. The cylinder 19 and the transfer ports 49*a* and 49*b* are shown to rotate and translate relative to the piston 25. In other embodiments, a single transfer port could serve multiple intake and exhaust ports.

Figure 36:
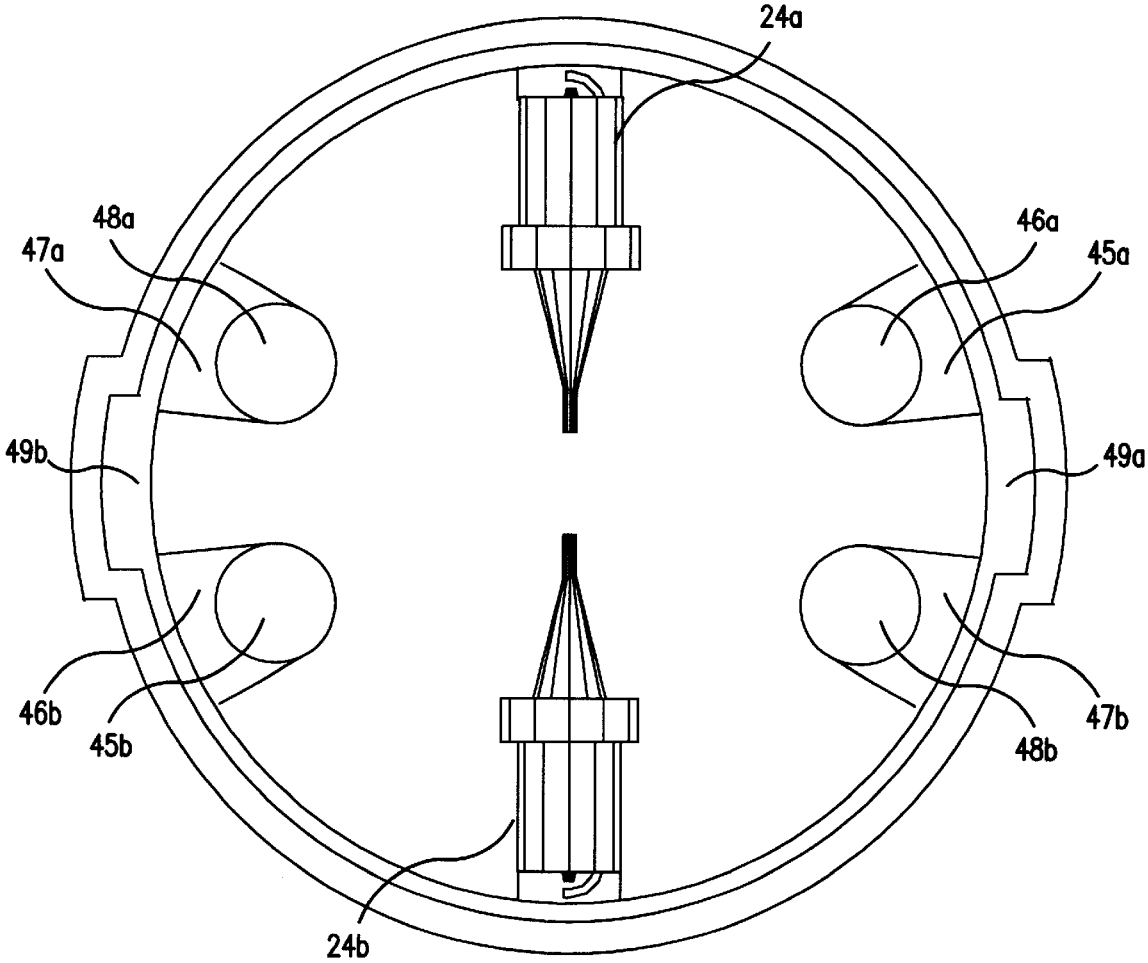
FIG. 36 is a cross sectional view along section 36—36 of the engine shown of FIG. 35.

FIG. 36 is a cross sectional view of the engine shown along section a–a' of FIG. 35. This view shows the transfer ports 49*a* and 49*b* rotating clockwise with the cylinder 19 past the exhaust ports 45*a* and 45*b* and toward the intake ports 47*a* and 47*b*. Following the intake stroke, the chamber contents will be compressed and then ignited by the spark plugs 24*b*.

Example—Electromagnetic Path Definition

Figure 37:
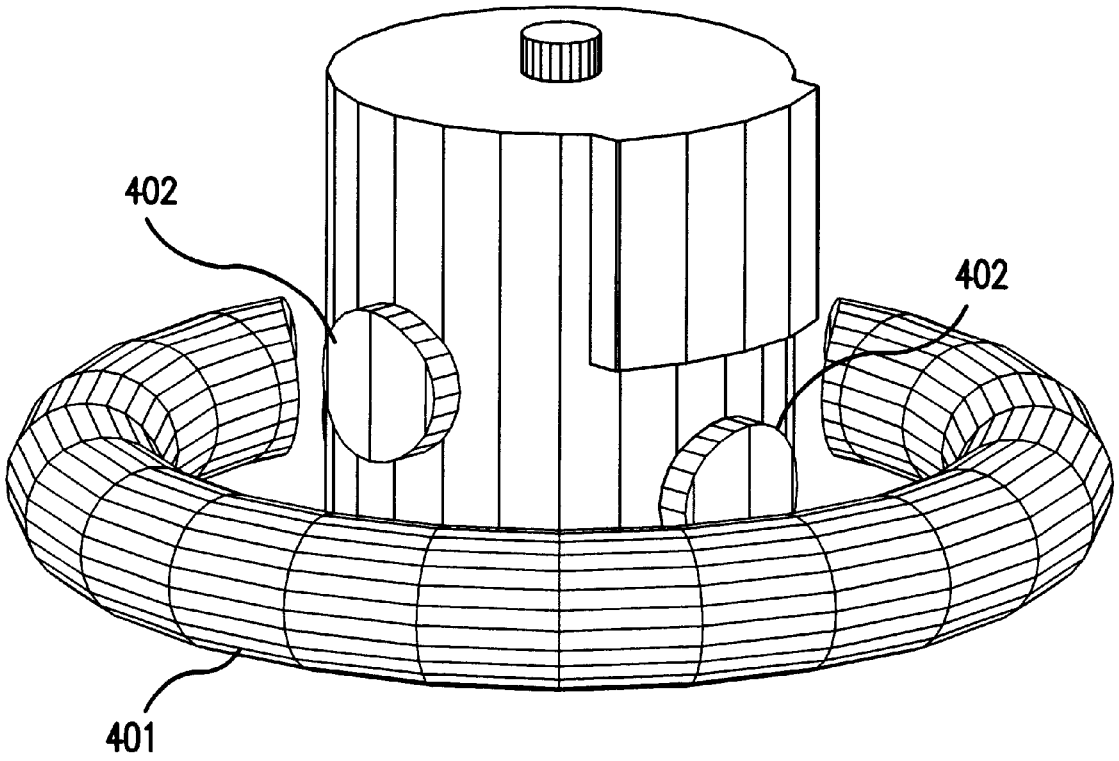
FIG. 37 is a side view of a positive displacement device with an electromagnetic means for defining the path of cylinder rotation and translation.

FIG. 37 is a side view of a positive displacement device with an electromagnetic means for defining the path of cylinder rotation and translation. In this example, an electromagnet 401 is used to create an electromotive force on the poles 402 to drive the cylinder rotation and translation.

Example—Injector, Glow Plug, and Piston Ring Sealing Means

Figure 38:
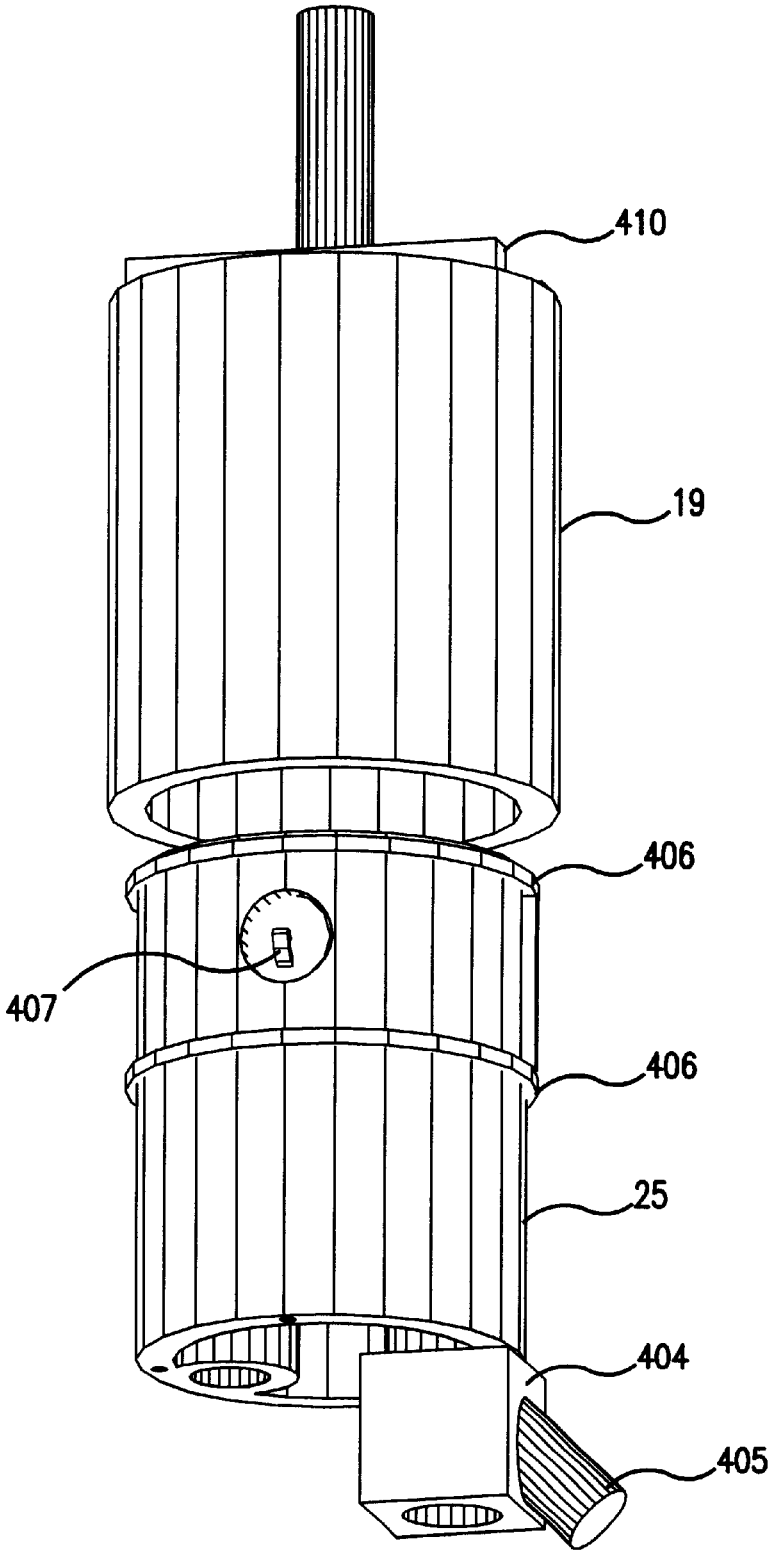
FIG. 38 is an exploded view of an engine showing a fuel injector, a glow plug ignition means, and piston ring seals.

FIG. 38 is an exploded view of an engine showing an injector 405 and throttle body 404 to introduce a fuel into an air stream to the intake runner. The engine is ignited by a glow plug 407. Sealing between the piston and cylinder is provided by piston rings 406. Cylinder cooling is provided by one or more fins 410 integral to the top of the cylinder.

Example—Carburetor and Port Sealing Means

Figure 39:
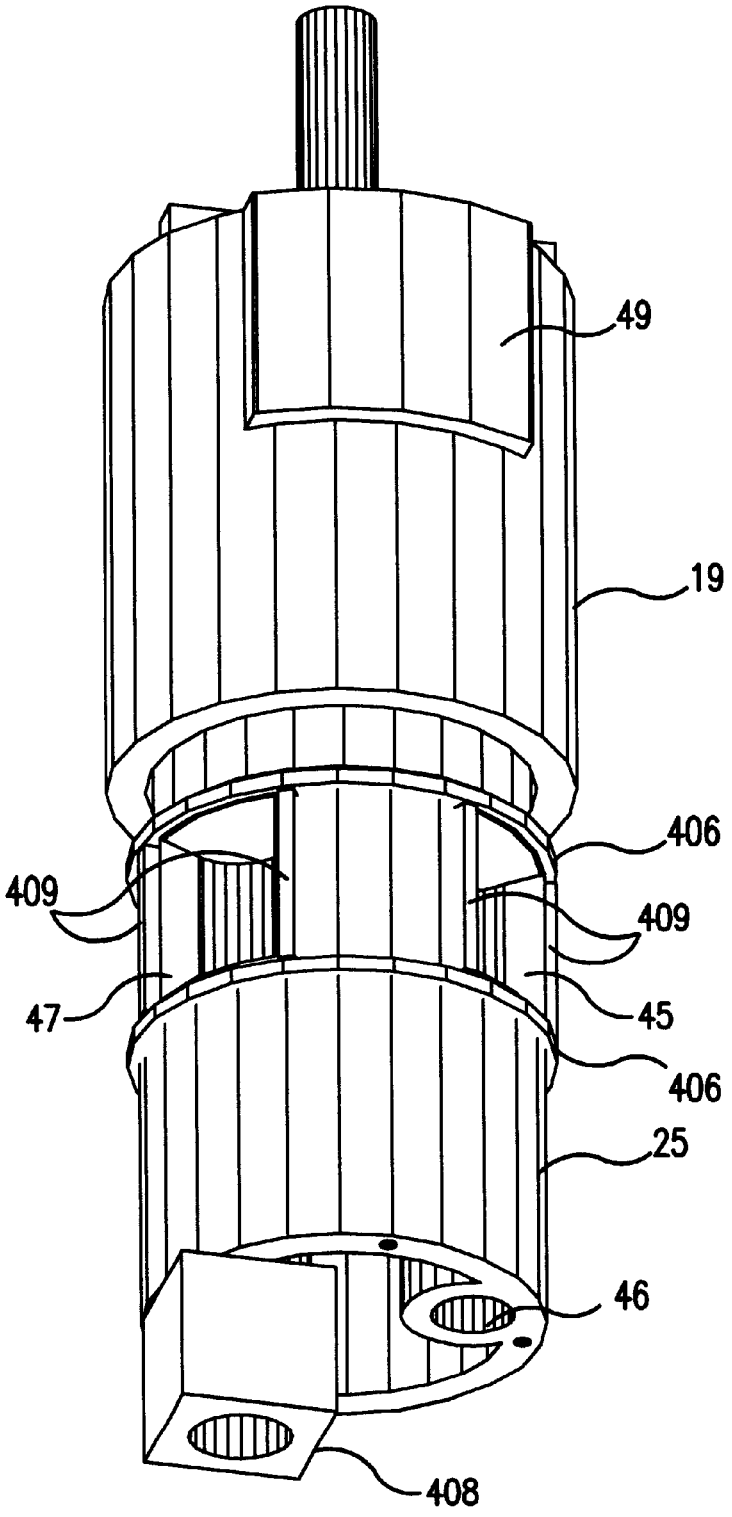
FIG. 39 is an exploded view of an engine showing a carburetor and a port sealing means.

FIG. 39 is an exploded view of an engine showing a carburetor 408 to introduce a fuel and air to the intake runner. Sealing between the piston and cylinder is provided by piston rings 406. Sealing around the intake port and exhaust port is provided by a port sealing means 409.

Example—Variable Compression Ratio Engine

Figure 40:
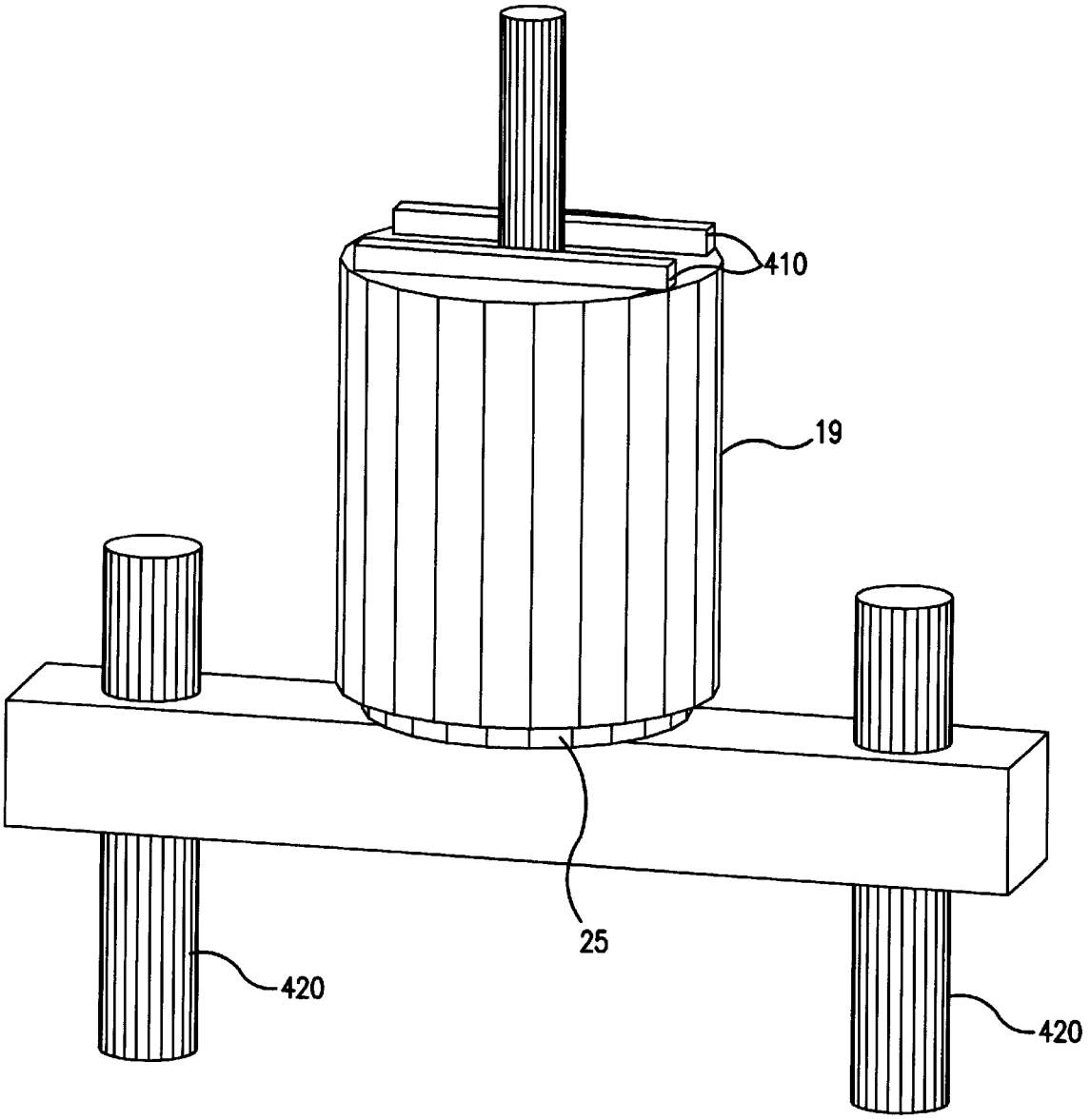
FIG. 40 is a side view of an engine where the compression ratio may be adjusted by lead screws.

FIG. 40 is a side view of an engine showing one means of varying the compression ratio of an engine or other positive displacement device. The relatively fixed piston is mounted on a crossbar 421 which may be moved by lead screws 420. In one alternate embodiment, the crossbar may be mounted on springs so that the compression load would serve to move the piston at higher manifold pressures.

Example—Variable Compression Positive Displacement Device

Figure 41:
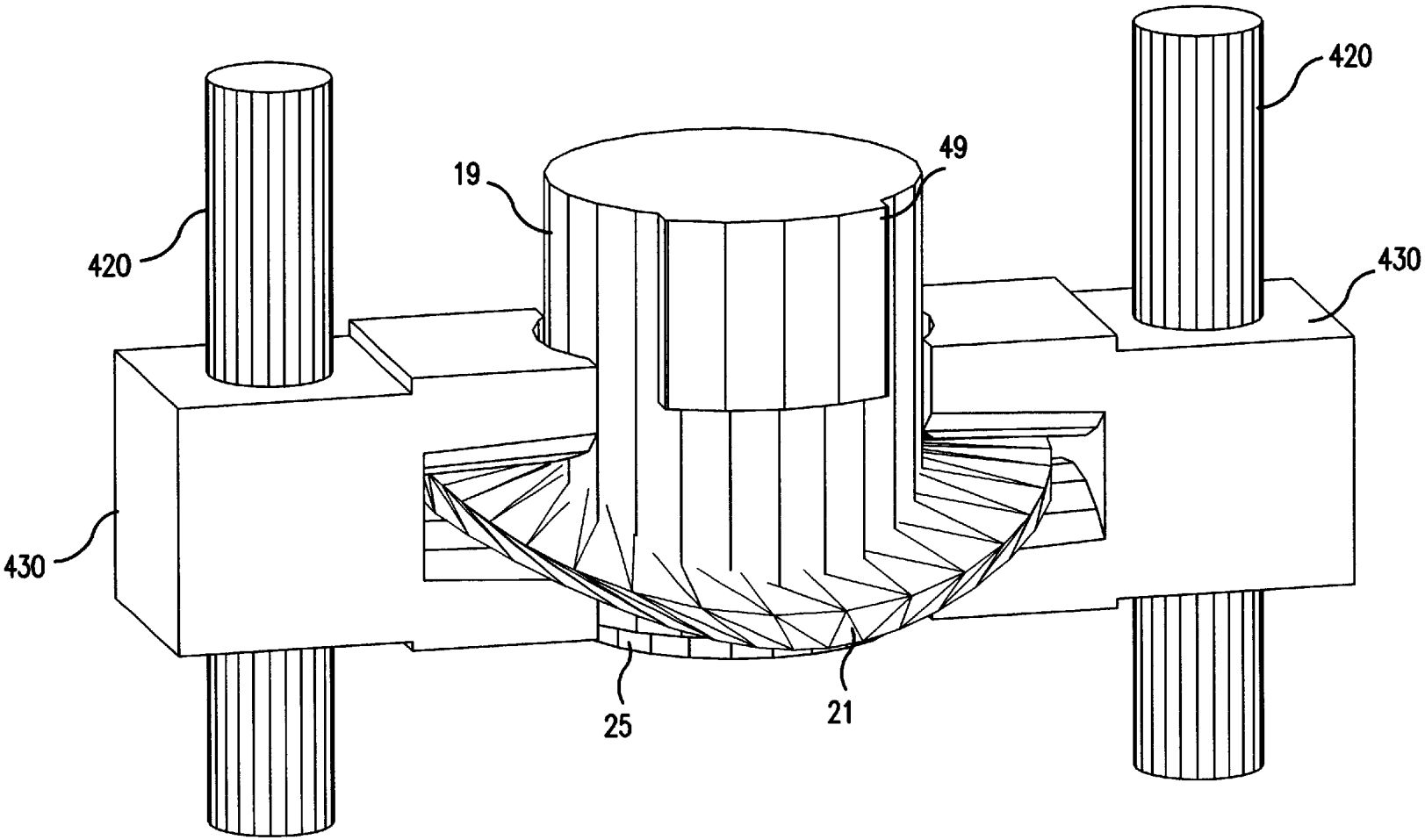
FIG. 41 is a side view of a positive displacement device where the compression ratio may be adjusted by moving the relatively fixed follower means.

FIG. 41 is a side view of a positive displacement device showing another means of varying the compression ratio. In this case, the relatively fixed follower means 430 is adjusted by lead screws 420. The integral cam 21 moves in the same path as before the adjustment, but the cylinder 19 has a steady state displacement imposed on top of its reciprocating motion relative to the fixed piston 25, and the compression ratio will change. This method of adjusting the compression ratio is also appropriate for other path definition means including the moving follower and fixed cam embodiments.

What is claimed is:

1. A positive displacement device having an intake and an exhaust, comprised of:

a convex piston;

a hollow cylinder having one closed end,
the cylinder overlapping the piston;

a means for defining the relative translation and rotation of the piston and the cylinder, such that the piston is generally fixed and the cylinder rotates and translates relative to the piston; and a chamber between the piston and the closed end of the cylinder,
the volume of said chamber being varied by said relative translation and rotation of the piston and cylinder; and such rotation and translation accomplishing the functions of a rotary valve with respect to the intake and exhaust, such that the cylinder contains a recessed volume which serves as a transfer port, and the piston contains a recessed volume which serves as an intake port, such that the intake port, the transfer port, and the chamber are in periodic registry during the cylinder rotation to allow fluid to enter the chamber through the intake port and the transfer port, and the piston contains a recessed volume which serves as an exhaust port, such that the exhaust port, the transfer port, and the chamber are in periodic registry during the cylinder rotation to allow fluid to exit the chamber through the transfer port and the exhaust port.

2. A positive displacement device as in claim 1 wherein:

there is provided a sealing means for the intake port and the exhaust port.

3. A positive displacement device as in claim 1 wherein:

the intake port and the exhaust port occupy less than 180 degrees of the circumference of the piston.

4. A positive displacement device as in claim 1 wherein:

there is an integral cam on the cylinder; and a pair of cams are generally fixed relative to the piston, such that as the cylinder rotates, the integral cam moves between the generally fixed cams.

5. A positive displacement device as in claim 1 wherein:

there is an integral follower on the cylinder; and a pair of cams are generally fixed relative to the piston, such that as the cylinder rotates, the integral follower moves between the generally fixed cams.

6. A positive displacement device as in claim 1 wherein:

the cam is generally fixed relative to the piston; and at least one pair of cam followers are integral to the cylinder, such that as the cylinder rotates, the cam followers move on either side of the generally fixed cam.

7. A four-stroke internal combustion engine having an inlet and an exhaust comprised of:

a generally fixed piston;

a hollow cylinder having one closed end, the cylinder having an inner diameter approximately the same as the diameter of the piston, and configured such that the cylinder overlaps the piston, so that the cylinder may rotate and translate relative to the piston;

a chamber between the piston and the closed end of the cylinder, such that the volume of the chamber can be varied by the translation of the cylinder relative to the piston;

a cam means which couples the translation of the cylinder to its rotation;

at least one opening in the piston which serves as an intake port;

at least one opening in the piston which serves as an exhaust port;

at least on recess in the hollow cylinder which serves as a transfer port;

such that the piston intake port and cylinder transfer port are in periodic registry during the cylinder rotation to allow fluid to enter the chamber through the intake port and transfer port, and such that the piston exhaust port and cylinder transfer port are in periodic registry during the cylinder rotation to allow fluid to exit the chamber through the transfer port and the exhaust port; and a coupling means, such that the rotation and translation of the cylinder is linked to an external load/driver.

8. A four-stroke internal combustion engine having an inlet and an exhaust comprised of:

a generally fixed piston;

a hollow cylinder having one closed end, the cylinder having an inner diameter approximately the same as the diameter of the piston, and configured such that the cylinder overlaps the piston, so that the cylinder may rotate and translate relative to the piston;

a chamber between the piston and the closed end of the cylinder, such that the volume of the chamber can be varied by the translation of the cylinder relative to the piston;

a cam means which couples the translation of the cylinder to its rotation;

at least one opening in the piston which serves as an intake port;

at least one opening in the piston which serves as an exhaust port;

at least on recess in the hollow cylinder which serves as a transfer port;

such that the piston intake port and cylinder transfer port are in periodic registry during the cylinder rotation to allow fluid to enter the chamber through the intake port and transfer port, and such that the piston exhaust port and cylinder transfer port are in periodic registry during the cylinder rotation to allow fluid to exit the chamber through the transfer port and the exhaust port; and a coupling means, such that the rotation of the cylinder is linked to an external load/driver.

9. An engine as in claim 8 wherein:

there is a second relatively fixed piston where the second piston is axially aligned with the first piston; and there is a second closed end cylinder such that the second cylinder is integral to the first cylinder, the primary axis of the second cylinder is parallel with the primary axis of the first cylinder, the second cylinder overlaps the second piston, and the closed ends of the first and second cylinders are located between the first and second piston.

10. An engine as in claim 8 wherein:

the cylinder has an inner diameter in the range of +0.010" to −0.005" relative to the outer diameter of the piston.

11. An engine as in claim 8 wherein:

a fuel is provided to the engine; and the compression ratio and the fuel are selected such that the fuel ignites spontaneously upon compression.

12. An engine as in claim 8 wherein:

a fuel is injected into the chamber.

13. An engine as in claim 8 wherein:

a fuel is injected into the transfer port.

14. An engine as in claim 8 wherein:

a self reacting working fluid is externally supplied.

15. An engine as in claim 8 wherein:

there is an integral cam on the cylinder; and at least one pair of cam followers are generally fixed relative to the piston, such that as the cylinder rotates, the integral cam moves between the followers.

16. An engine as in claim 8 wherein:

the compression ratio is variable, such that the compression ratio can by adjusted by moving the cam followers.

17. An engine as in claim 8 wherein:

there is an integral cam on the cylinder; and a pair of cams are generally fixed relative to the piston, such that as the cylinder rotates, the integral cam moves between the generally fixed cams.

18. An engine as in claim 17 wherein:

the compression ratio is variable, such that the compression ratio can by adjusted by moving the generally fixed cams.

19. An engine as in claim 8 wherein:

there is an integral follower on the cylinder; and a pair of cams are generally fixed relative to the piston, such that as the cylinder rotates, the integral follower moves between the generally fixed cams.

20. An engine as in claim 19 wherein:

the compression ratio is variable, such that the compression ratio can by adjusted by moving the generally fixed cams.

21. An engine as in claim 8 wherein:

the cam is generally fixed relative to the piston; and at least one pair of cam followers are integral to the cylinder, such that as the cylinder rotates, the cam followers move on either side of the generally fixed cam.

22. An engine as in claim 21 wherein:

the compression ratio is variable, such that the compression ratio can by adjusted by moving the generally fixed cam.

23. An engine as in claim 8 wherein:

there is provided a means for introducing a fuel; and there is provided a means for igniting the fuel.

24. An engine as in claim 8 wherein:

a flexible coupling is used to link the rotation of the cylinder to a load/driver.

25. An engine as in claim 8 wherein:

an enclosure houses the cylinder.

26. An engine as in claim 25 wherein:

there is a chamber between the external cylinder surface and the inside of the enclosure;

and the chamber is used as a pumping chamber.

27. An engine as in claim 25 wherein:

there is a support structure is integral to the enclosure.

28. An engine as in claim 25 wherein:

the enclosure contains a lubricant.

29. An engine as in claim 25 wherein:

the enclosure has a cooling means.

30. An engine as in claim 8 wherein:

there is a support structure, such that the structure generally fixes the location of the piston location, and the structure fixes the location of the generally fixed portion of the cam means.

31. An engine as in claim 30 wherein:

the cylinder contacts the support structure at the end of its stroke.

32. An engine as in claim 30 wherein:

the cylinder contacts at least one spring attached to the support structure at the end of its stroke.

33. An engine as in claim 32 wherein:

the spring has a high coefficient of restitution.

34. An engine as in claim 8 wherein:

there is provided a means for sealing between the piston and the cylinder.

35. An engine as in claim 34 wherein:

the means for sealing between the piston and the cylinder is at least one piston ring.

36. An engine as in claim 34 wherein:

the means for sealing between the piston and the cylinder is a means for sealing the intake port, the exhaust port, and the transfer port.

37. An engine as in claim 8 wherein:

the intake port and the transfer port in the piston occupy less than 180 degrees of the circumference of the piston.

38. An engine as in claim 8 wherein:

the engine compression ratio is variable, such that the compression ratio can be adjusted by moving the piston along its axis.

39. A variable compression ratio engine as in claim 38 wherein:

the piston moves passively under the influence of gas pressure.

40. A variable compression ratio engine as in claim 38 wherein:

the piston is moved actively.

41. An engine as in claim 8 wherein:

the engine port timing can be adjusted by rotating the piston about its axis.

42. An engine as in claim 8 wherein:

the transfer port acts as a prechamber.

43. An engine as in claim 8 wherein:

the cam shape is selected to reduce vibration.

44. An engine as in claim 8 wherein:

the cam shape is selected to improve combustion.

45. An engine as in claim 8 wherein:

the displacement divided by the transfer port volume is in the range of 5 to 12.

46. An engine as in claim 8 wherein:

the maximum dimension of the transfer port parallel to the axis of the engine is at least 1.1 times the stroke.

47. A four-stroke internal combustion engine having an inlet and an exhaust comprised of:

a support structure;

a piston which is generally fixed to the support structure;

a hollow cylinder having one closed end, the cylinder having an inner diameter approximately the same as the diameter of the piston, and configured such that the cylinder overlaps the piston, so that the cylinder may rotate and translate relative to the piston;

a chamber between the piston and the closed end of the cylinder, such that the volume of the chamber can be varied by the rotation and translation of the cylinder relative to the piston;

an integral cam on the cylinder;

a pair of cams are generally fixed relative to the piston, such that as the cylinder rotates, the integral cam moves between the generally fixed cams, thereby defining the translation and rotation of the cylinder with respect to the piston;

at least one opening in the piston which serves as an intake port;

at least one opening in the piston which serves as an exhaust port; and at least one recess in the hollow cylinder which serves as a transfer port;

such that the piston intake port and cylinder transfer port are in periodic registry during the cylinder rotation to allow fluid to enter the chamber through the intake port and transfer port, such that the piston exhaust port and cylinder transfer port are in periodic registry during the cylinder rotation to allow fluid to exit the chamber through the transfer port and the exhaust port.

48. An engine as in claim 47 wherein:

a liquid fuel and air are burned in the chamber by means of spark ignition.

49. An engine as in claim 47 wherein:

there is a flexible coupling means to couple the rotation of the cylinder to an external load.

50. A four-stroke internal combustion engine having an inlet and an exhaust comprised of:

a generally fixed piston;

a hollow cylinder having one closed end, the cylinder having an inner diameter approximately the same as the diameter of the piston, and configured such that the cylinder overlaps the piston, so that the cylinder may rotate and translate relative to the piston;

a chamber between the piston and the closed end of the cylinder, such that the volume of the chamber can be varied by the translation of the cylinder relative to the piston;

a means for coupling the translation of the cylinder to its rotation;

at least one opening in the piston which serves as an intake port;

at least one opening in the piston which serves as an exhaust port;

at least on recess in the hollow cylinder which serves as a transfer port;

such that the piston intake port and cylinder transfer port are in periodic registry during the cylinder rotation to allow fluid to enter the chamber through the intake port and transfer port, and such that the piston exhaust port and cylinder transfer port are in periodic registry during the cylinder rotation to allow fluid to exit the chamber through the transfer port and the exhaust port; and a means for coupling the rotation of the cylinder to an external load.

51. A four-stroke internal combustion engine having an inlet and an exhaust comprised of:

a support structure;

a piston which is generally fixed to the support structure;

a hollow cylinder having one closed end, the cylinder having an inner diameter approximately the same as the diameter of the piston, and configured such that the cylinder overlaps the piston, so that the piston may rotate and translate relative to the piston;

a chamber between the piston and the closed end of the cylinder, such that the volume of the chamber can be varied by the rotation and translation of the cylinder relative to the piston;

a means for coupling the translation of the cylinder to its rotation;

at least one opening in the piston which serves as an intake port;

at least one opening in the piston which serves as an exhaust port; and at least one recess in the hollow cylinder which serves as a transfer port;

such that the piston intake port and cylinder transfer port are in periodic registry during the cylinder rotation to allow fluid to enter the chamber through the intake port and transfer port, such that the piston exhaust port and cylinder transfer port are in periodic registry during the cylinder rotation to allow fluid to exit the chamber through the transfer port and the exhaust port.

52. An engine as in claim 51 wherein:

a means for sealing between the piston and cylinder is provided.

53. An engine as in claim 51 wherein:

the fluid is a combination of a liquid fuel and air; and a means for igniting the fluid is provided.

54. An engine as in claim 51 wherein:

a means for coupling the cylinder rotation to an external load is provided.

55. An engine as in claim 51 wherein:

a means for varying the engine compression ratio is provided.

56. An engine as in claim 51 wherein:

a means for varying the engine port timing is provided.

* * * * *